US011654327B2

(12) United States Patent
Phillips et al.

(10) Patent No.: US 11,654,327 B2
(45) Date of Patent: May 23, 2023

(54) SYSTEM FOR UNWEIGHTING A USER AND RELATED METHODS OF EXERCISE

(71) Applicant: ALTERG, INC., Fremont, CA (US)

(72) Inventors: Michael Edward Phillips, Fremont, CA (US); Michael Page McGirr, Fremont, CA (US)

(73) Assignee: AlterG, Inc., Fremont, CA (US)

( * ) Notice: Subject to any disclaimer, the term of this patent is extended or adjusted under 35 U.S.C. 154(b) by 0 days.

(21) Appl. No.: 16/756,864

(22) PCT Filed: Oct. 31, 2018

(86) PCT No.: PCT/US2018/058582

§ 371 (c)(1),
(2) Date: Apr. 17, 2020

(87) PCT Pub. No.: WO2019/089850

PCT Pub. Date: May 9, 2019

(65) Prior Publication Data

US 2021/0187348 A1 Jun. 24, 2021

Related U.S. Application Data

(60) Provisional application No. 62/579,802, filed on Oct. 31, 2017.

(51) Int. Cl.
*A63B 22/02* (2006.01)
*A63B 24/00* (2006.01)

(52) U.S. Cl.
CPC ..... *A63B 22/02* (2013.01); *A63B 24/0087* (2013.01); *A63B 2208/05* (2013.01);
(Continued)

(58) Field of Classification Search
CPC . A63B 22/02; A63B 24/0087; A63B 2208/05; A63B 2209/08; A63B 2220/52;
(Continued)

(56) References Cited

U.S. PATENT DOCUMENTS 44,198 A 9/1864 Jones
54,530 A 5/1866 Hadfield
(Continued)

FOREIGN PATENT DOCUMENTS

CN 2034152 U 3/1989
CN 2208414 Y 9/1995
(Continued)

OTHER PUBLICATIONS

"Feedback Control System;" The Encyclopedia Americana International Edition; pp. 82-84; Dec. 2003.
(Continued)

*Primary Examiner* — Megan Anderson
(74) *Attorney, Agent, or Firm* — Shay Glenn LLP

(57) ABSTRACT

The invention comprises a differential air pressure exercise system, comprising: a base; a pair of uprights on the base dividing the base into a front portion and a rear portion; a bulkhead extending between and vertically moveable relative to the uprights; a right arm and a left arm attached to the bulkhead extending from the bulkhead towards the base rear portion; a chamber support frame coupling element on the right arm and on the left arm; a hinge coupled to the bulkhead between the left and right arms; a chamber support frame extending between the left and right arms and coupled to the hinge to move between an engaged condition and a lowered condition.

19 Claims, 47 Drawing Sheets

(52) U.S. Cl.
CPC ..... *A63B 2209/08* (2013.01); *A63B 2220/52* (2013.01); *A63B 2220/56* (2013.01)

(58) Field of Classification Search
CPC ..... A63B 2220/56; A63B 2208/053; A63B 2208/056
See application file for complete search history.

(56) References Cited

U.S. PATENT DOCUMENTS 60,883 A 1/1867 Hadfield
72,631 A 12/1867 Hadfield
100,867 A 3/1870 Curran
871,074 A 11/1907 Stockton
1,336,774 A 4/1920 Cooper
1,504,166 A 8/1924 Thornley
2,785,004 A 3/1957 Cooper
3,165,314 A 1/1965 Clearman et al.
3,176,793 A 4/1965 Roland
3,292,613 A 12/1966 Macleod
3,332,176 A 7/1967 Knetzer
3,335,529 A 8/1967 Gedney
3,353,309 A 11/1967 Kwake
3,428,015 A 2/1969 Cloud
3,768,467 A 10/1973 Jennings
3,911,913 A 10/1975 June
4,149,712 A 4/1979 Murphy
4,257,407 A 3/1981 Macchi
4,343,302 A 8/1982 Dillon
4,411,422 A 10/1983 Solloway
4,509,513 A 4/1985 Lasley
4,536,163 A 8/1985 Schnirch et al.
4,576,376 A 3/1986 Miller
4,614,337 A 9/1986 Schönenberger
4,621,621 A 11/1986 Marsalis
4,712,788 A 12/1987 Gaudreau, Jr.
4,731,882 A 3/1988 Ekman
4,776,581 A 10/1988 Shepherdson
4,805,601 A 2/1989 Eischen, Sr.
4,887,317 A 12/1989 Phillips et al.
4,934,694 A 6/1990 McIntosh
4,959,047 A 9/1990 Tripp, Jr.
4,974,829 A 12/1990 Gamow et al.
5,029,579 A 7/1991 Trammel
5,075,902 A 12/1991 McReynolds et al.
5,112,045 A 5/1992 Mason et al.
5,133,339 A * 7/1992 Whalen ..... A61H 9/005 128/202.12
5,242,339 A 9/1993 Thornton
5,273,502 A 12/1993 Kelsey et al.
5,295,929 A 3/1994 Weisz
5,356,361 A 10/1994 Watenpaugh
5,368,532 A 11/1994 Farnet
5,372,561 A 12/1994 Lynch
5,398,678 A 3/1995 Gamow
5,527,242 A 6/1996 Gangloff
5,569,129 A 10/1996 Seif-Naraghi et al.
5,571,062 A 11/1996 Saganovsky
5,577,598 A 11/1996 Schoenenberger
5,623,944 A 4/1997 Nashner
5,626,540 A 5/1997 Hall
5,662,311 A 9/1997 Waedekin et al.
5,667,461 A 9/1997 Hall
5,688,225 A 11/1997 Walker
5,702,323 A 12/1997 Poulton
5,706,822 A 1/1998 Khavari
5,738,612 A 4/1998 Tsuda
5,799,652 A 9/1998 Kotliar
5,830,162 A 11/1998 Giovannetti
5,860,857 A 1/1999 Wasastjerna et al.
5,919,419 A 7/1999 Majuri
5,921,892 A 7/1999 Easton
5,960,480 A 10/1999 Neustater et al.
6,027,464 A 2/2000 Dahlquist
6,033,344 A 3/2000 Trulaske et al.
6,042,537 A 3/2000 Kaiser
6,146,315 A 11/2000 Schonenberger
6,162,151 A 12/2000 Tani et al.
6,174,268 B1 1/2001 Novak
6,332,290 B1 12/2001 DeLamare
6,332,354 B1 12/2001 Lalor et al.
6,348,025 B1 2/2002 Schönenberger
6,405,685 B1 6/2002 Cox
6,482,128 B1 11/2002 Michalow
6,527,678 B1 3/2003 Wang et al.
6,539,946 B2 4/2003 Weyergans
6,565,624 B2 5/2003 Kutt et al.
6,609,054 B2 8/2003 Wallace
6,645,126 B1 11/2003 Martin et al.
6,656,091 B1 12/2003 Abelbeck et al.
6,666,831 B1 12/2003 Edgerton et al.
6,689,075 B2 2/2004 West
D495,384 S 8/2004 Rolfes
6,783,482 B2 8/2004 Oglesby et al.
6,821,233 B1 11/2004 Colombo et al.
6,827,669 B2 12/2004 Cohen et al.
6,905,459 B2 6/2005 Humphries, Jr.
6,918,858 B2 7/2005 Watterson et al.
7,141,007 B2 11/2006 Egger
7,166,064 B2 1/2007 Watterson et al.
7,381,163 B2 6/2008 Gordon et al.
7,544,172 B2 6/2009 Santos-Munne et al.
7,556,040 B2 7/2009 Meyer et al.
7,591,795 B2 9/2009 Whalen et al.
7,594,281 B1 9/2009 Stinson et al.
7,837,597 B2 11/2010 Reyes et al.
7,850,629 B2 12/2010 Ravikumar
7,857,731 B2 12/2010 Hickman et al.
7,862,478 B2 1/2011 Watterson et al.
7,883,450 B2 2/2011 Hidler
7,914,420 B2 3/2011 Daly et al.
7,955,219 B2 6/2011 Birrell et al.
7,980,996 B2 7/2011 Hickman
7,985,164 B2 7/2011 Ashby
8,083,643 B2 12/2011 Ng et al.
8,172,724 B2 5/2012 Solomon
8,235,724 B2 8/2012 Gilley et al.
8,447,401 B2 5/2013 Miesel et al.
8,656,516 B1 2/2014 Reinhardt Rawlings et al.
8,762,167 B2 6/2014 Blander et al.
8,840,572 B2 9/2014 Whalen et al.
9,087,454 B2 7/2015 Crivello et al.
9,474,934 B1 10/2016 Krueger et al.
9,483,957 B1 11/2016 Fuemmeler
9,642,764 B2 5/2017 Kuehne et al.
9,672,754 B2 6/2017 Yuen et al.
9,914,003 B2 3/2018 Kuehne et al.
10,265,565 B2 4/2019 Jue et al.
2001/0018564 A1 8/2001 Manor et al.
2002/0022554 A1 2/2002 Borsheim
2002/0032103 A1 3/2002 Cook
2002/0065173 A1 5/2002 Cook
2003/0032904 A1 2/2003 Egger
2003/0204148 A1 10/2003 Lange et al.
2004/0016043 A1 1/2004 Uno et al.
2004/0019304 A1 1/2004 West
2004/0171465 A1 9/2004 Hald et al.
2004/0238285 A1 12/2004 Stokes
2004/0249675 A1 12/2004 Stark et al.
2004/0259689 A1 12/2004 Wilkins et al.
2005/0075680 A1 4/2005 Lowry et al.
2005/0239613 A1 10/2005 Colombo et al.
2006/0009333 A1 1/2006 Wang
2006/0052728 A1 3/2006 Kerrigan et al.
2006/0185065 A1 8/2006 Allen
2006/0190051 A1 8/2006 Gerber et al.
2006/0199712 A1 9/2006 Barnard et al.
2006/0240947 A1 10/2006 Qu
2007/0054783 A1 3/2007 Egger
2007/0219059 A1 9/2007 Schwartz et al.
2007/0272484 A1 11/2007 Helms
2008/0070757 A1 3/2008 Albert
2008/0246581 A1 10/2008 Irie et al.
2008/0281633 A1 11/2008 Burdea et al.

(56) References Cited

U.S. PATENT DOCUMENTS

| | | | | |
|---|---|---|---|---|
| 2008/0306412 | A1 | 12/2008 | Nieminen et al. | |
| 2009/0014004 | A1 | 1/2009 | Whalen et al. | |
| 2009/0036272 | A1 | 2/2009 | Yoo | |
| 2009/0047644 | A1 | 2/2009 | Mensah et al. | |
| 2009/0082700 | A1 | 3/2009 | Whalen et al. | |
| 2009/0221404 | A1 | 9/2009 | Dorogusker et al. | |
| 2009/0236176 | A1 | 9/2009 | Sheu et al. | |
| 2009/0255531 | A1 | 10/2009 | Johnson et al. | |
| 2009/0269728 | A1 | 10/2009 | Verstegen et al. | |
| 2010/0000547 | A1 | 1/2010 | Johnson et al. | |
| 2010/0006737 | A1 | 1/2010 | Colombo et al. | |
| 2010/0170546 | A1 | 7/2010 | Popovic et al. | |
| 2010/0298102 | A1 | 11/2010 | Bosecker et al. | |
| 2011/0071442 | A1 | 3/2011 | Park et al. | |
| 2011/0098157 | A1 | 4/2011 | Whalen et al. | |
| 2011/0098615 | A1 | 4/2011 | Whalen et al. | |
| 2011/0120567 | A1* | 5/2011 | Kuehne | A63B 22/02 137/14 |
| 2011/0179068 | A1 | 7/2011 | O'Brien | |
| 2012/0029666 | A1 | 2/2012 | Crowley et al. | |
| 2012/0238921 | A1* | 9/2012 | Kuehne | A63B 71/0009 601/5 |
| 2012/0277643 | A1 | 11/2012 | Whalen et al. | |
| 2012/0302301 | A1 | 11/2012 | Homsi | |
| 2013/0095459 | A1 | 4/2013 | Tran | |
| 2013/0117908 | A1 | 5/2013 | Dyson | |
| 2013/0325491 | A1 | 12/2013 | Ferrari | |
| 2014/0026893 | A1 | 1/2014 | Johnson et al. | |
| 2014/0058312 | A1 | 2/2014 | Ziehler et al. | |
| 2014/0081661 | A1 | 3/2014 | Fu et al. | |
| 2014/0113775 | A1 | 4/2014 | Egan | |
| 2014/0147820 | A1 | 5/2014 | Snow et al. | |
| 2014/0228985 | A1 | 8/2014 | Elliott et al. | |
| 2015/0011917 | A1 | 1/2015 | Whalen et al. | |
| 2015/0199494 | A1 | 7/2015 | Koduri et al. | |
| 2015/0251055 | A1 | 9/2015 | Ashby | |
| 2015/0325139 | A1 | 11/2015 | Kang et al. | |
| 2015/0379239 | A1* | 12/2015 | Basta | G16H 20/30 434/247 |
| 2016/0000155 | A1 | 1/2016 | Marecek et al. | |
| 2016/0001119 | A1 | 1/2016 | Jue et al. | |
| 2016/0007885 | A1* | 1/2016 | Basta | A61B 5/222 482/5 |
| 2016/0055760 | A1 | 2/2016 | Mirabile | |
| 2016/0073704 | A1 | 3/2016 | Basta et al. | |
| 2016/0242993 | A1 | 8/2016 | Whalen et al. | |
| 2017/0014295 | A1 | 1/2017 | Whalen et al. | |
| 2017/0128769 | A1 | 5/2017 | Long et al. | |
| 2017/0367916 | A1 | 12/2017 | Kuehne et al. | |
| 2019/0046828 | A1 | 2/2019 | Kuehne et al. | |
| 2019/0099315 | A1 | 4/2019 | Kuehne et al. | |
| 2019/0099320 | A1 | 4/2019 | Whalen et al. | |
| 2019/0150530 | A1 | 5/2019 | Basta et al. | |
| 2020/0221975 | A1 | 7/2020 | Basta et al. | |
| 2020/0384309 | A1 | 12/2020 | Long et al. | |
| 2021/0187347 | A1 | 6/2021 | Remsberg et al. | |
| 2021/0196552 | A1 | 7/2021 | Whalen et al. | |
| 2021/0205165 | A1 | 7/2021 | Kuehne et al. | |
| 2021/0251841 | A1 | 8/2021 | Whalen et al. | |
| 2021/0267833 | A1 | 9/2021 | Kuehne et al. | |
| 2022/0054893 | A1 | 2/2022 | Basta et al. | |
| 2022/0059198 | A1 | 2/2022 | Basta et al. | |

FOREIGN PATENT DOCUMENTS

| | | | |
|---|---|---|---|
| CN | 202860021 | U | 4/2013 |
| DE | 20305670 | U1 | 8/2003 |
| DE | 10362043 | A1 | 5/2005 |
| DE | 102006010887 | A1 | 9/2007 |
| GB | 2128488 | A | 5/1984 |
| JP | 59002993 | A | 1/1984 |
| JP | 63109878 | A | 5/1988 |
| JP | 05500760 | A | 2/1993 |
| JP | 05049596 | A | 6/1993 |
| JP | 1022334 | S | 10/1998 |
| JP | 11113988 | A | 4/1999 |
| JP | 2000342713 | A | 12/2000 |
| JP | 2001112886 | A | 4/2001 |
| JP | 2001517187 | A | 10/2001 |
| JP | 200228202 | A | 1/2002 |
| JP | 2002360644 | A | 12/2002 |
| JP | 2004073445 | A | 3/2004 |
| JP | 2005102798 | A | 4/2005 |
| JP | 2007151676 | A | 6/2007 |
| JP | 2008538511 | A | 10/2008 |
| JP | 1395000 | S | 8/2010 |
| JP | 1421980 | S | 8/2011 |
| JP | 2012214936 | A | 11/2012 |
| TW | 425592 | B | 3/2001 |
| TW | I235427 | B | 7/2005 |
| WO | WO2004/103176 | A1 | 12/2004 |
| WO | WO2006/050787 | A1 | 5/2006 |
| WO | WO2006/061834 | A2 | 6/2006 |
| WO | WO2007/038888 | A1 | 4/2007 |
| WO | WO2007/115565 | A2 | 10/2007 |
| WO | WO2008/058567 | A1 | 5/2008 |
| WO | WO-2009051750 | A1 * | 4/2009 | A63B 22/02 |
| WO | WO2010/132550 | A1 | 11/2010 |
| WO | WO-2012129125 | A2 * | 9/2012 | A63B 22/0235 |
| WO | WO2013/019956 | A1 | 2/2013 |
| WO | WO2013/021709 | A1 | 2/2013 |
| WO | WO2014/138228 | A1 | 9/2014 |
| WO | WO2014/138281 | A1 | 9/2014 |
| WO | WO2014/153016 | A1 | 9/2014 |
| WO | WO-2015195983 | A1 * | 12/2015 | A63B 24/0075 |
| WO | WO2019/089850 | A1 | 5/2019 |

OTHER PUBLICATIONS

Hamilton; Low-Tech Alternative to AlterG on Market; Runner's World; 2 pgs.; Aug. 16, 2012; (printed from internet: http://www.runnersworld.com/elite-runners/low-tech-alternative-alterg-market).

Hargens et al.; Lower body negative pressure to provide load bearing in space; Aviat Space Environ Med; 62(10); pp. 934-937; Oct. 1991.

Kawai et al.; Rehabilitation apparatus for treadmill walking using lower body positive pressure (Japanese & English abstracts); Aerospace and Environmental Medicine; vol. 44; No. 4; 2007.

Vacu Well Wellness & Beauty; Company History and Vacu Well Power Professional treadmill specifications; printed from website (http://www.vacuwell.com); 3 pgs.; printed Apr. 4, 2012.

Whalen et al.; Design U.S. Appl. No. 29/337,097 entitled "Adjustable Positive Pressure Support System," filed May 14, 2009.

Basta et al.; U.S. Appl. No. 16/254,503 entitled "Systems and methods for management and scheduling of differential air pressure and other unweighted or assisted treatment systems," filed Jan. 22, 2019.

Jue et al.; U.S. Appl. No. 16/391,167 entitled "Support frame and related unweighting system," filed Apr. 22, 2019.

* cited by examiner

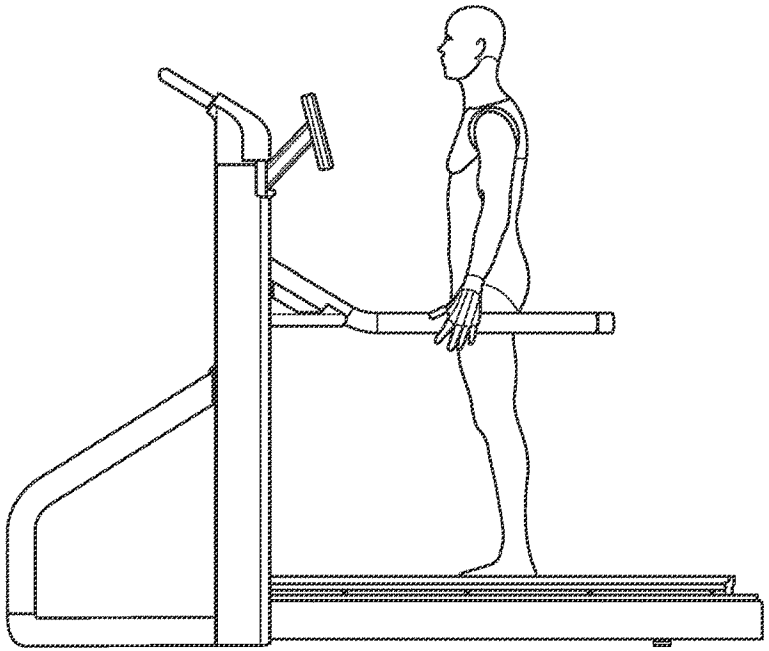
FIG. 27A
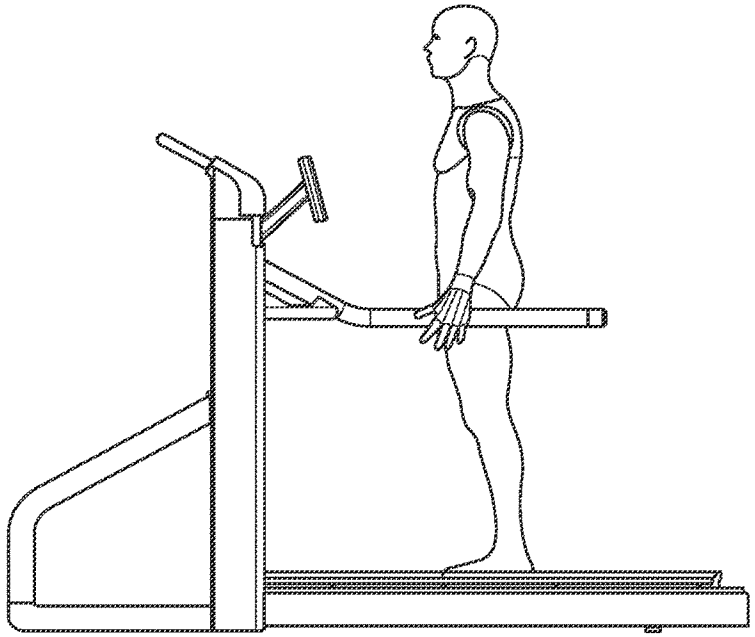
FIG. 27B
IRD height spec: 5' to 6'4" . Anthropomorphic data:
| Percentile (Woman) | Height | (Waist to foot) length | Weight | Percentile(Man) | Height | (Waist to foot) length | Weight |
|---|---|---|---|---|---|---|---|
| 1% ile | 4.84 feet / 58.1 inches | 29.6 inches | 93 lb | 1% ile | 5.21 feet / 62.6 inches | 32.5 inches | 100.3 lb |
| 50% ile | 5.33 feet / 64 inches | 33.4 inches | 137.5 lb | 50% ile | 5.75 feet / 69.1 inches | 36.5 inches | 172 lb |
| 99% ile | 5.81 feet / 69.8 inches | 36.56 inches | 217.6 lb | 99% ile | 6.3 feet / 75.6 inches | 40.1 inches | 244 lb |
FIG. 27C

SYSTEM FOR UNWEIGHTING A USER AND RELATED METHODS OF EXERCISE

CROSS REFERENCE TO RELATED APPLICATION

This patent application claims priority to U.S. provisional patent application No. 62/579,802, filed Oct. 31, 2017, titled "SYSTEM FOR UNWEIGHTING A USER AND RELATED METHODS OF EXERCISE".

INCORPORATION BY REFERENCE

All publications and patent applications mentioned in this specification are herein incorporated by reference in their entirety to the same extent as if each individual publication or patent application was specifically and individually indicated to be incorporated by reference.

FIELD

This application relates to the field of exercise or therapy systems in particular exercise or therapy systems that controllably generate and maintain an unweighted environment using a mechanical system or a differential air pressure (DAP) envelope about a user so as to at least partially or completely unweight the user. This application also relates to improved control systems for pressure chambers for use in differential air pressure (DAP) systems including data collection and utilization for general fitness use, athletic use, or medical use treadmills and related software, control and analytics systems, especially as related to obtaining gait data from load cells provided in the system. Additional improvements to the control system are also disclosed.

BACKGROUND

Conventional treadmills and other cardiovascular load inducing training equipment have historically used analog interfaces for the display of information and interactivity for adjusting various control settings such as treadmill speed, incline degree, amount of unweighting, and the like during the session. As a result, conventional treadmill and exercise equipment data has mostly existed in a fitness environment. As such, the user data collected lacks the necessary privacy and security, communication and payment management features required by the medical industry. To date, utilization of cloud connected exercise equipment has been almost non-existent in medical facilities due to privacy and confidentiality challenges to protected health information (PHI) required by the Health Insurance Portability and Accountability Act (HIPAA) and the Health Information Technology for Economic and Clinical Health (HITECH) Act. HIPAA and HITECH define PHI as individually identifiable health information including demographic information such as date of birth and zip code, that: (A) is created or received by a health care provider, health plan, public health authority, employer, life insurer, school or university, or health care clearinghouse; and (B) relates to the past, present, or future physical or mental health or condition of any individual, the provision of health care to an individual, or the past, present, or future payment for the provision of health care to an individual.

Differential Air Pressure (DAP) partial unweighting systems have typically been designed for Physical Therapists for direct use with their patients. Such systems typically contain a treadmill, a flexible bag that applies air pressure to the lower portion of the user's body, and large, continuous, unobstructed windows in the bag, that allow a therapist to observe a patient's gait mechanics in order to provide feedback and to assess issues or progress.

Expanding into markets beyond the specialized requirements of PTs, the need exists for different system capabilities as well as improved data collection modes and methods.

Differential Air Pressure (DAP) partial unweighting systems have typically comprised an OEM treadmill enclosed in a flexible bag that applies air pressure to the lower portion of the user's body. Mechanical unweighting systems have also been described.

The need exists for improved range of DAP system sizing and for additional systems allowing a user to more readily gain access to a DAP chamber. Still further improvements are needed for unweighting systems to be easier to maintain, and easier for users to access as well as equipped to meet the requirements of privacy and confidentiality required for patient medical records, including the data and patient electronic health records created, generated, updated before, during or after performing unweighting therapy.

SUMMARY OF THE DISCLOSURE

In general, in one embodiment, a differential air pressure exercise system includes a base, a pair of uprights on the base dividing the base into a front portion and a rear portion, a bulkhead extending between and vertically moveable relative to the uprights, a right arm attached to the bulkhead extending from the bulkhead towards the base rear portion, a left arm attached to the bulkhead extending from the bulkhead towards the base rear portion, a chamber support frame coupling element on the right arm, a chamber support frame coupling element on the left arm, at least one hinge coupled to the bulkhead between the left arm and the right arm, and a chamber support frame extending between the left arm and the right arm. The chamber support frame is coupled to the at least one hinge to move between an engaged condition wherein a portion of the chamber support frame is coupled to the chamber support frame coupling element on the right arm and a portion of the chamber support frame is coupled to the chamber support frame coupling element on the left arm and a lowered condition wherein the chamber support frame is uncoupled from both the chamber support frame coupling element on the right arm and the chamber support frame coupling element on the left arm.

This and other embodiments can include one or more of the following features. The support frame coupling element on the right arm and the left arm can be magnets and the chamber support frame can be formed from a magnetic material. The support frame coupling element on the right arm and the left arm can be formed from a magnetic material and the chamber support frame can further include one or more magnets to couple to the left arm and the right arm. The system can further include a differential air chamber bag that is at least partially conformable to the base, the bag having a left side panel, a right side panel, a rear panel and a top panel. The top panel can further include an opening, and a set of loops sized to receive the chamber support frame when the chamber support frame is within the set of loops on the top panel and the chamber support frame is in the engaged condition the opening is between the right arm and the left arm. The top panel can further include an opening, and a set of loops sized to receive the chamber support frame when the chamber support frame is within the set of loops on the top panel and the chamber support frame is in the lowered condition the rear panel is folded down and the opening is adjacent to a portion of the folded rear panel. The folded rear portion can include a transparent portion. The top panel can further include an opening, and a set of loops sized to receive the chamber support frame when the chamber support frame is within the set of loops on the top panel the chamber support frame extends from the bulkhead along a right side of the top panel, along a left side of the top panel and only partially along a right side and a left side of the opening. The top panel can further include an opening, and a set of loops sized to receive the chamber support frame wherein the chamber support frame is U-shaped with the bottom of the U shape coupled to the at least one hinge and the arms extending along and within the set of loops on the top panel wherein a portion of the opening extends beyond the ends of the chamber support frame arms. The bag can be sealed in the front portion and the rear portion. The system can further include an enclosure adjacent the pair of uprights in the front portion of the base. The system can further include a computer controller and a differential air pressure source in the enclosure wherein an outlet of the differential air pressure source is coupled to an inlet in the differential air pressure chamber bag. The differential air pressure source can be a pump under control of the computer controller. The pump can be one of a variable speed blower, a fixed speed pump, a variable speed pump, a centrifugal pump or a recirculating pump. The system can further include a valve with an inlet coupled to the differential air pressure chamber bag and an exhaust within the enclosure. The system can further include a muffler on a pump exhaust. The valve can be a plunger valve or a butterfly valve under control of the computer controller. The system can further include a display coupled to an upright of the pair of uprights. The system can further include a display coupled to the bulkhead between the right arm and the left arm. The system can further include a treadmill within the base. The system can further include an exercise platform within the base. The system can further include a pair of retractable pins on the bulkhead, a series of holes along a surface of each of the uprights adjacent to the bulkhead positioned for engagement with one pin of the pair of retractable pins. The system can further include a release mechanism on the bulkhead configured to move the retractable pins from engagement with one of the holes along the surface of each of the uprights. The release mechanism can be a slider that moves across a face of the bulkhead. The release mechanism can be a pull bar. The holes spaced along the surface of each of the uprights can provide a fixed position of the arms and bulkhead at a plurality of predetermined user inseams lengths. The holes spaced along the surface of each of the uprights can provide a fixed position of the bulkhead when the pins are engaged with the holes to position the left arm and the right arm alongside a user's hips. The holes spaced along the surface of each of the uprights can provide a fixed position of the bulkhead when the pins are engaged so that the differential air pressure system accommodates a user having a waist to foot measurement between 29 inches and 42 inches.

In general, in one embodiment, a differential air pressure chamber bag includes a left side panel, a right side panel, a rear panel, a front panel, a top panel having an opening, a zipper along the top panel opening, a chamber sealing member having a zipper spacer, a first zipper on a first side of the zipper spacer configured to couple to the zipper in the top panel opening and a second zipper on a second side of the zipper spacer configured to couple to a user zipper. A chamber gasket is adjacent to the first zipper and a first user gasket adjacent to the second zipper.

This and other embodiments can include one or more of the following features. The differential air pressure can further include a chamber liner adjacent to the first zipper and a user liner adjacent to the second zipper. In use the first zipper moves along the chamber liner when coupling to the zipper in the top panel and the second zipper moves along the user liner when coupling to a user zipper. The zipper spacer can be dimensioned. The first zipper can be separated from the second zipper by from 0.5 inches to 6 inches. The first zipper teeth spacing can be different from the second zipper teeth spacing. The differential air pressure bag can further include a user seal having a user zipper and a second user gasket wherein the user zipper is coupled to the second zipper the first user seal gasket is against the second user gasket. The zipper teeth spacing on the user zipper and the second zipper can be different from the zipper spacing on the first zipper.

In general, in one embodiment, a method of providing a differential air pressure session for a user includes: (1) stepping onto a first folded portion of a differential air pressure bag; (2) stepping into a zippered opening in a top panel of the differential air pressure bag; (3) moving the top panel of the differential air pressure bag about a hinge to bring the zippered opening into position for coupling to a zipper worn by the user; and (4) zipping the user into the zippered opening in the top panel.

In general, in one embodiment, a method of performing a differential air pressure therapy includes: (1) positioning a differential air pressure bag and cockpit in a folded position by moving a hinged chamber frame permitting ingress of a user into an opening in a top panel of a differential air pressure chamber pressure bag; (2) moving the hinged chamber frame to position the opening in the top panel adjacent to a seal worn by the user; and (3) coupling the user seal to the opening in the top panel to form a suitable DAP seal about a portion of the user's body.

This and other embodiments can include one or more of the following features. After the moving step, the hinged chamber frame can be coupled to a first arm and a second arm of the differential air pressure chamber. The method can further include coupling a chamber sealing member into the opening prior to positioning the user in the opening. The chamber sealing member can include a chamber seal and a user seal.

BRIEF DESCRIPTION OF THE DRAWINGS

The novel features of various aspects of the invention are set forth with particularity in the claims that follow. A better understanding of the features and advantages of the present invention will be obtained by reference to the following detailed description that sets forth illustrative embodiments, in which various principals of the invention are utilized, and in the accompanying drawings of which:

FIG. 4A includes a center display mounted on an upright member. The DAP system of FIG. 4A also includes an optional rear ramp with a receiver for a pair of rear access handrails.

FIG. 6B also shows the relationship of the left arm mount between the left side of the center display and the left upright. Two transparent panels are located in the bag rear panel one each along the angled top and bottom sides. The left side panel and right side panels have transparent and non-transparent portions with an angled boundary between along the transition that is placed to minimize folding or creasing of the transparent portion when the DAP chamber is placed in a lowered condition.

FIG. 12A shows the bulkhead at the upper most travel for a bulkhead a positioned in as in FIG. 6A. FIG. 12B shows the bulkhead at the bottom of travel as shown in FIGS. 7A and 7B.

FIGS. 27A, 27B and 27C provide various details of male and female anthropomorphic data that may be used to determine the pre-set user inseam heights in various alternative DAP chamber configurations and for determining the range of travel for the bulkhead.

DETAILED DESCRIPTION

Figure 1:
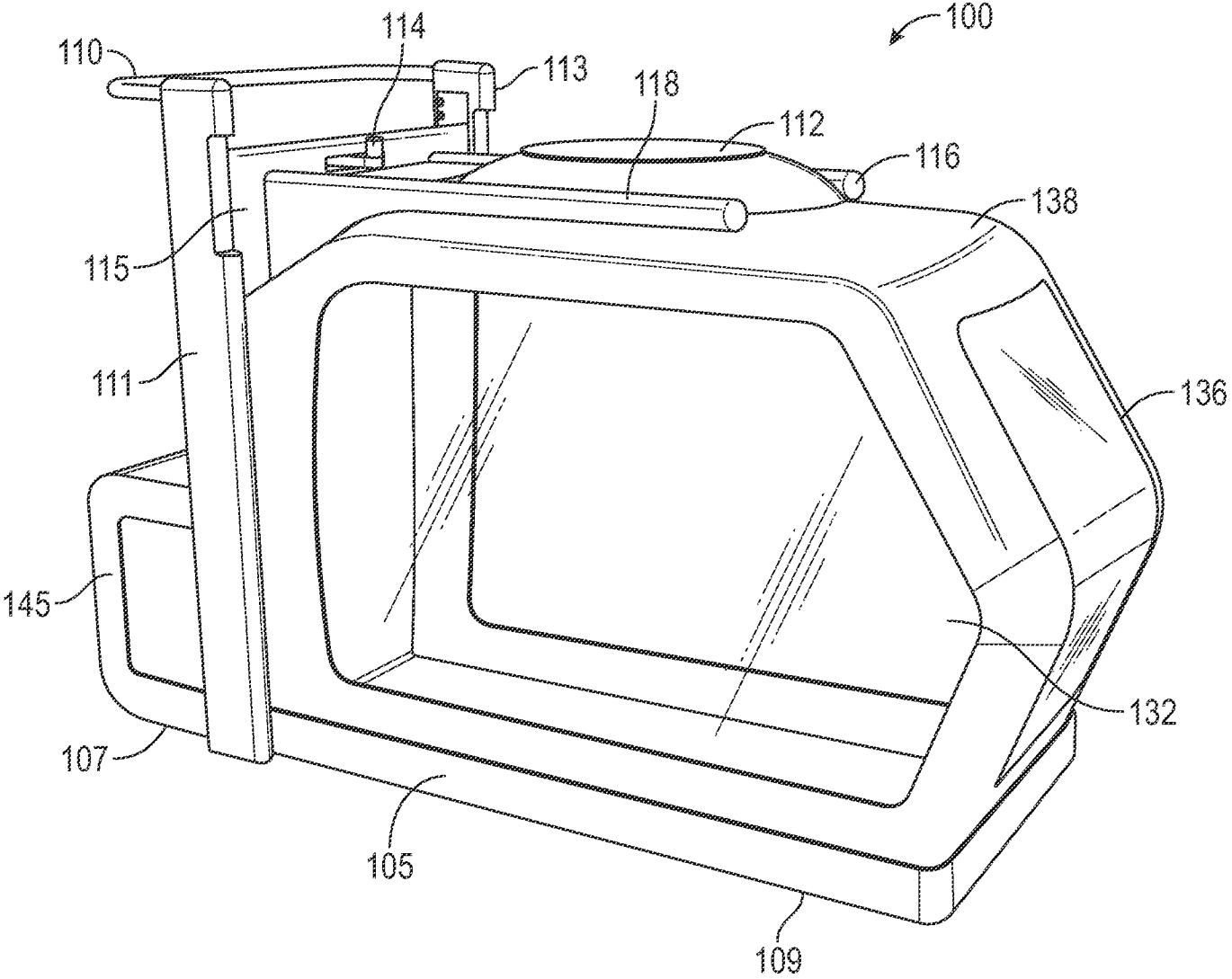
FIG. 1 is a left side rear aspect of view of the differential air pressure system having improved user access and preset user cockpit range of sizes. The DAP system releases the moving bulkhead to adjust between a number of pre-set user heights through motion of the lever in the center of the bulkhead. An enclosure is located in the front of the system that contains electronics, a DAP pressure source and, optionally, valves, pumps or mufflers. The DAP chamber has a top panel and user cockpit between the left and right arms that extend from the bulkhead. The chamber top panel is shown in the engaged condition coupled to the arms.

Exemplary DAP systems, components and operation are illustrated and described in U.S. Pat. No. 7,591,795, U.S. Patent Application Publication No. US-2011-0098615-A1, U.S. Pat. No. 8,464,716, and U.S. Patent Application Publication No. US 2017/0128769. The commercially available AlterG P200 and M320 models are typical of existing DAP systems that are designed for physical therapists and athletic trainers. These systems comprise an exercise device, typically a treadmill, a flexible bag that applies air pressure to the lower portion of the user's body, an airtight garment which interfaces between the flexible bag and the user, and a height adjustable cockpit structure to set the height of the bag top surface to accommodate different height users. Additional details of DAP systems are provided in U.S. Provisional Patent Application 62/574,138 filed on Oct. 17, 2017 entitled "GAIT DATA COLLECTION AND ANALYTICS SYSTEM AND METHODS FOR OPERATING UNWEIGHTING TRAINING SYSTEMS," and in Patent Cooperation Treaty Application Serial Number PCT/US2018/056297 entitled "GAIT DATA COLLECTION AND ANALYTICS SYSTEM AND METHODS FOR OPERATING UNWEIGHTING TRAINING SYSTEMS," filed Oct. 18, 2018 incorporated herein by reference in its entirety.

There are available various unweighting systems suited to training users or patients in different categories based on a number of factors such as, for example, patient ability to access the machine, the specific training needs of the patient and the physical capabilities of the patient as well as whether the patient requires assistance during training and if so to what degree. The systems include air pressure unweighting systems and mechanical unweighting systems.

Air pressure unweighting systems can include differential air pressure (DAP) systems and non-DAP systems. A number of differential air pressure systems for various levels of patient assistance before, during or after use are described in the non-provisional patent application entitled "Differential Air Pressure Systems and Methods of Using and Calibrating Such Systems for Mobility Impaired Users" application Ser. No. 13/423,124 filed on Mar. 16, 2012 ("the '124 application") and U.S. Provisional Application No. 62/049,307, filed Sep. 11, 2014, titled "Unweighted Training Systems and Methods of Using and Calibrating Such Systems for Mobility Impaired or Obese Users" ("the '307 application"). The entireties of these applications are incorporated herein by reference.

Other air pressure unweighting systems are described at U.S. Provisional Application No. 62/013,999, filed Jun. 18, 2014, titled "Differential Air Pressure Treadmill System" and U.S. Provisional Application No. 62/024,916, filed Jul. 15, 2014, titled "Pressure Chamber and Lift for Differential Air Pressure System", the disclosures of which are incorporated herein by reference in their entireties.

In addition, this application may be related to operation of any of the unweighting systems or auxiliary systems or patient interface embodiments described in any of the following patent applications, each of which is herein incorporated by reference in its entirety: U.S. Provisional Application No. 61/785,402 filed on Mar. 14, 2013; International Application No. PCT/US2014/028032 filed on Mar. 14, 2014. U.S. Pat. No. 7,591,795 issued on Sep. 22, 2009; U.S. application Ser. No. 12/236,459 filed on Sep. 23, 2008; U.S. application Ser. No. 12/236,465 filed on Sep. 23, 2008; U.S. application Ser. No. 12/236,468 filed on Sep. 23, 2008; International Application No. PCT/US2006/038591 filed on Sep. 28, 2006; U.S. Provisional Application No. 60/999,102 filed on Oct. 15, 2007; U.S. Provisional Application No. 60/999,101 filed on Oct. 15, 2007; U.S. Provisional Application No. 60/999,061 filed on Oct. 15, 2007; U.S. Provisional Application No. 60/999,060 filed on Oct. 15, 2007; U.S. application Ser. No. 12/761,316 filed on Apr. 15, 2010; U.S. application Ser. No. 12/761,312 filed on Apr. 15, 2010; International Application No. PCT/US2008/011832 filed on Oct. 15, 2008; International Application No. PCT/US2008/011807 filed on Oct. 15, 2008; U.S. Provisional Application No. 61/178,901 filed on May 15, 2009; U.S. application Ser. No. 12/778,747 filed on May 12, 2010; International Application No. PCT/US2010/034518 filed on May 12, 2010; U.S. Design Application No. 29/337,097 filed on May 14, 2009; U.S. Provisional Application No. 61/454,432 filed on Mar. 18, 2011; U.S. application Ser. No. 13/423,124 filed on Mar. 16, 2012; International Application No. PCT/US12/29554 filed on Mar. 16, 2012; U.S. Pat. No. 5,133,339 issued on Jul. 28, 1992; U.S. Provisional Application No. 61/651,415 filed on May 24, 2012; U.S. Provisional Application No. 61/785,317 filed on Mar. 14, 2013, titled "METHOD OF GAIT EVALUATION AND TRAINING WITH DIFFERENTIAL PRESSURE SYSTEM"; International Application No. PCT/US2014/029578 filed on Mar. 14, 2014; U.S. Patent Application Publication No. 2016/00007885; U.S. Provisional Application No. 61/784,387 filed on Mar. 14, 2013, titled "SUPPORT FRAME AND RELATED UNWEIGHTING SYSTEM"; International Application No. PCT/US2014/029002 filed on Mar. 14, 2014; U.S. Provisional Application No. 61/772,964 filed on Mar. 5, 2013; International Application No. PCT/US2014/020741 filed on Mar. 5, 2014; U.S. Provisional Application No. 61/773,019 filed on Mar. 5, 2013; U.S. Provisional Application No. 61/773,037 filed on Mar. 5, 2013; International Application No. PCT/US2014/020863 filed Mar. 5, 2014; U.S. Provisional Application No. 61/773,048 filed on Mar. 5, 2013; International Application No. PCT/US2014/020934 filed on Mar. 5, 2014; U.S. Provisional Application No. 61/784,664 filed on Mar. 14, 2013 titled "UNWEIGHTING GARMENTS"; U.S. Provisional Application No. 61/784,510 filed on Mar. 14, 2013, titled "CANTILEVERED UNWEIGHTING SYSTEMS"; International Application No. PCT/US2014/028694 filed on Mar. 14, 2014; U.S. Provisional Application No. 62/049,307 filed on Sep. 11, 2014, titled "UNWEIGHTED TRAINING SYSTEMS AND METHODS OF USING AND CALIBRATING SUCH SYSTEMS FOR MOBILITY IMPAIRED OR OBESE USERS"; U.S. Provisional Application No. 62/013,999 filed on Jun. 18, 2014, titled "DIFFERENTIAL AIR PRESSURE TREADMILL SYSTEM"; U.S. Provisional Application No. 62/042,916 filed pm Jul. 15, 2014, titled "PRESSURE CHAMBER AND LIFT FOR DIFFERENTIAL AIR PRESSURE SYSTEM"; U.S. Provisional Application No. 62/049,149 filed on Sep. 11, 2014, titled "UNWEIGHTING GARMENTS", each of which are incorporated by reference its entirety.

Any of the above described unweighting training system or methods of providing unweighting therapy may be modified to include one of more of the additional aspects of DAP system design, operation or methods of use as detailed herein.

In some embodiments, the DAP systems employing the inventive integrated treadmill base have a lower step height than DAP systems by use of a platform base pan to receive the DAP exercise device. This is especially important for low mobility users. In addition, the use of center bag and with removable arms may permit the embodiments described herein to be assembled and tested and then partially dissembled for shipping. Embodiments of the various DAP system also provide for a limited user inseam range. The reduction in available inseam heights also contributes to lowering the overall height of the DAP system for shipping and installation. Moreover, installation techniques may be simplified since a requirement for a high or wide door opening is no longer required. Shipping of DAP systems is also potentially less expensive since the lowered height of the system lends to the use of smaller shipping containers. The removable and inter changeable cockpit supports or arm rails (as in a U-shaped or Y-shaped chamber support frame configuration or other support frame shape with an open rear cockpit) also helps with various modular aspects of the DAP system but also aids in shipping.

Figure 4A:
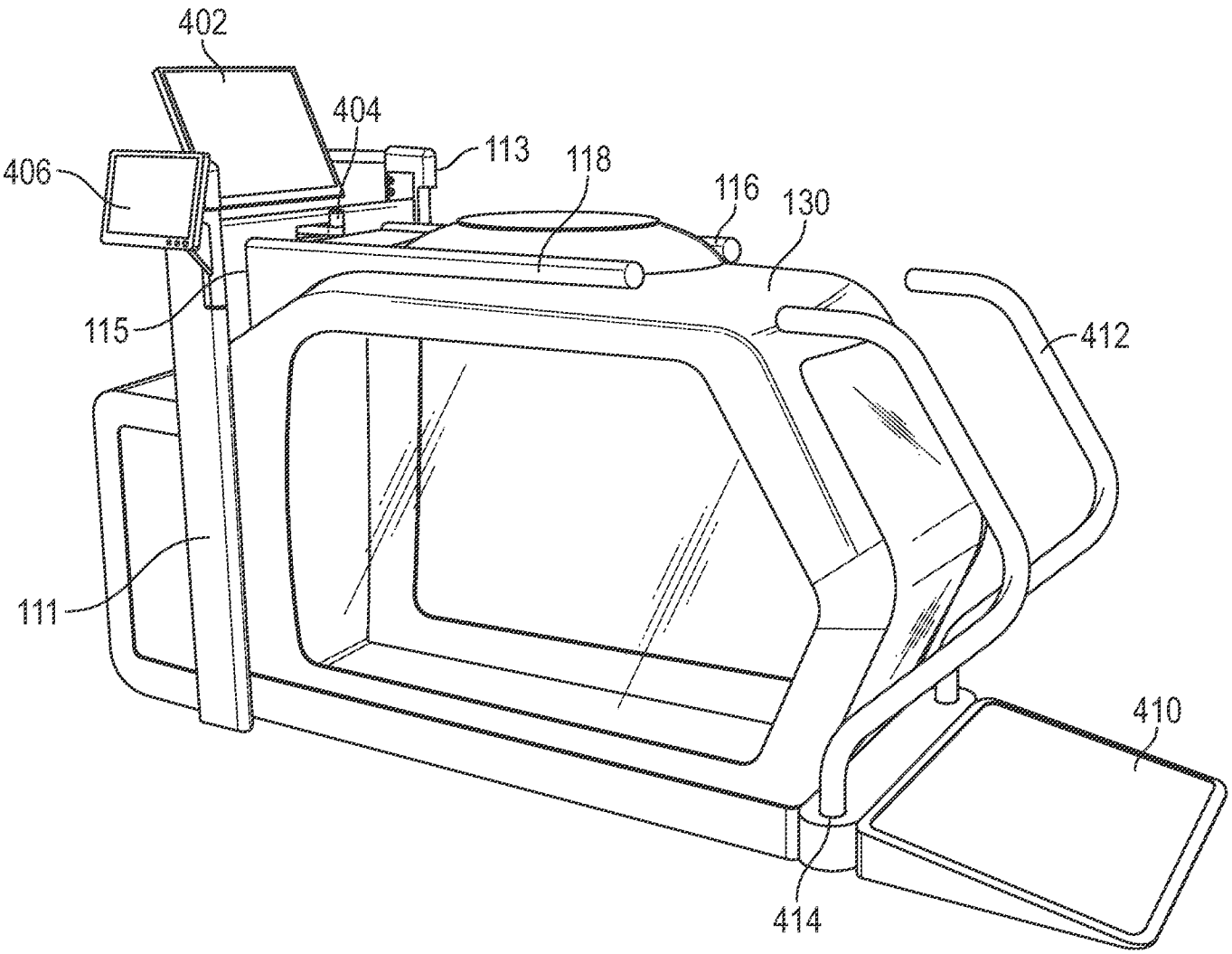
FIG. 4A is a left side rear aspect of view of a differential air pressure system similar to FIG. 3.
Figure 4B:
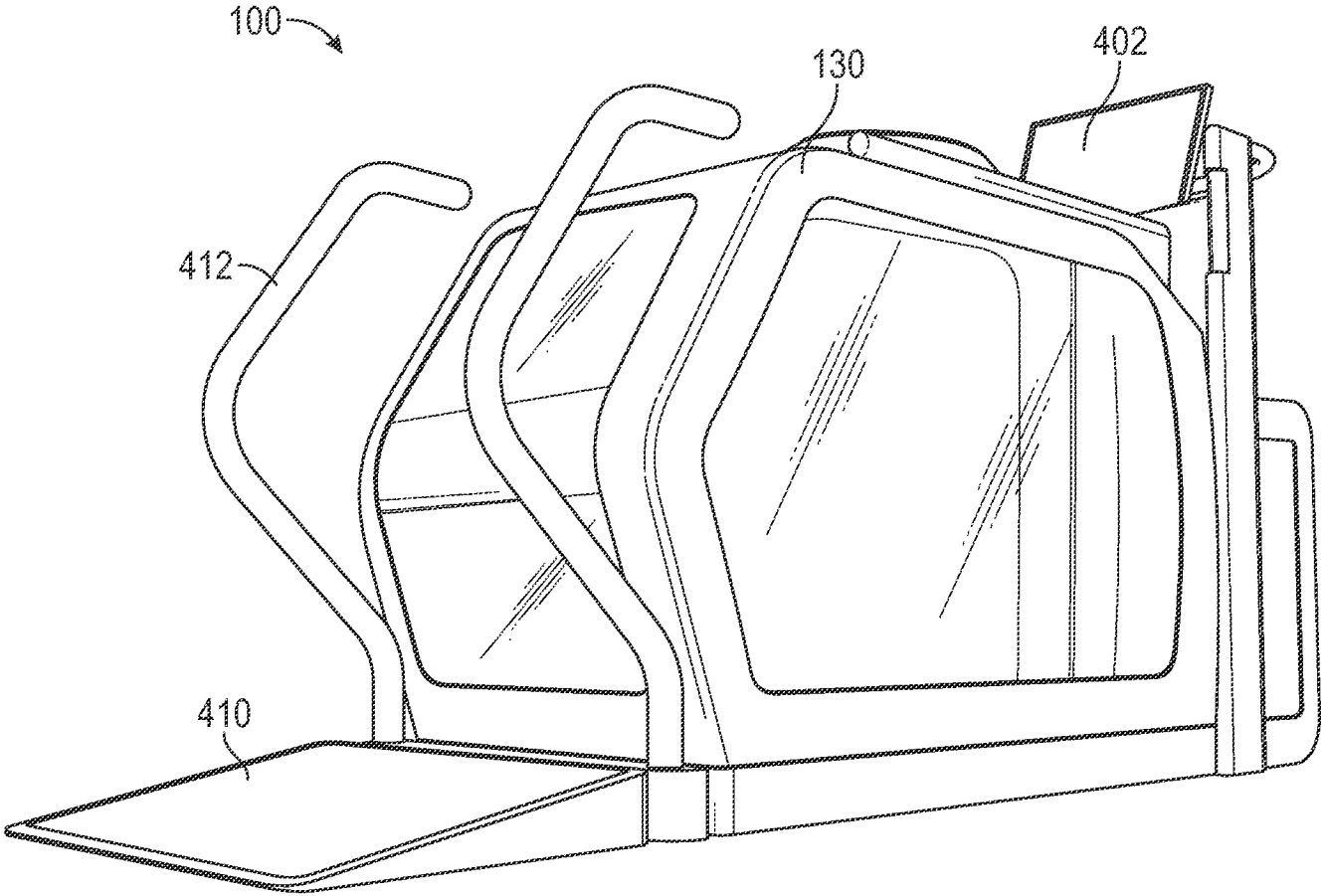
FIG. 4B is a right side rear aspect of the differential air pressure system of FIG. 4A showing the ramp mounted to the rear of the DAP system platform and the rear access handrails. The rear access handrails extend to the top of the inflated DAP chamber as shown but are not connected to the left and right arms connected to the movable bulkhead.

In various embodiments, there a various views of the differential air pressure system removable railings and access ramp as in FIGS. 4A and 4B. One or more displays, user interfaces or screens may also be removed for compact storage or shipping.

In addition, various details of the system components and operation of exemplary DAP systems and various operations of treadmill based DAP therapy systems as described herein, may also be modified or adapted to bring these advantageous designs to one or more of the various embodiments described herein, to those DAP systems described in commonly assigned U.S. Pat. No. 7,591,795; U.S. Patent Application Publication 2011/0098615; and U.S. Patent Application publication 2011/0120567, each of which is incorporated herein by reference in its entirety for all purposes.

The DAP system may have a modular base includes a platform pan adapted to receive a variety of different training devices.

In one embodiment, the DAP chamber base includes a platform pan. The platform pan is a recessed or adapted portion of the lower aspect of the DAP chamber that receives a training device. (SEE FIGS. 10A, 10B and 10C). The training device supports the user while the user is engaged with a DAP chamber or undergoing a DAP training session. In one configuration, the platform pan is configured so that in use the upper surface of the training device or the surface that interacts with or supports the user is flush with the edge of the platform. As a result of the alignment in this configuration between the upper surface of the training device and the platform, the user is provided with a level surface within the DAP chamber whether from the surface of the training device or a perimeter or edge of the platform. In still another aspect, the training device includes one or more pairs of load cells, position sensors, pressure sensors or other suitable biomechanical measurement instruments. The one or more biomechanical measurement instruments are positioned in relation to the specific type of training device and adapted to provide information about the balance, loading, pressure, balance, posture, gait or other biomechanical indicia of the user based on the type of DAP training being performed on a training platform. In one embodiment, the training device is a pressure mat. In another embodiment, the training device is a balance board. In still another aspect, the training device in the platform pan is a treadmill. In one embodiment, the treadmill is a belt treadmill. In another aspect, the treadmill is a slat treadmill. DAP systems where the DAP training device is a treadmill are illustrated and described with regard to all embodiments with the extended base. In other specific embodiments, the training device is a treadmill that does not incline. In each of the above embodiments, the software control systems are configured to detect or have indicated the type of training device present in the platform pan. The DAP control system and operational parameters are adapted according to the features and characteristics of the specific type of training device positioned within the platform pan within the DAP chamber.

Platform base is adapted to receive accessories to increase access for impaired patients. In one aspect, a portion of the DAP chamber or platform base is configured to support handrails. In one embodiment, one end of the handrail is engaged to a rear aspect of the platform and extends upward to a position near the user seal. In another aspect, an access ramp is connected to the rear of the platform and provides a smooth transition up to the platform base. The ramp may be hinged to the platform or joined to the platform using any suitable mechanical fit connection. Illustrative handrails and access ramp are shown and described with regard to FIGS. 4A and 4B.

In some embodiments, the DAP system includes a touchpad or electronic user interface is off axis as in FIGS. 3, 4A, 5A, 5B, 5C. In some embodiments, the DAP system includes a centrally located screen as in FIGS. 4A and 6B. In some embodiments, the DAP system only has an off axis interaction screen leaving the central axis of the DAP system open with an unobstructed forward view. In some embodiments, there is no user interaction screen coupled to the system as illustrated and described with regard to FIG. 1. In one exemplary embodiment, a DAP system so configured is controlled remotely or by a mobile device that is not attached to the DAP system.

In other aspects, there are improvements to a DAP calibration algorithm employed in a DAP system. The purpose of a calibration algorithm is to determine the appropriate DAP chamber or bag pressure to lift the subject by a specific amount of weight. Reliable calibration is useful in ensuring repeatability and controllability of the DAP user experience. The pressure response of the system depends on several factors including the fit of the shorts and the general size and shape of the subject. In some embodiments, the DAP calibration algorithm may be provided as described in co-pending and commonly assigned PCT Patent Application No. PCT/US2018/056297.

Aspects of the DAP system software provide computer readable instructions for implementing various aspects of an adaptive DAP system implementing Stride Smart. In exemplary embodiments, there is provided DAP system with treadmill as DAP training device including computer controlled DAP system software including Stride Smart or other user gait assessment system. In one embodiment, the DAP system collects user gait data or other biometric information during DAP training session and using computer readable instructions implements one or more steps of coordinating DAP system parameters to achieve one or more desired user biometric indications or gait parameters, such as: Monitor gait parameters with a goal of achieving targeted gait parameters "normal" gait for the user; or change the body weight, speed & incline to achieve normal gait of the user; or providing high read rate, nearly continuous or continuous reading of the load cell data and the incoming gait data; or using collected biometric and/or load cell data, one or more computer readable instructions adjust the variables to achieve a "normal" gait for the user; or other computer readable instructions to have the DAP control system behave as a "virtual therapist" to monitor or influence pre-determined DAP, gait, user, or physician provided parameters.

Aspects of the DAP system software provide computer readable instructions for implementing various aspects of a DAP control system having remote DAP system monitoring. In exemplary embodiments, there is provided computer readable instructions implemented by a DAP software control program having a communication system (via WiFi or cellular) to monitor the DAP system enabling one or more of: using a mobile app or mobile web app to monitor the DAP system; or push notifications when the system is outside the parameters set by the therapist at the beginning of session; or the parameters can be pain threshold, minimum or maximum body weight, min or max speed or incline, specific gait parameters, or any combination of the above. In one aspect, the remote monitoring system includes a cloud server to act as an agent to pass information from the DAP system to the remote agent. In still another aspect, the remote monitoring system includes an option for local only communication could also exist, where the DAP system acts as a server and communicates directly to the client (mobile device or PC). Additionally or optionally, the DAP control system includes aspects of communications and connectivity provided in FIGS. 28 and 30.

Compliant User Cockpit

The various aspects of the DAP embodiments described herein provide various alternative DAP bag and top panel designs providing alternative DAP cockpit designs having improved user envelopes. During walking and especially during running, even on a treadmill, users naturally move up, down, side to side, fore, and aft. Because of this, it is important for comfort that the user not be tightly restrained in these axes. Laterally, it is ideal for resistance to build gradually so that the user receives tactile feedback as to their position within the cockpit without experiencing discomfort. To accomplish this, the transition between the rigid cockpit frame and the user connection is carefully designed. Turning now to several specific configurations and alternatives.

In various embodiments there is a differential air pressure exercise system 100. The differential air pressure system includes a base 105 with a front portion 107 and a rear portion 109. There are a pair of uprights (a left upright 111 and a right upright 113) on the base 105 dividing the base into a front portion 107 and a rear portion 109. A bulkhead 115 extending between and vertically moveable relative to the uprights 111. 113.

A right arm 116 attached to the bulkhead 115 with a right arm base 117. The right arm 116 extending from the bulkhead 115 towards the base rear portion 109.

A left arm 118 attached to the bulkhead 115 with a left arm base 119 extending from the bulkhead 115 towards the base rear portion 109. A chamber support frame coupling element 122 is provided on the right arm 116. A chamber support frame coupling element 122 is provided on the left arm 118.

At least one hinge 125 coupled to the bulkhead 115 between the left arm 118 and the right arm 116.

A chamber support frame 120 extending between the left arm and the right arms, the chamber support frame coupled to the at least one hinge 125 to move between an engaged condition 190 wherein a portion of the chamber support frame 120 is coupled to the chamber support frame coupling element 122 on the right arm and a portion of the chamber support frame is coupled to the chamber support frame coupling element 122 on the left arm and a lowered condition 195 wherein the chamber support frame 120 is uncoupled from both the chamber support frame coupling element 122 on the right arm 116 and the chamber support frame coupling element 122 on the left arm 118.

The support frame coupling element 122 on the right arm and the left arm 116, 118 are magnets and the chamber support frame 120 is formed from a magnetic material. In another embodiment, the support frame coupling element 122 on the right arm and the left arm 116, 118 are formed from a magnetic material and the chamber support frame 120 further comprises one or more magnets to couple to the left arm and the right arm 116, 118.

The differential air chamber bag 130 is at least partially conformable to the base 105 and sealed thereto. The bag 130 has a left side panel 132, a right side panel 134, a rear panel 136 and a top panel 138. The top panel 138 also includes an opening 140, and a set of loops 142 sized to receive the chamber support frame 120 wherein when the chamber support frame 120 is within the set of loops 142 on the top panel 138 and the chamber support frame 120 is in the engaged condition 190 the opening 140 is between the right arm and the left arm 116, 118. There may be one of more handles 197 may be provided on the top panel 138.

In other embodiments, the DAP system includes a top panel 138 having an opening 140, and a set of loops 142 sized to receive the chamber support frame 120. The chamber support frame 120 is within the set of loops 142 on the top panel 138 and the chamber support frame 120 is in the lowered condition 195 the rear panel 136 is folded down and the opening 140 is adjacent to a portion of the folded rear panel 136. When in the lowered condition, a support frame angle 198 is defined between an arm, the bulkhead and the support frame. Depending on the specific configuration of the chamber support frame, the support frame angle 198 may range from 30 degrees to 70 degrees. The support frame angle 198 is selected to provide the top panel opening in a position to enhance user access into the opening 140.

In some embodiments, the folded rear portion 137 of the rear panel 136 comprises a transparent panel 139. Along the same lines, the left and right bag side panels may include a transparent panel portion and a non-transparent panel portion. The boundary between the transparent and the non-transparent portion may form an angle adapted to encourage folding along the boundary line as the chamber top panel/chamber support frame move into a lowered condition. The encouraged folding may be adapted to reduce creasing, cracking or other damage to the transparent panel portion.

In another aspect, the top panel 138 includes an opening 140, and a set of loops 142 sized to receive the chamber support frame 120 wherein when the chamber support frame 120 is within the set of loops 142 on the top panel the chamber support frame 120 extends from the bulkhead 115 along a right side of the top panel 138, along a left side of the top panel 138 and only partially along a right side and a left side of the opening 140. Additionally, in one embodiment, the distal most ends of the chamber support frame legs 121, 123 are shorter than the length of the right arm and the left arm. In still another aspect, the distal most ends of the chamber support frame legs 121, 123 are shorter than the length of the top panel 138. In one aspect, the distal most portion of the top panel 138 and opening 140 beyond and unsupported by the chamber support frame legs 121, 123.

Optionally, the top panel 138 may also include an opening 140, and a set of loops 142 sized to receive the chamber support frame 120 as before. The chamber support frame 120 may also be U-shaped with the bottom of the U shape coupled to the at least one hinge and the arms 121, 123 extending along and within the set of loops 142 on the top panel 138. A portion of the opening 140 extends beyond the ends of the chamber support frame arms 121, 123.

The DAP bag 130 is sealed to the base 105. The DAP chamber includes a pressure maintained in the front portion and the rear portion corresponding to the base 105 with a front portion 107 and a rear portion 109.

FIG. 1 is a left side rear aspect of view of the differential air pressure system 100 having improved user access and preset user cockpit range of sizes. The differential air pressure system includes a base 105 with a front portion 107 and a rear portion 109. There are a pair of uprights (a left upright 111 and a right upright 113) on the base 105 dividing the base into a front portion 107 and a rear portion 109. A bulkhead 115 upright 110 extends between uprights 111, 113. A slide release latch 114 is positioned on the bulkhead 115. The DAP system releases the moving bulkhead 115 to adjust between a number of pre-set user heights through motion of the lever in the center of the bulkhead 115. An enclosure 145 is located in the front of the system that contains electronics, a DAP pressure source and, optionally, valves, pumps or mufflers. The DAP chamber has a rear panel 136, left side panel 132, top panel 138 and user cockpit 106 and user seal 112 between the left and right arms 118, 116 that extend from the bulkhead 115. The chamber top panel 138 is shown in the engaged condition coupled to the arms 118, 116.

Figure 2:
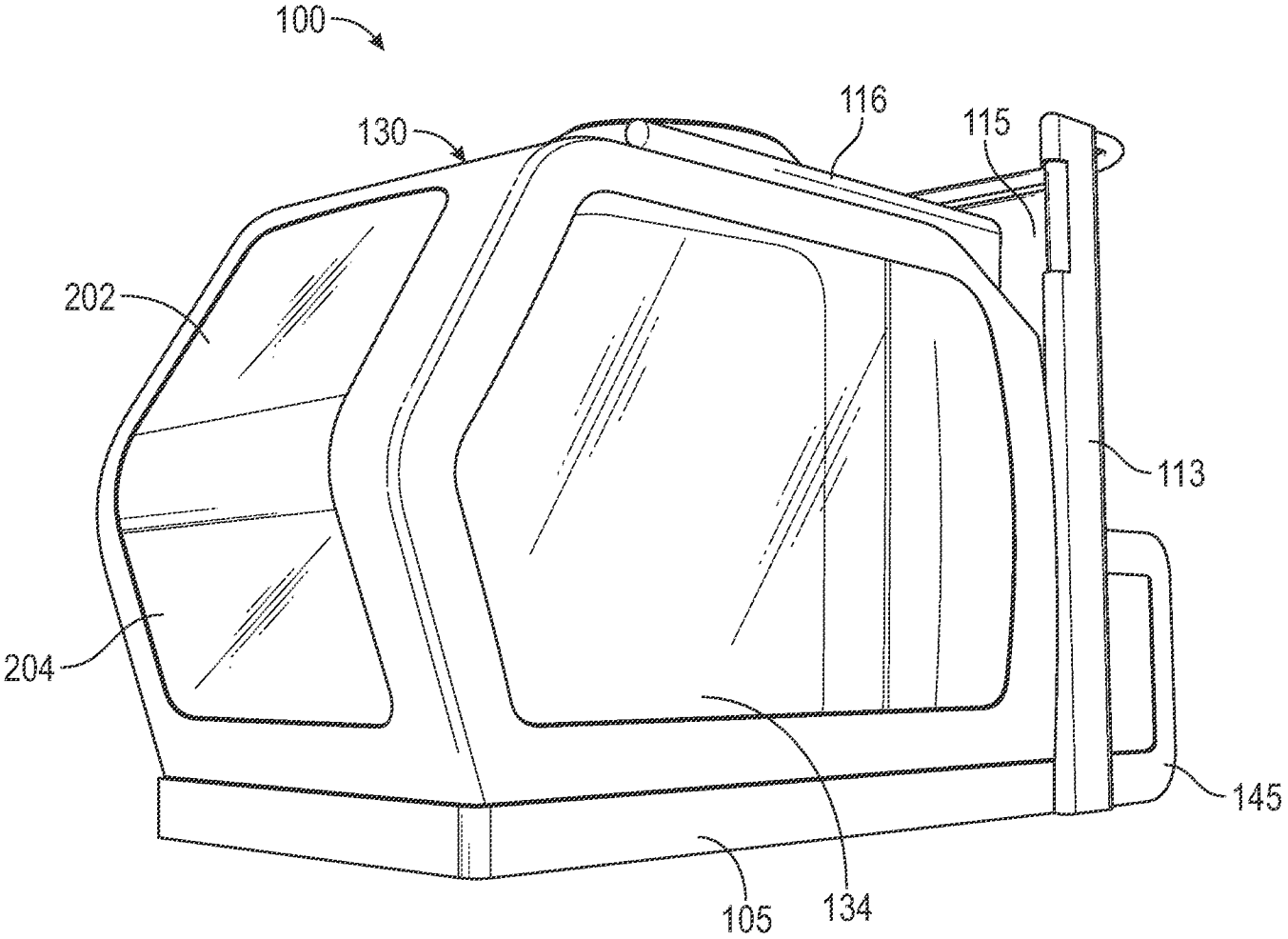
FIG. 2 is a right side rear aspect of the differential air pressure system of FIG. 1.

FIG. 2 is a right side rear aspect of the differential air pressure system 100 of FIG. 1. FIG. 2 shows the DAP bag 130 above the base 105. Right side panel 134, lower rear panel 202 and upper rear panel 204 extending upwards from the base 105. A folding section 206 is located between the upper and lower rear panels 202, 204. Left and right 116 arms extend from the bulkhead 115. The bulkhead 115 extends between left upright and right upright 113. An enclosure 145 is positioned at the front portion of the base 105.

Cockpit movement may be augmented by one or more dampening or movement assistance devices. In one aspect, the cockpit height adjustment is assisted by a hydraulic lift, an air shock or a piston disposed within the forward stanchion.

Figure 3:
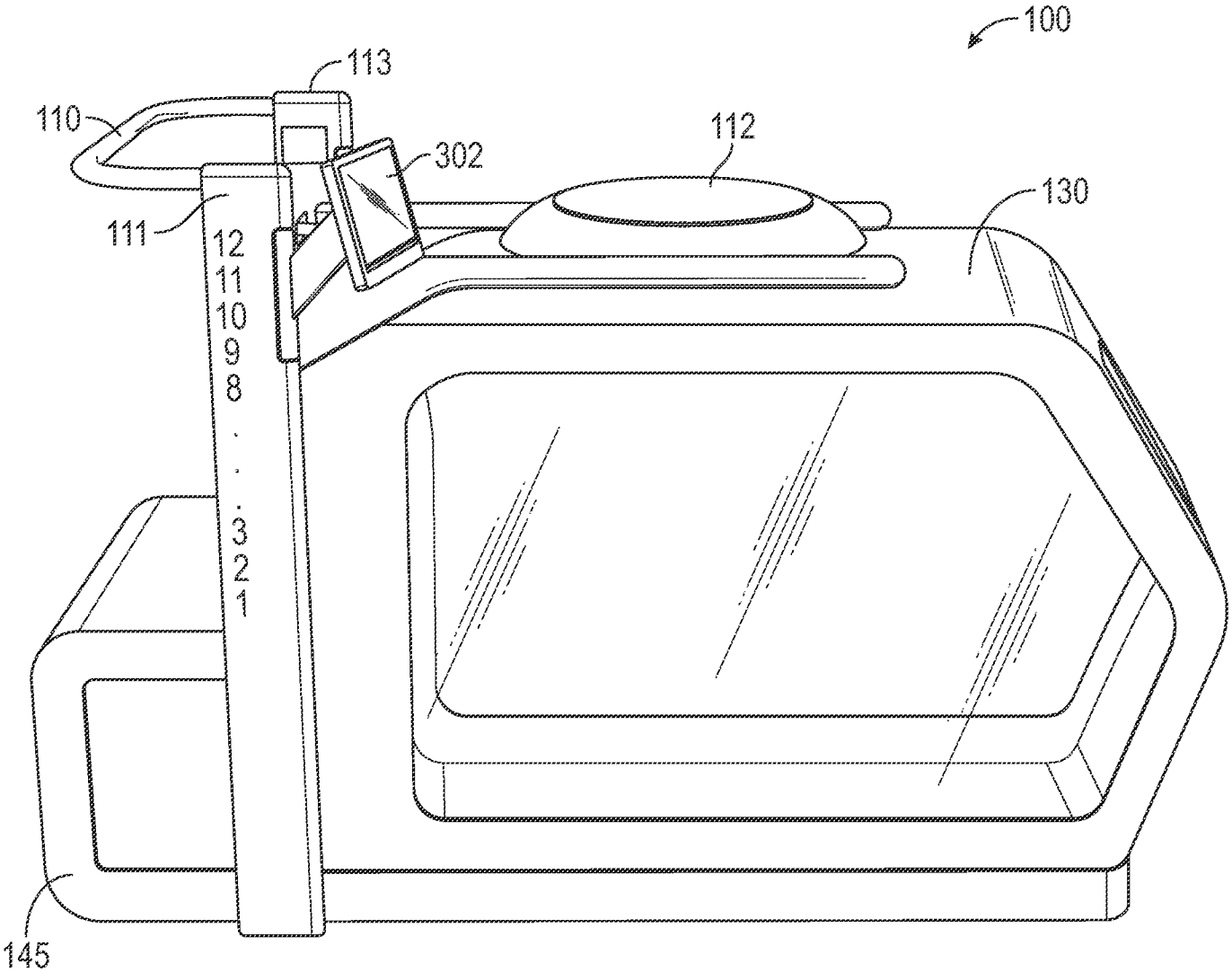
FIG. 3 is a left side view of the differential air pressure system of FIG. 1 showing the position of an off-center display.

FIG. 3 is a left side view of the differential air pressure system 100 of FIG. 1 showing the position of an off-center display 302. Upright cross bar 110 extends between uprights 111, 113. Upright 111 includes an indication of preset heights 304. Air pressure chamber bag 130 and user seal 112 are shown in FIG. 3.

FIG. 4A is a left side rear aspect of view of a differential air pressure system similar to FIG. 3. FIG. 4A includes a center display 402 mounted on an upright member cross bar in a central location. The system comprises a bulkhead 115 with a sliding latch release 404. Let and right uprights 111, 113 are positioned on either side of the bulkhead 115. A side mounted display 406 is mounted on the left upright 111. Left and right arms 118, 116 extend from the bulkhead 115. FIG. 4A shows the DAP chamber bag 130 and upper panel 408. The DAP system of FIG. 4A also includes an optional rear ramp 410 with a receiver 414 for a pair of rear access handrails 412. The handrails and ramp are bolt-on ready and can be applied when requested. The ramp frame can couple to the base.

FIG. 4B is a right side rear aspect of the differential air pressure system of FIG. 4A showing the ramp 410 mounted to the rear of the DAP system platform and the rear access handrails. The rear access handrails extend to the top of the inflated DAP chamber 130 as shown but are not connected to the left and right arms 118, 116 connected to the movable bulkhead 115.

Figure 5A:
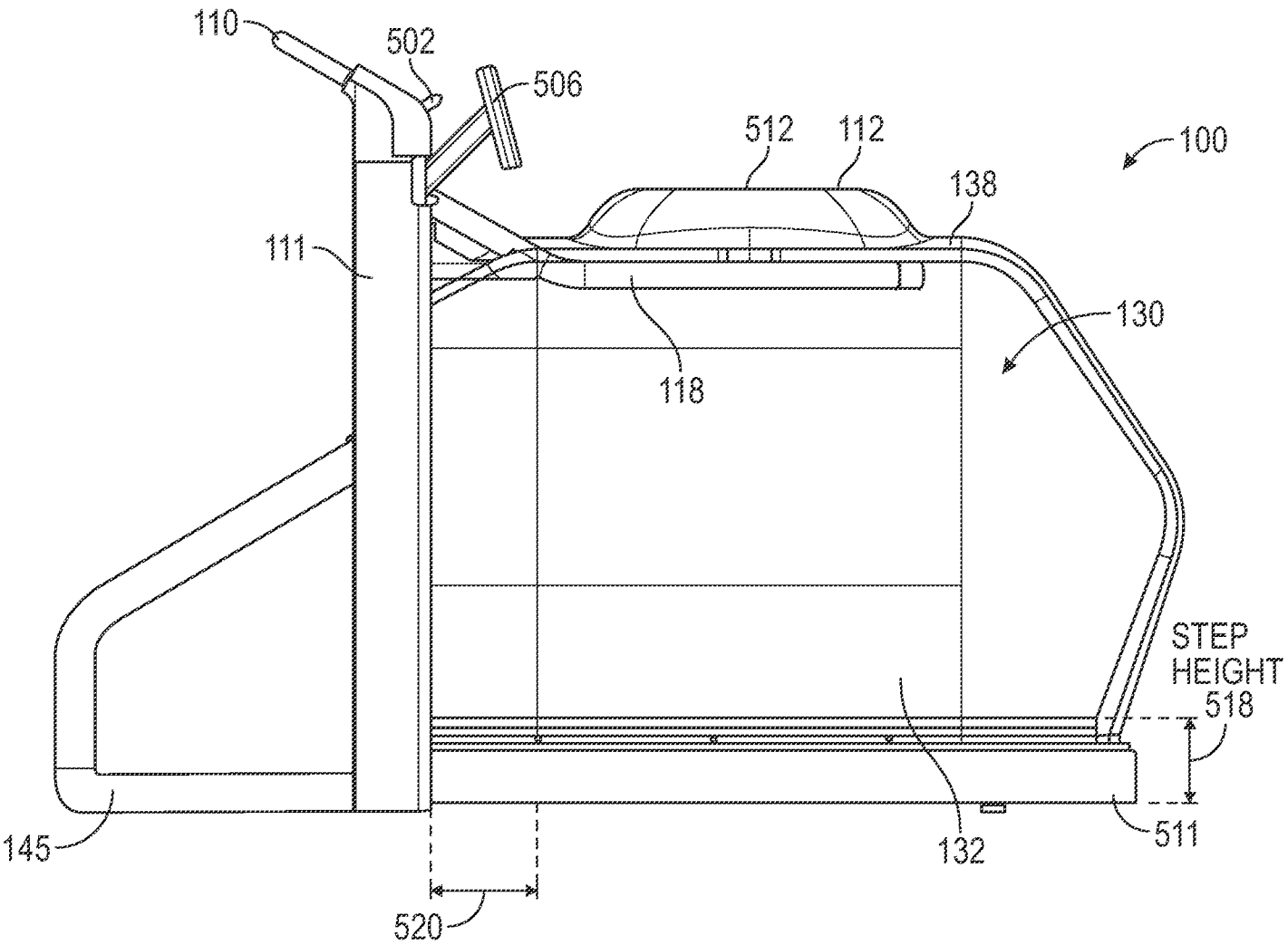
FIG. 5A is a left side rear aspect of view of the differential air pressure system having improved user access and preset user cockpit range of sizes similar to FIG. 1. The DAP system in FIG. 5A releases the moving bulkhead to adjust between a number of pre-set user heights through motion of the pull bar above the center of the bulkhead. An enclosure is located in the front of the system that contains electronics, a DAP pressure source and, optionally, valves, pumps or mufflers. A side mounted display similar to FIG. 3 is also shown. The DAP chamber has a top panel and user cockpit between the left and right arms that extend from the bulkhead. The chamber top panel is shown in the engaged condition coupled to the arms.
Figure 5B:
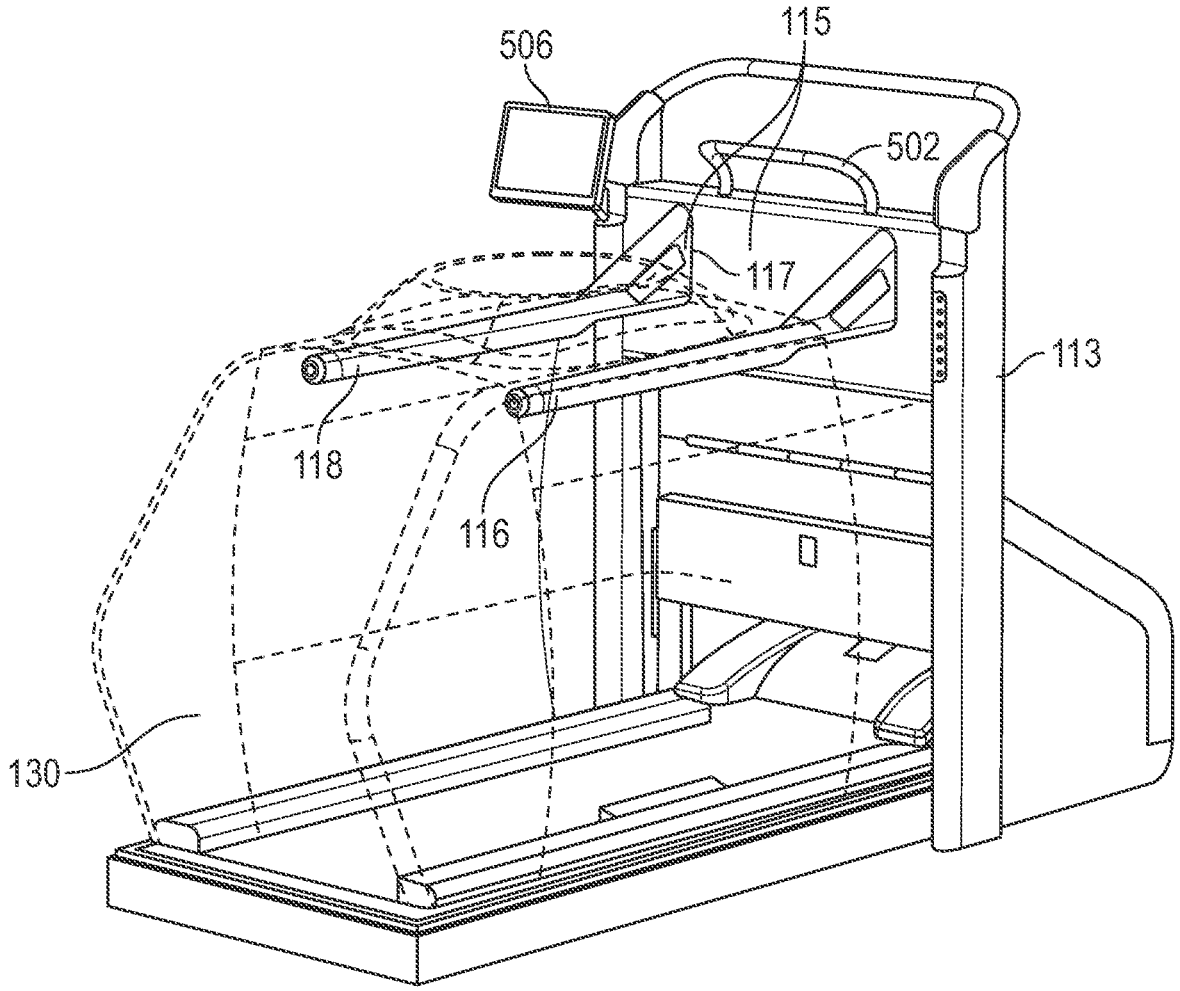
FIG. 5B is a right side rear view of the differential air pressure chamber of FIG. 5A. The preset height indicators are shown on the right side upright adjacent to the right arm.

FIG. 5A is a left side rear aspect of view of the differential air pressure system having improved user access and preset user cockpit range of sizes similar to FIG. 1. The DAP system in FIG. 5A releases the moving bulkhead to adjust between a number of pre-set user heights through motion of the pull bar 502 above the center of the bulkhead 115. An upright 110 extends between left 111 and right uprights. Left and right arms 118, 116 extend from the bulkhead 115. An enclosure 145 is located in the front of the system that contains electronics, a DAP pressure source and, optionally, valves, pumps or mufflers. The enclosure 145 comprises a sloped profile. A side mounted display 506 similar to FIG. 3 is also shown (FIG. 5B). The DAP chamber 130 has a top panel 138 and user cockpit 512 between the left and right arms that extend from the bulkhead. The left side panel 132 is also shown. The chamber top panel is shown in the engaged condition coupled to the arms. A chamber sealing member 112 is engaged with the top panel 510.

The platform base 511 is a pan adapted and configure to receive a DAP training device. A DAP training device may be equipped with one or more instruments or sensors to read and communicate to a DAP control system one or more biometric indications about the user in the DAP chamber. In one aspect, the sensors are one or more pairs of load cells positioned on, in, within, under or adjacent to a DAP training device. In one aspect, the platform base has a treadmill sitting inside. In some embodiments, the use of platform pan reduces step height 518 to 8", 7" 5" or 4" depending upon the DAP training device in use.

A forward support stanchion 520 (e.g., about 3-4") can extend forward for an enlarged cockpit envelope for improved arm swing.

FIG. 5B is a right side rear view of the differential air pressure chamber of FIG. 5A. The preset height indicators 530 are shown on the right side upright 113 adjacent to the right arm 116. A reduced vertical height range of cockpit is delineated by user inseam from top surface of the DAP training device within the DAP chamber.

The DAP chamber bag 130 is shown in outline. Upper surfaces of the DAP chamber bag 130 are tapered towards the user seal. Optionally, a removable bag cockpit, such as a zippered or quick release style is provided. Benefits include reduced labor an materials for many bag repair. This configuration can also create a "conning" tower for waist wrap.

The pull bar 502 is shown which comprises a push/pull locking mechanism.

A connector 117 provides connection of the right and left arms 116, 118 to the bulkhead 115.

The cockpit arms are removable from the main cockpit. This allows for interchange of arms with different geometries or sizes. A reduced profile simplifies shipping.

Figure 5C:
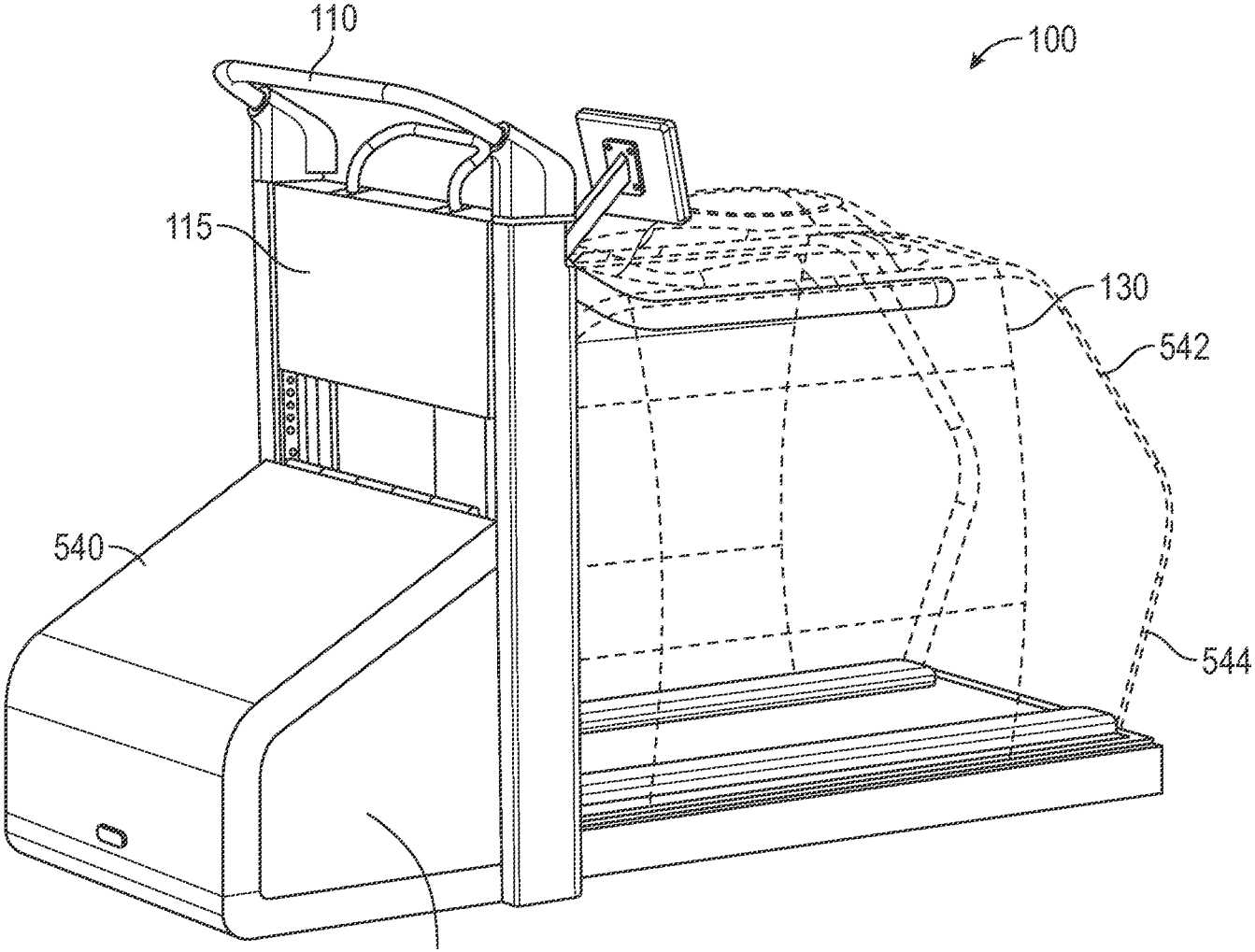
FIG. 5C is a front left side view of the differential air pressure chamber of FIG. 5A. Visible in this view is the sloped cover of the enclosure located in the front of the system that contains electronics, a DAP pressure source and, optionally, valves, pumps or mufflers. The movable bulkhead is shown at the upper end of travel indicating the longest user height setting.

FIG. 5C is a front left side view of the differential air pressure chamber of FIG. 5A. Visible in this view is the sloped cover 540 of the enclosure 145 located in the front of the system that contains electronics, a DAP pressure source and, optionally, valves, pumps or mufflers. The movable bulkhead 115 is shown at the upper end of travel indicating the longest user height setting.

A large center display is omitted, allowing an unobstructed forward view. The display 506 may be a touch screen or smart pad or other mobile communication device positioned off the central axis, optionally on an articulating arm.

The DAP pressure bag 130 is sealed to the platform pan 511 using clamp, join, or other suitable pressure seal. The bag 130 is to be welded together using infrared technology. Upper rear panel 542 and lower rear panel 544 are shown in FIG. 5C.

Cockpit movement may be augmented by one or more dampening or movement assistance devices. In one aspect, the cockpit height adjustment is assisted by a hydraulic lift, an air shock or a piston disposed within the forward stanchion.

Figure 5D:
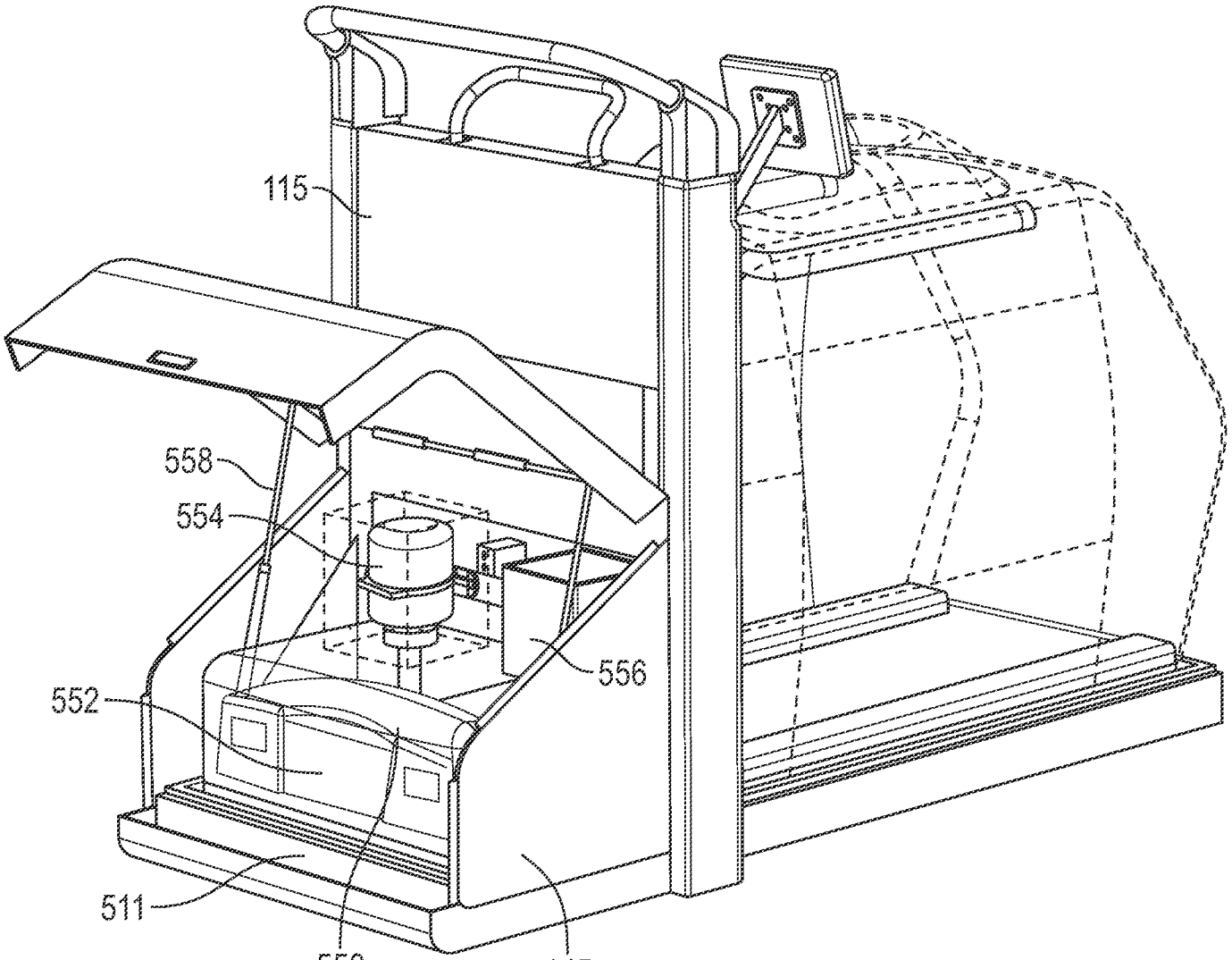
FIG. 5D is similar to FIG. 5C with the enclosure open. In this view, the interior components of the enclosure including the forward most portion of the DAP bag, the computer controller the blower, electronics compartment and also a treadmill within the DAP chamber that is shown in phantom. The enclosure located in the front of the system may optionally include a valves, a different pump type or a muffler on the valve exhaust.

FIG. 5D is similar to FIG. 5C with the enclosure 145 open. In this view, the interior components of the enclosure including the forward most portion 550 of the DAP bag, the electronics compartment 556, including the computer controller, the blower 554, and also a treadmill 552 within the DAP chamber that is shown in phantom. The DAP chamber enclosure covers the DAP training device in the platform pan 511. The enclosure located in the front of the system may optionally include a valves, a different pump type or a muffler on the valve exhaust. The electronics are accessed via "boot", with gas springs 558. May also be used on cockpit height adjustment.

Figure 5E:
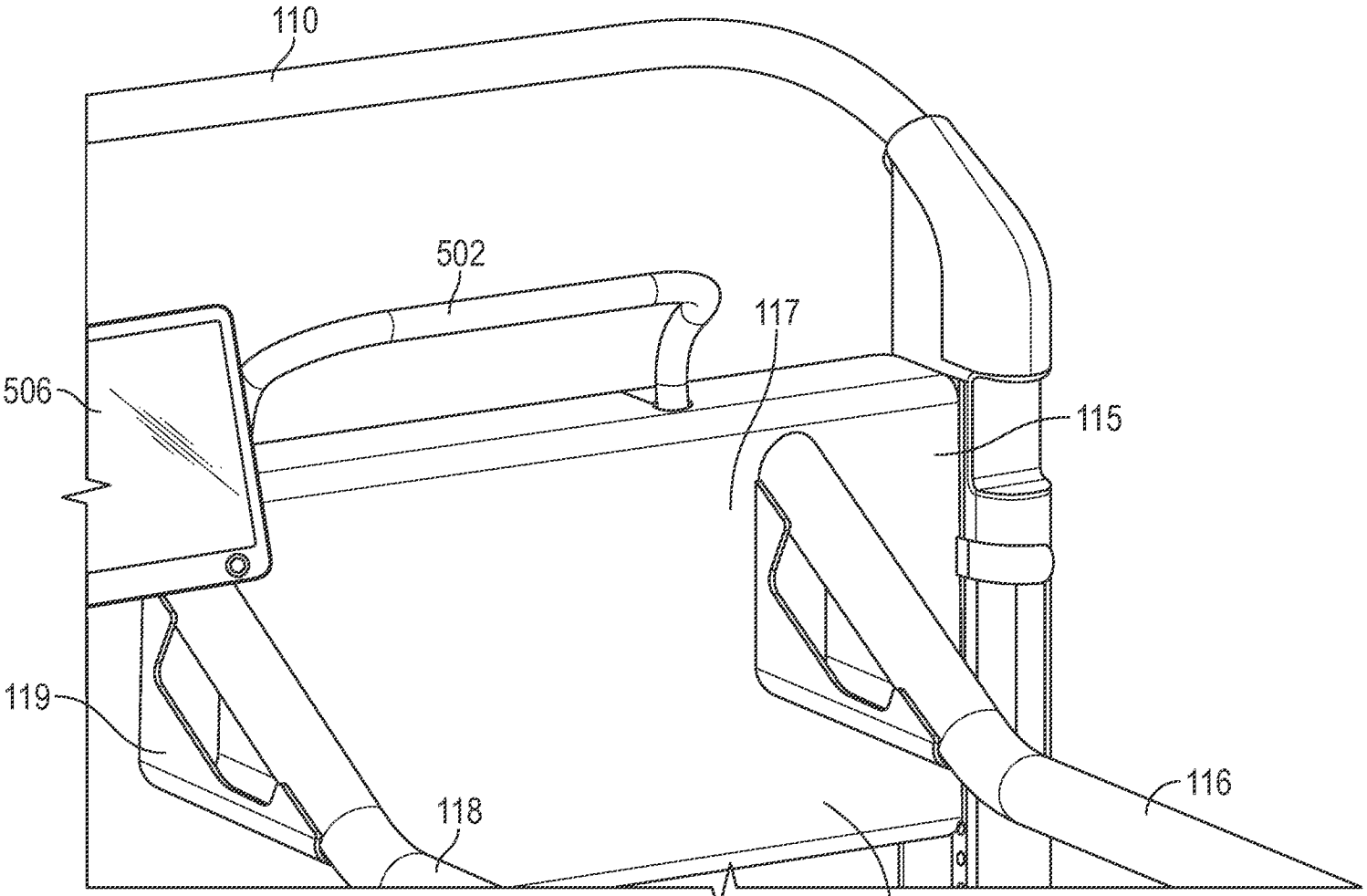
FIG. 5E is close up view of the central portion of the DAP system of FIG. 5A with the bulkhead in the uppermost raised position (i.e., highest inseam or user height value). The bulkhead, cross bar, right upright and the push/pull locking bar are shown. Also shown in this view are the user height settings from inseams of 28 to 34 with an indicator on inseam 34. The base of each of the right arm and the left arm are also shown where they attach to left and right portions of the bulkhead.

FIG. 5E is close up view of the central portion of the DAP system of FIG. 5A with the bulkhead 115 in the uppermost raised position (i.e., highest inseam or user height value). The height indicators are inseam lengths. The bulkhead 115, upright cross bar 110, right upright 113 and the push/pull locking bar are shown. Also shown in this view are the user height settings 530 from inseams of 28 to 34 with an indicator on inseam 34. The base 117, 119 of each of the right arm 118 and the left arm 116 are also shown where they attach to left and right portions of the bulkhead 115. A removable panel 560 for substitution of cockpit arms is also shown. Also shown in this view is the display 506.

Figure 6B:
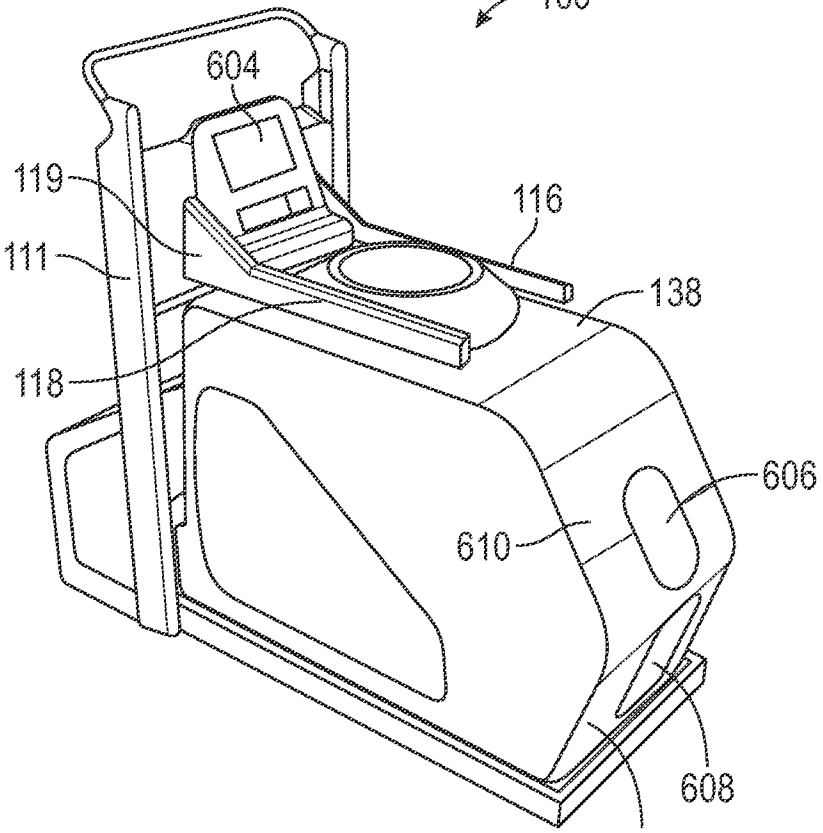
FIGS. 6A and 6B are front right and left rear view of another DAP system similar in many respects to the DAP system of FIG. 5A having improved user access and preset user cockpit range of sizes. The DAP system is shown with the bulkhead in an engaged slot with the DAP chamber pressurized as when in use during DAP therapy, except a user would be in the top panel opening/user seal. The DAP system in FIGS. 6A and 6B releases the moving bulkhead to adjust between a number of pre-set user heights through motion of the lever in the center of the bulkhead. An enclosure is located in the front of the system that contains electronics, a DAP pressure source and, optionally, valves, pumps or mufflers. The DAP chamber has a top panel and user cockpit between the left and right arms that extend from the bulkhead. The chamber top panel is shown in the engaged condition coupled to the arms. As best seen in FIG. 6B a user display or control panel is mounted to the bulkhead between the left arm and the right arm.
Figure 6A:
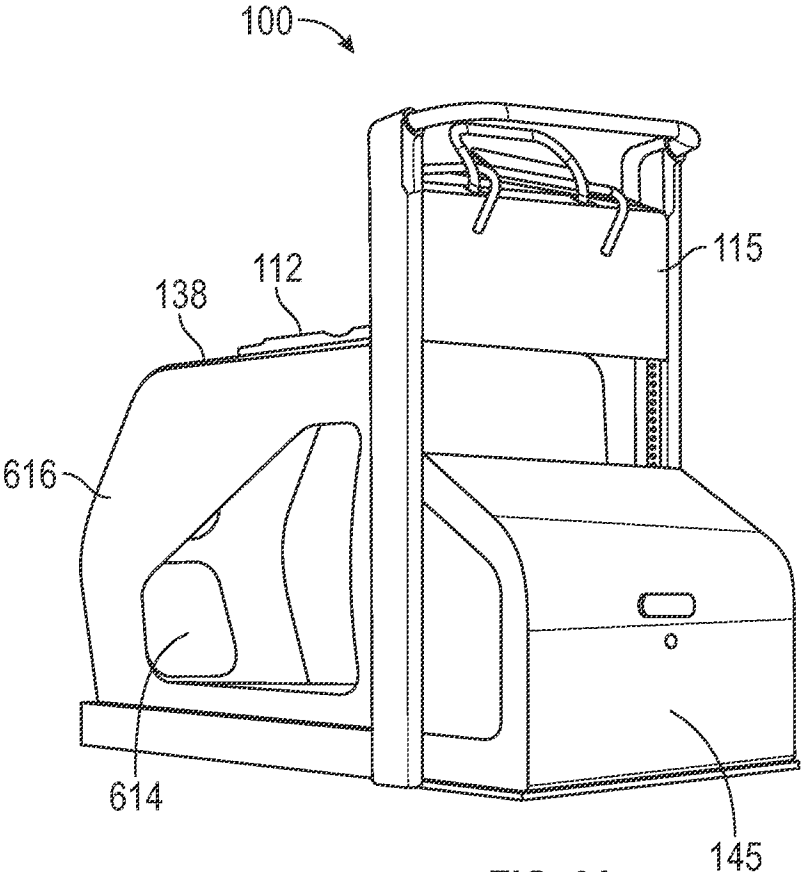

FIGS. 6A and 6B are front right and left rear view of another DAP system similar in many respects to the DAP system of FIG. 5A having improved user access and preset user cockpit range of sizes. The DAP system is shown with the bulkhead 115 in an engaged slot with the DAP chamber pressurized as when in use during DAP therapy, except a user would be in the top panel opening/user seal 112. The DAP system in FIGS. 6A and 6B releases the moving bulkhead to adjust between a number of pre-set user heights through motion of the lever in the center of the bulkhead. An enclosure 145 is located in the front of the system that contains electronics, a DAP pressure source and, optionally, valves, pumps or mufflers. The DAP chamber has a top panel 138 and user cockpit between the left and right arms 118, 116 that extend from the bulkhead 115. The chamber top panel 138 is shown in the engaged condition coupled to the arms 118, 116. As best seen in FIG. 6B a user display 604 or control panel is mounted to the bulkhead 115 between the left arm 118 and the right arm 116. FIG. 6B also shows the relationship of the left arm mount 119 between the left side of the center display 604 and the left upright 111. FIG. 6B shows upper and lower rear panels 610, 612. Two transparent panels 606, 608 are located in the bag rear panel one each along the angled top and bottom sides. The left side panel and right side panels have transparent 614 and non-transparent portions 616 with an angled boundary between along the transition that is placed to minimize folding or creasing of the transparent portion when the DAP chamber is placed in a lowered condition.

Figure 6C:
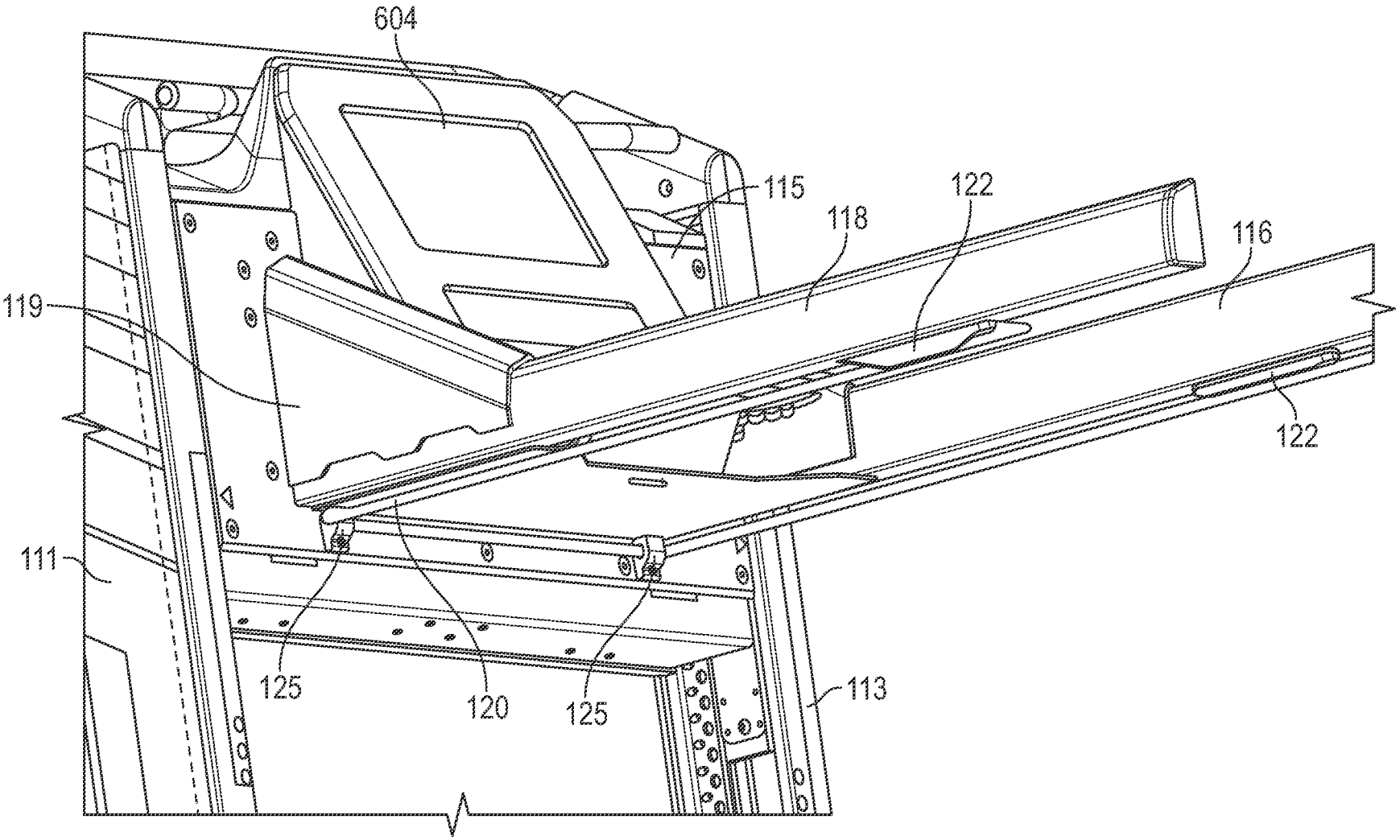
FIG. 6C is a bottom up view of the DAP system of FIGS. 6A and 6B with the DAP bag removed making interior details visible. Chamber engagement elements are shown on the bottom aspect of the left and right arms. The U-shaped chamber support frame is also shown in the engaged position as in FIGS. 6A and 6B. The left and right chamber support frame hinges are visible in this view showing the right and left pivot points in the central portion of the bulkhead. The left arm base connection to the bulkhead adjacent to the central display section is also visible in this view. The series of holes 176 are shown below the bottom edge of the bulkhead and spaced along the interior aspect of the right upright.

FIG. 6C is a bottom up view of the DAP system of FIGS. 6A and 6B with the DAP bag removed making interior details visible. Chamber engagement elements 122 are shown on the bottom aspect of the left and right arms 118, 116. The U-shaped chamber support frame 120 is also shown in the engaged position as in FIGS. 6A and 6B. The left and right chamber support frame hinges 125 are visible in this view showing the right and left pivot points in the central portion of the bulkhead 115. The left arm base connection 119 to the bulkhead adjacent to the central display section is also visible in this view. A bottom surface 620 of the bulkhead 115 is visible in this view. The series of holes 176 are shown below the bottom edge of the bulkhead and spaced along the interior aspect of the right upright. These openings are used to adjust inseam height.

Figure 6D:
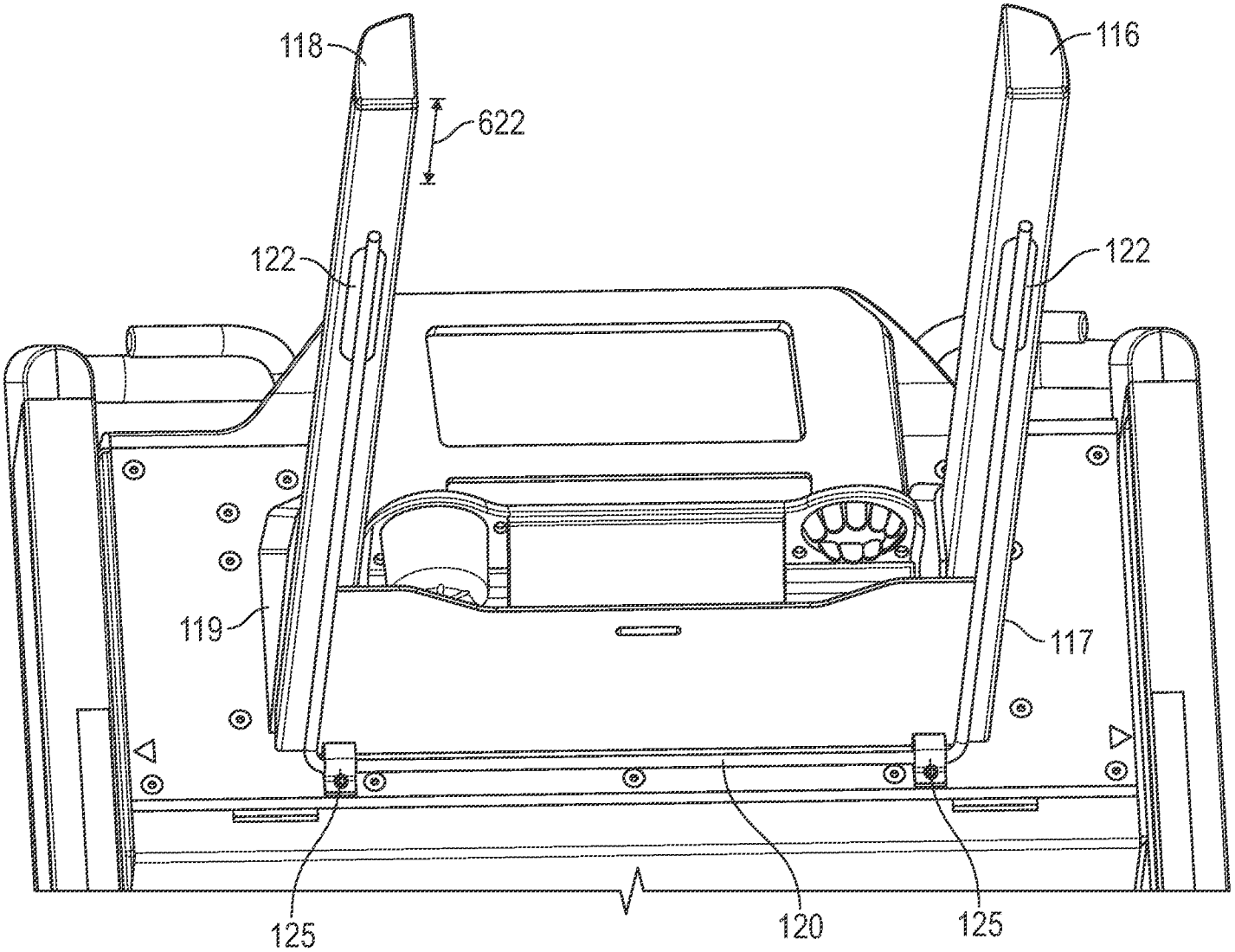
FIG. 6D is a bottom up view of the DAP system of FIGS. 6A and 6B with the DAP bag removed making interior details visible similar to FIG. 6C. Chamber engagement elements are shown on the bottom aspect of the left and right arms. The U-shaped chamber support frame is also shown in the engaged position as in FIG. 6C. The left and right chamber support frame hinges are visible in this view showing the right and left pivot points in the central portion of the bulkhead. Both the right and left arm base connections to the bulkhead adjacent to the central display section are visible in this view.

FIG. 6D is a bottom up view of the DAP system of FIGS. 6A and 6B with the DAP bag removed making interior details visible similar to FIG. 6C. Chamber engagement elements 122 are shown on the bottom aspect of the left and right arms 118, 116. The chamber engagement elements 122 are spaced from an end of the left and right arms by a distance 622. The U-shaped chamber support frame 120 is also shown in the engaged position as in FIG. 6C. The left and right chamber support frame hinges 125 are visible in this view showing the right and left pivot points in the central portion of the bulkhead. Both the right and left arm base connections 117, 119 to the bulkhead adjacent to the central display section are visible in this view.

Figure 6E:
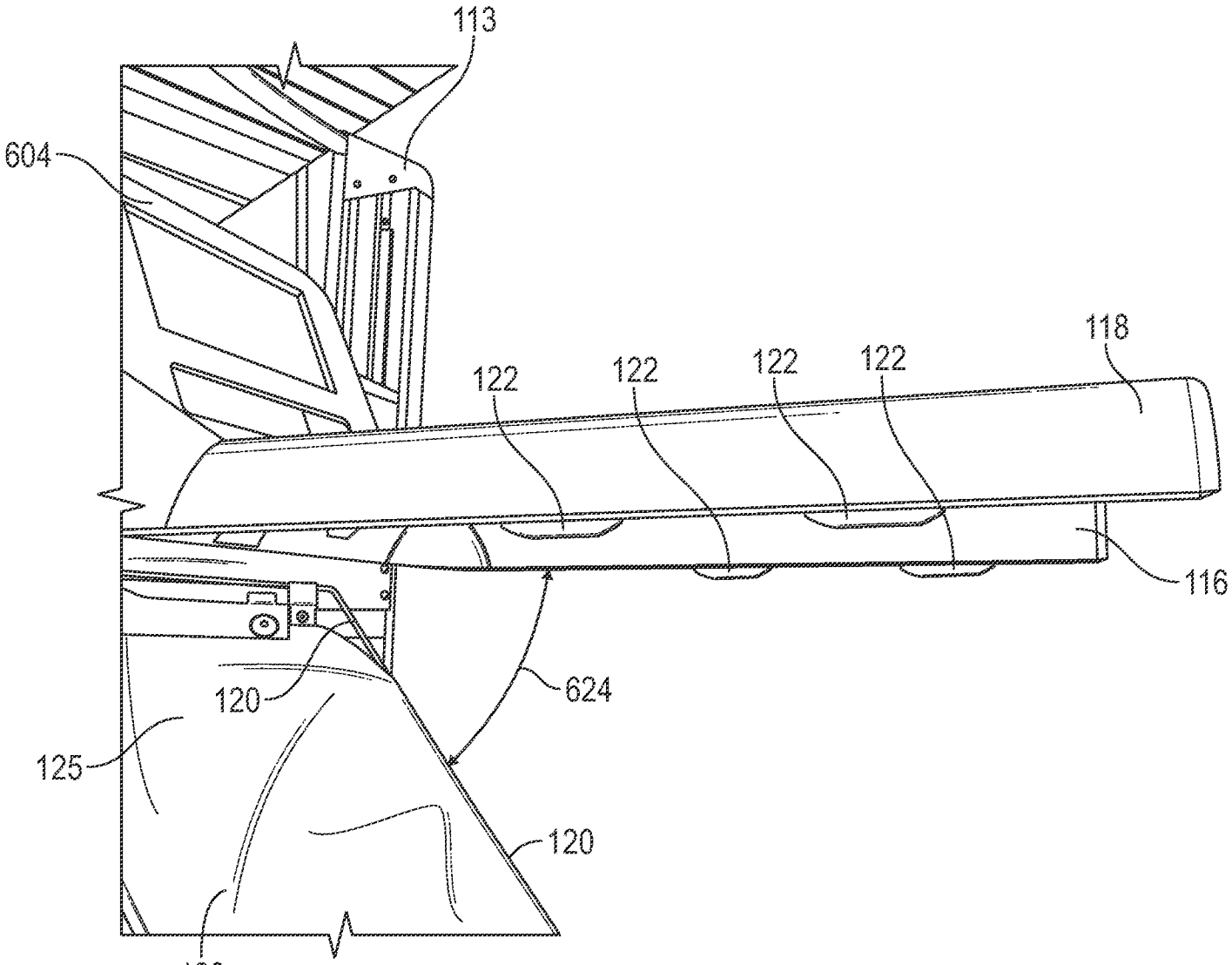
FIG. 6E is side view of an alternative arm configuration of FIGS. 6A-6D. In this configuration, the left arm and the right arm each contain two chamber support frame engagement elements. The chamber support engagement elements are located along the bottom surface of the arms. The distal most chamber engagement element is proximal to the distal end of each arm as shown. The chamber support frame is coupled to the DAP chamber top panel and is shown in the lowered condition. In this view a support frame angle is visible and formed relative to the right arm and the right side of the chamber support frame.

FIG. 6E is side view of an alternative arm configuration of FIGS. 6A-6D. In this configuration, the left arm and the right arm 118, 116 each contain two chamber support frame engagement elements 122. The chamber support engagement elements 122 are located along the bottom surface of the arms. The distal most chamber engagement element is proximal to the distal end of each arm as shown. The chamber support frame 120 is coupled to the DAP chamber top panel 138 and is shown in the lowered condition. In this view a support frame angle 624 is visible and formed relative to the right arm 116 and the right side of the chamber support frame 120.

Figure 6F:
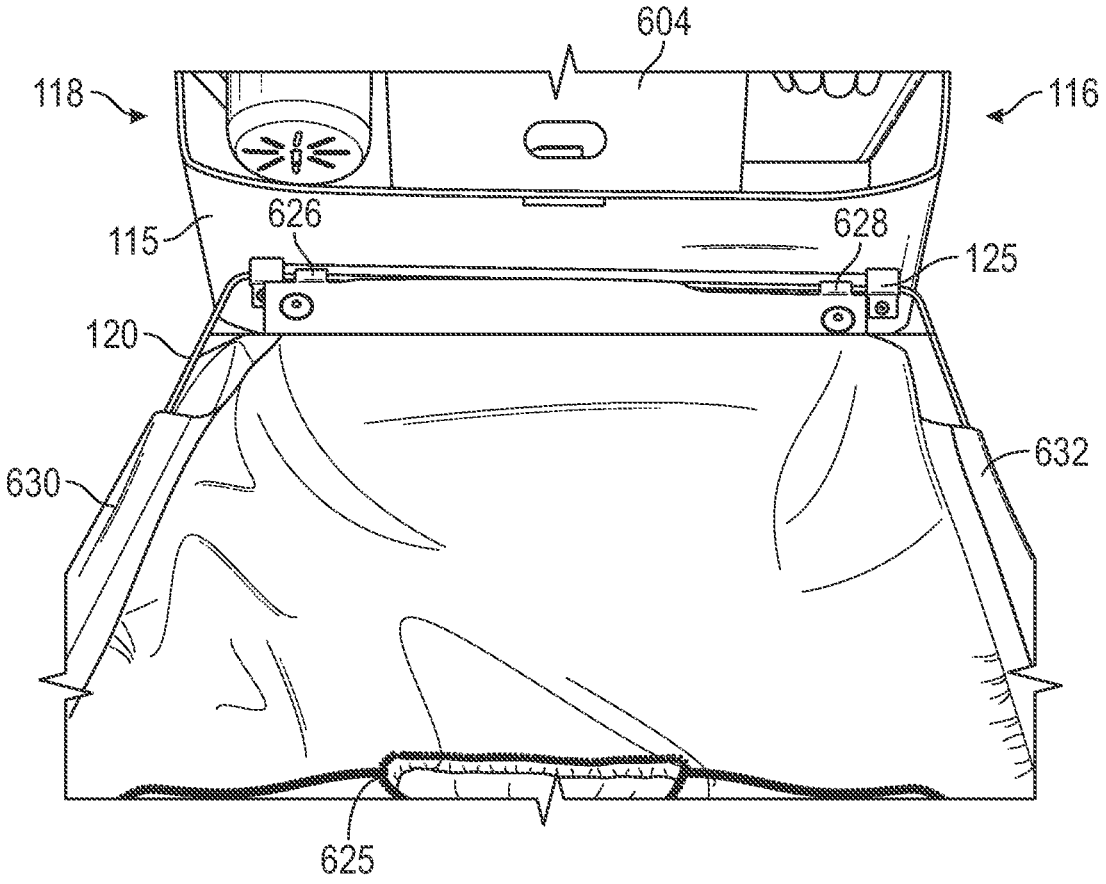
FIG. 6F is forward facing view of the chamber top panel and support frame as positioned in FIG. 6E. The left and right chamber support hinges are shown adjacent the left and right corners of the chamber support frame. Left and right top bag panel attachments are also shown in the view adjacent to and inboard of the left and right hinges. The left and right top bag panel attachments are used to join the front edge of the bag top panel and the loop containing the bottom of the u-shaped support frame to the bulkhead. Top panel support loops on the left and the right edges of the top panel are also shown in this view.
Figure 6G:
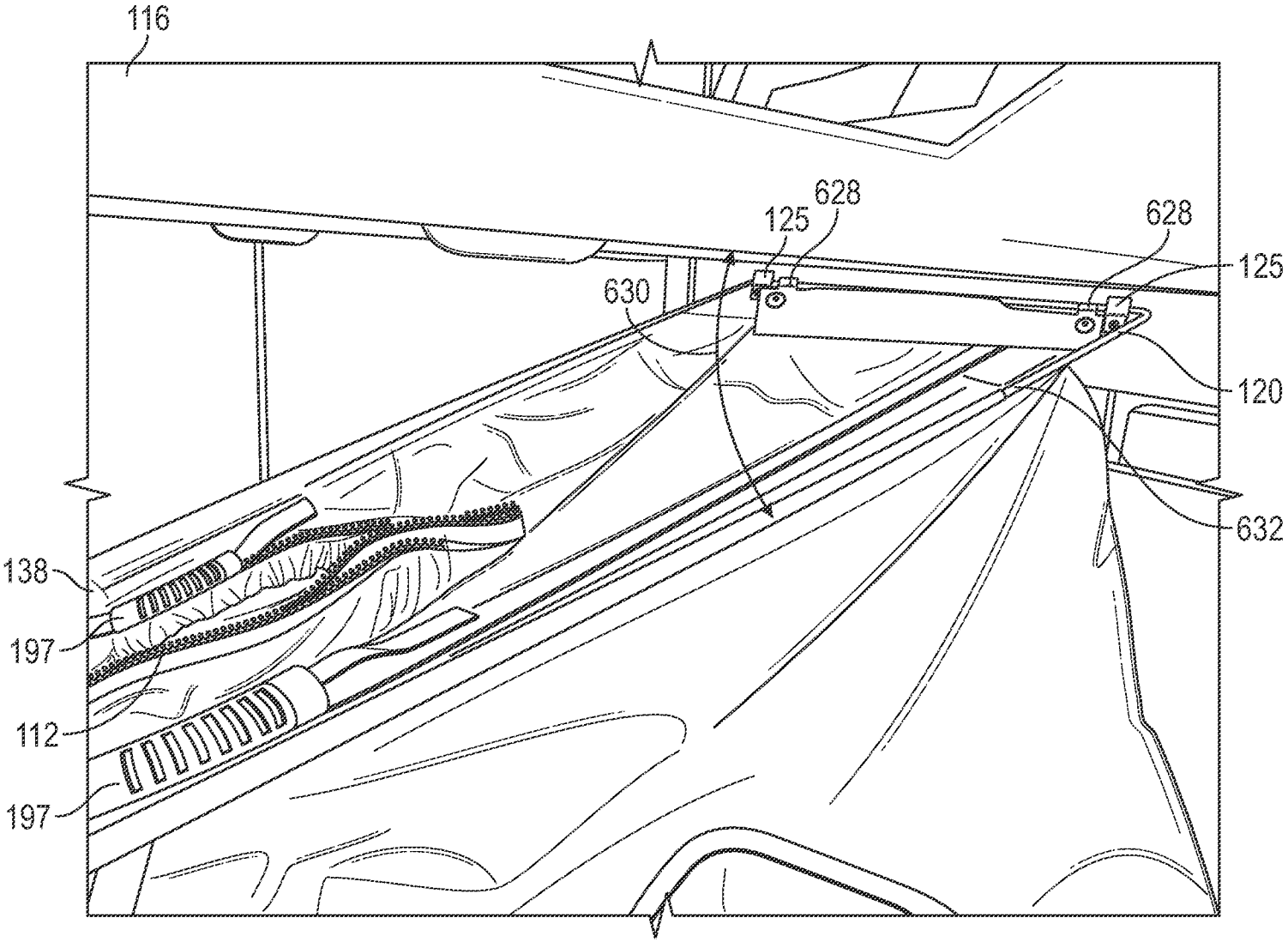
FIG. 6G is a right side view of the lowered chamber top panel and support frame as positioned in FIGS. 6E and 6F. The left and right chamber support hinges are shown adjacent the left and right corners of the chamber support frame. Left and right top bag panel attachments are also shown in the view adjacent to and inboard of the left and right hinges. The left and right top bag panel attachments are used to join the front edge of the bag top panel and the loop containing the bottom of the u-shaped support frame to the bulkhead. Top panel support loops on the left and the right edges of the top panel are also shown in this view. In this view a support frame angle is visible and formed relative to the right arm and the right side of the chamber support frame. A chamber sealing member is shown in the top panel with the user zipper ready for engagement with a user seal zipper. Handles on the top panel to the left and the right of the chamber opening are also visible in this view.

FIG. 6F is forward facing view of the chamber top panel 138 and support frame 120 as positioned in FIG. 6E. The left and right chamber support hinges 125 are shown adjacent the left and right corners of the chamber support frame. Left and right top bag panel attachments are also shown in the view adjacent to and inboard of the left and right hinges 125. The left and right top bag panel attachments are used to join the front edge of the bag top panel and the loop 628 containing the bottom of the u-shaped support frame to the bulkhead 115. Top panel support loops on the left and the right edges 630, 632 of the top panel are also shown in this view. The user zipper DAP Chamber sealing member 625 is also shown in FIG. 6F FIG. 6G is a right side view of the lowered chamber top panel 138 and support frame 120 as positioned in FIGS. 6E and 6F. The left and right chamber support hinges 125 are shown adjacent the left and right corners of the chamber support frame 120. Left and right top bag panel attachments are also shown in the view adjacent to and inboard of the left and right hinges 125. The left and right top bag panel attachments are used to join the front edge of the bag top panel and the loop 628 containing the bottom of the u-shaped support frame 120 to the bulkhead 115. Top panel support loops 628 on the left and the right edges of the top panel 138 are also shown in this view. In this view a support frame angle 630 is visible and formed relative to the right arm 116 and the right side 632 of the chamber support frame. A chamber sealing member 112 is shown in the top panel with the user zipper ready for engagement with a user seal zipper. Handles 197 on the top panel to the left and the right of the chamber opening are also visible in this view.

Figure 6H:
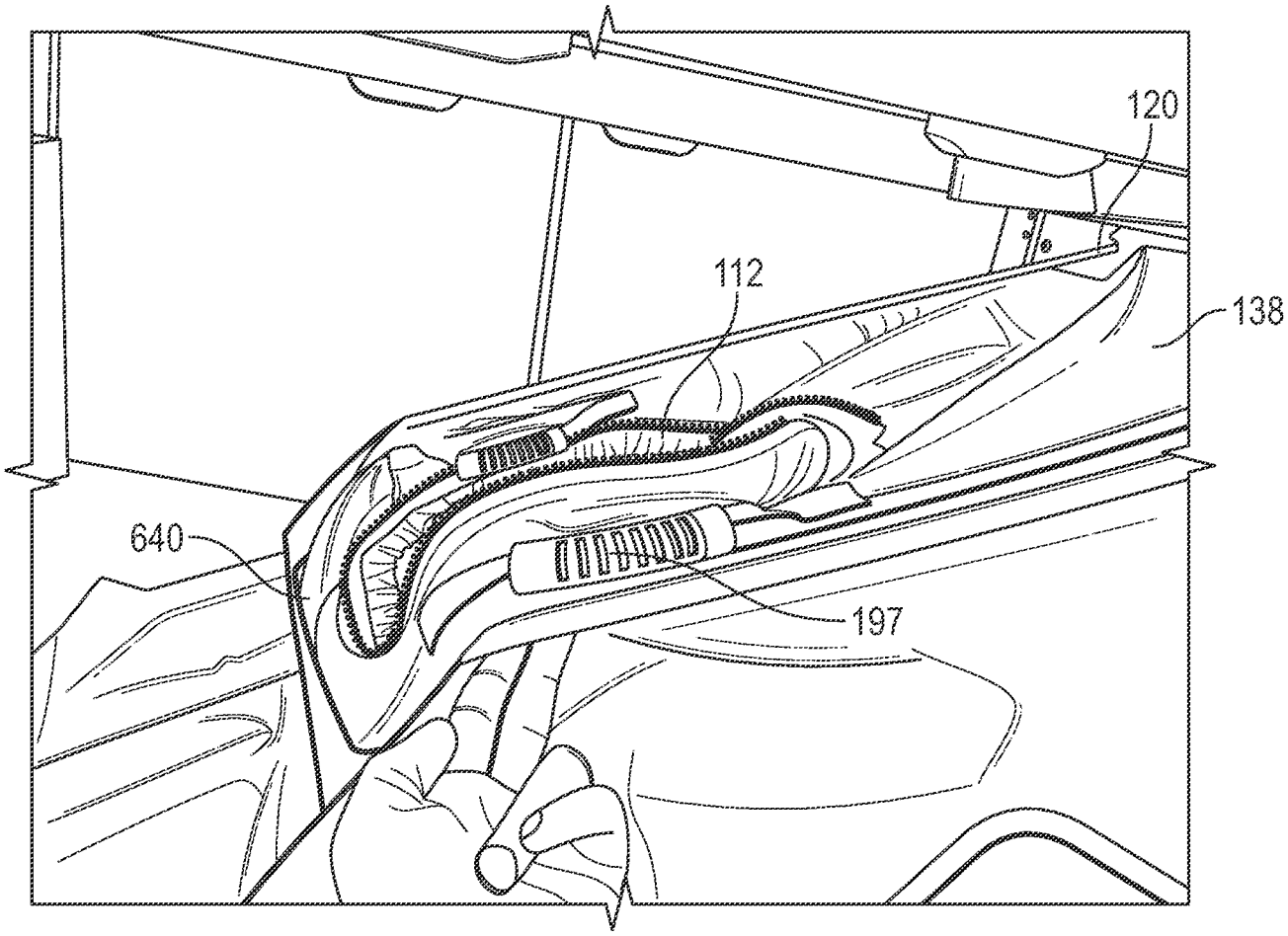
FIG. 6H is a right side view of the lowered chamber top panel and support frame as positioned in FIGS. 6E, 6F and 6G showing the distal most ends of the chamber support arms relative to the distal most end of the top panel and the panel opening/user seal. The position of the distal ends of the chamber support frame as shown allows for the distal most portion of the top panel and the user opening to flex when the support frame is in the lowered condition (See FIGS. 8A, 8B and 8C).

FIG. 6H is a right side view of the lowered chamber top panel 138 and support frame 120 as positioned in FIGS. 6E, 6F and 6G showing the distal most ends of the chamber support arms relative to the distal most end of the top panel 640 and the panel opening/user seal 112. The distal end of the chamber support frame does not extend to the end of the top panel. The position of the distal ends of the chamber support frame as shown allows for the distal most portion of the top panel and the user opening to flex when the support frame is in the lowered condition (See FIGS. 8A, 8B and 8C). Handle 197 is also shown in this view.

Figure 7B:
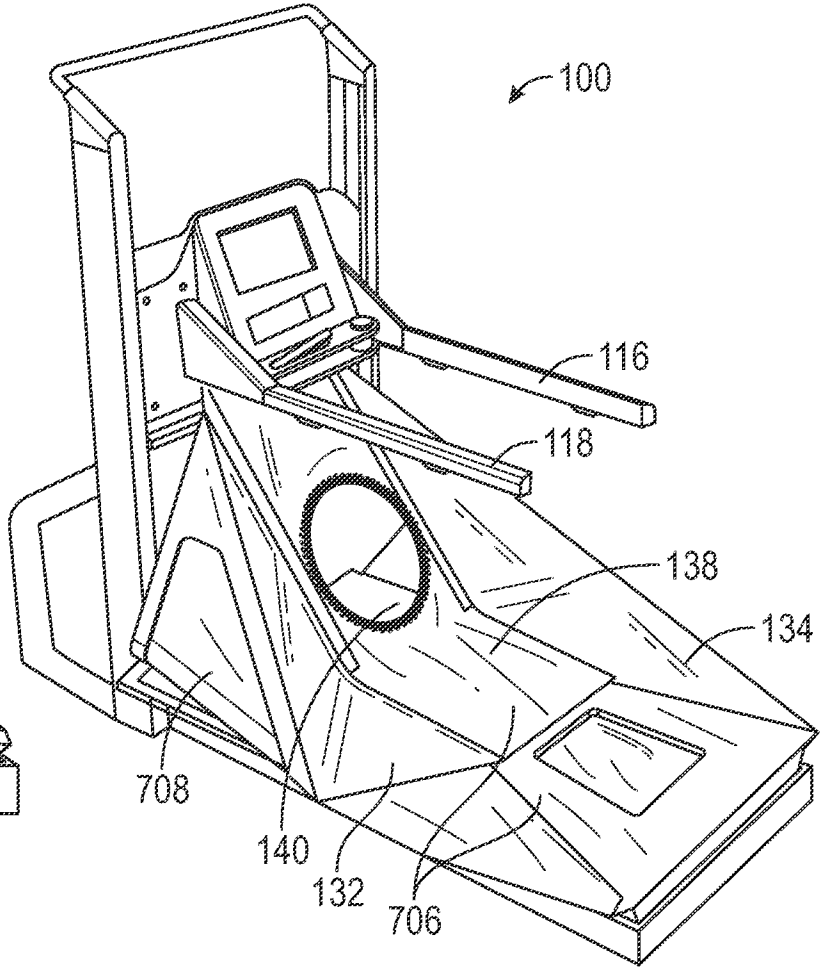
FIGS. 7A and 7B are similar views to the DAP system of FIGS. 6A and 6B. In the views of FIGS. 7A and 7B the DAP top panel and chamber frame are in a lowered condition and the DAP chamber is not pressurized. The bulkhead is at the lowest point of travel to the minimum spacing between the left and right arms and the platform. The DAP chamber bag is folded according to the upper and lower rear panel geometry to make steps leading from the rear of the system to the lowered user opening. Also shown in this view is the folding of the left and right side panels along or near the transparent-non-transparent boundary so as to reduce damage to the transparent panels in the left and right side panels.
Figure 7A:
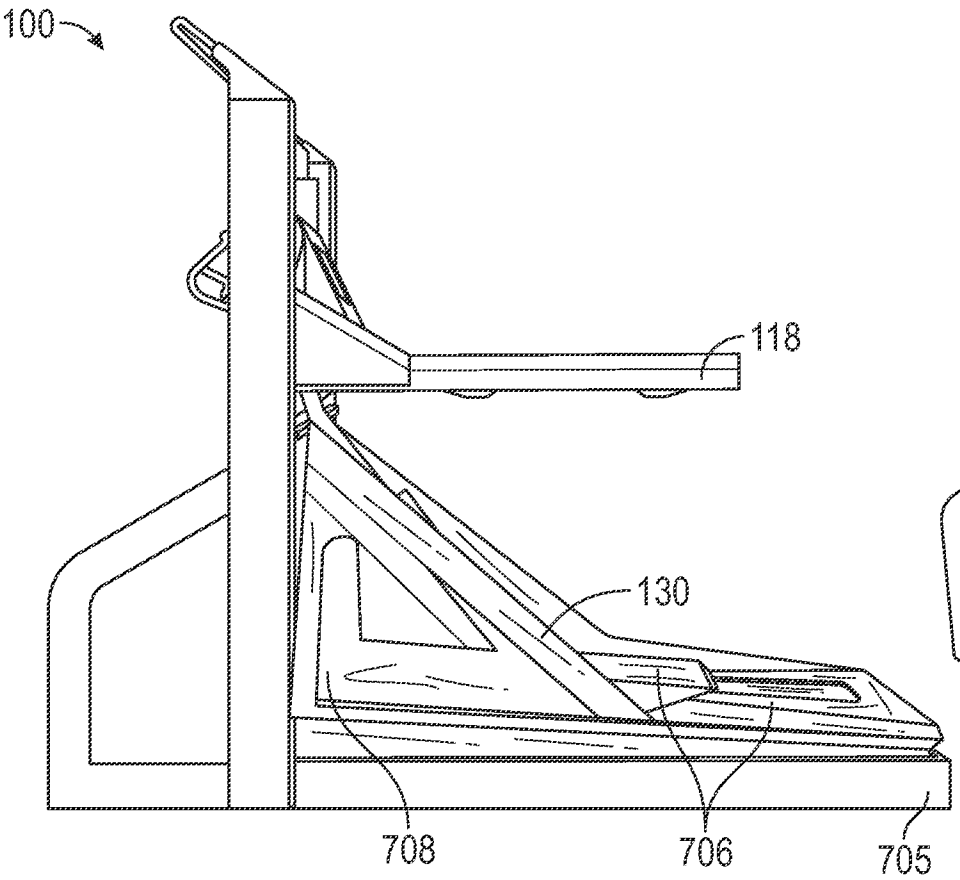

FIGS. 7A and 7B are similar views to the DAP system of FIGS. 6A and 6B. In the views of FIGS. 7A and 7B the DAP top panel 138 and chamber frame are in a lowered condition and the DAP chamber 130 is not pressurized. The bulkhead 115 is at the lowest point of travel to the minimum spacing between the left and right arms 118, 116 and the platform 705. The DAP chamber bag is folded according to the upper and lower rear panel geometry to make steps 706 leading from the rear of the system to the lowered user opening 140. Also shown in this view is the folding of the left and right side panels 134, 132 along or near the transparent-non-transparent boundary so as to reduce damage to the transparent panels 708 in the left and right side panels.

Figure 8A:
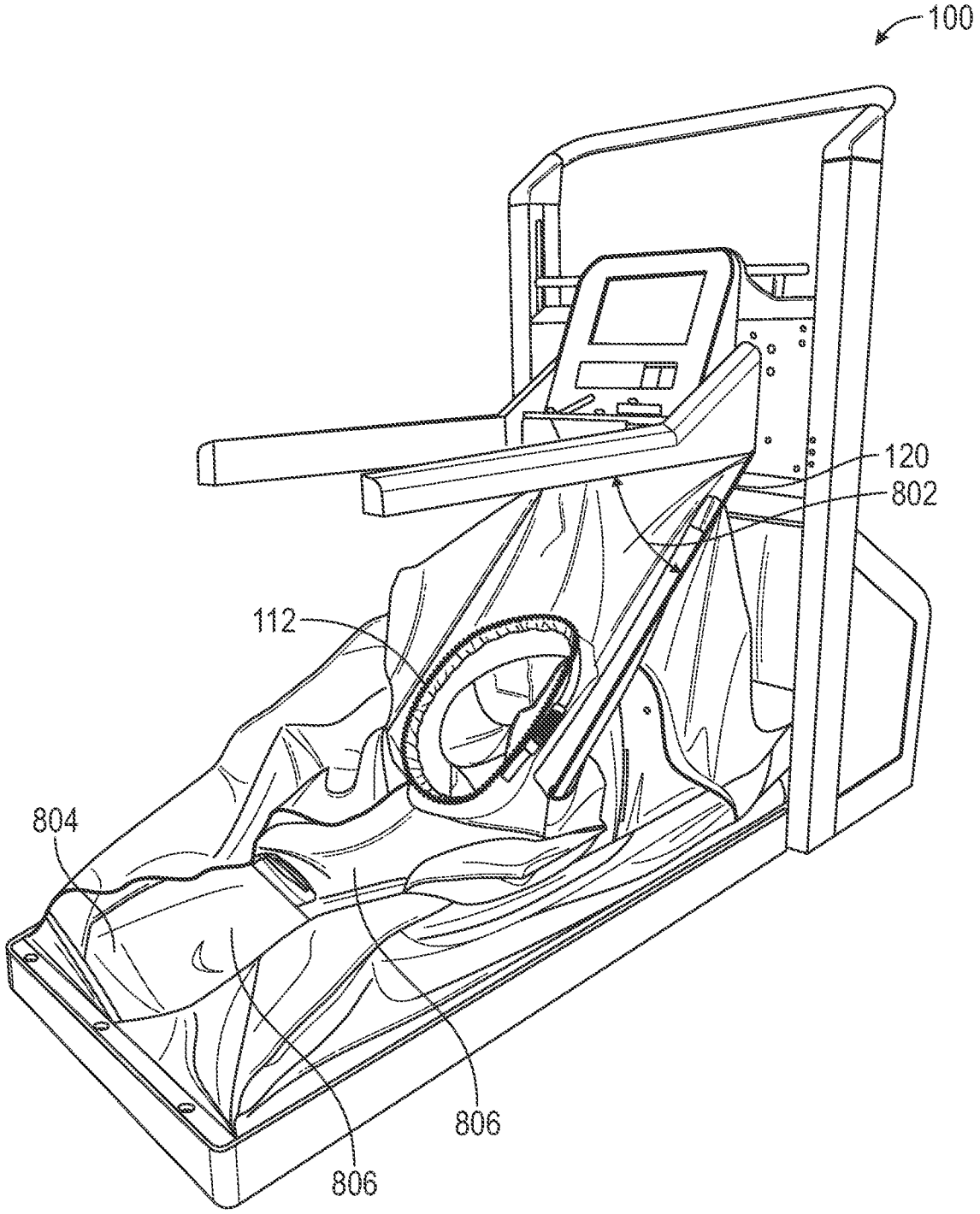
FIG. 8A is a right side rear perspective view of a DAP chamber prototype similar to FIGS. 6A, 6B, 7A and 7B. In this view the chamber support frame is in the lowered condition. This view shows the folding of the DAP chamber panels and the position of the user seal relative to the folds.

FIG. 8A is a right side rear perspective view of a DAP chamber prototype similar to FIGS. 6A, 6B, 7A and 7B. In this view the chamber support frame 120 is in the lowered condition, creating chamber support frame angle 802. This view shows the folding of the DAP chamber panels and the position of the user seal 112 relative to the folds. A folded portion of the rear panel 804 is shown. The folded portion includes first and second step 806.

Figure 8B:
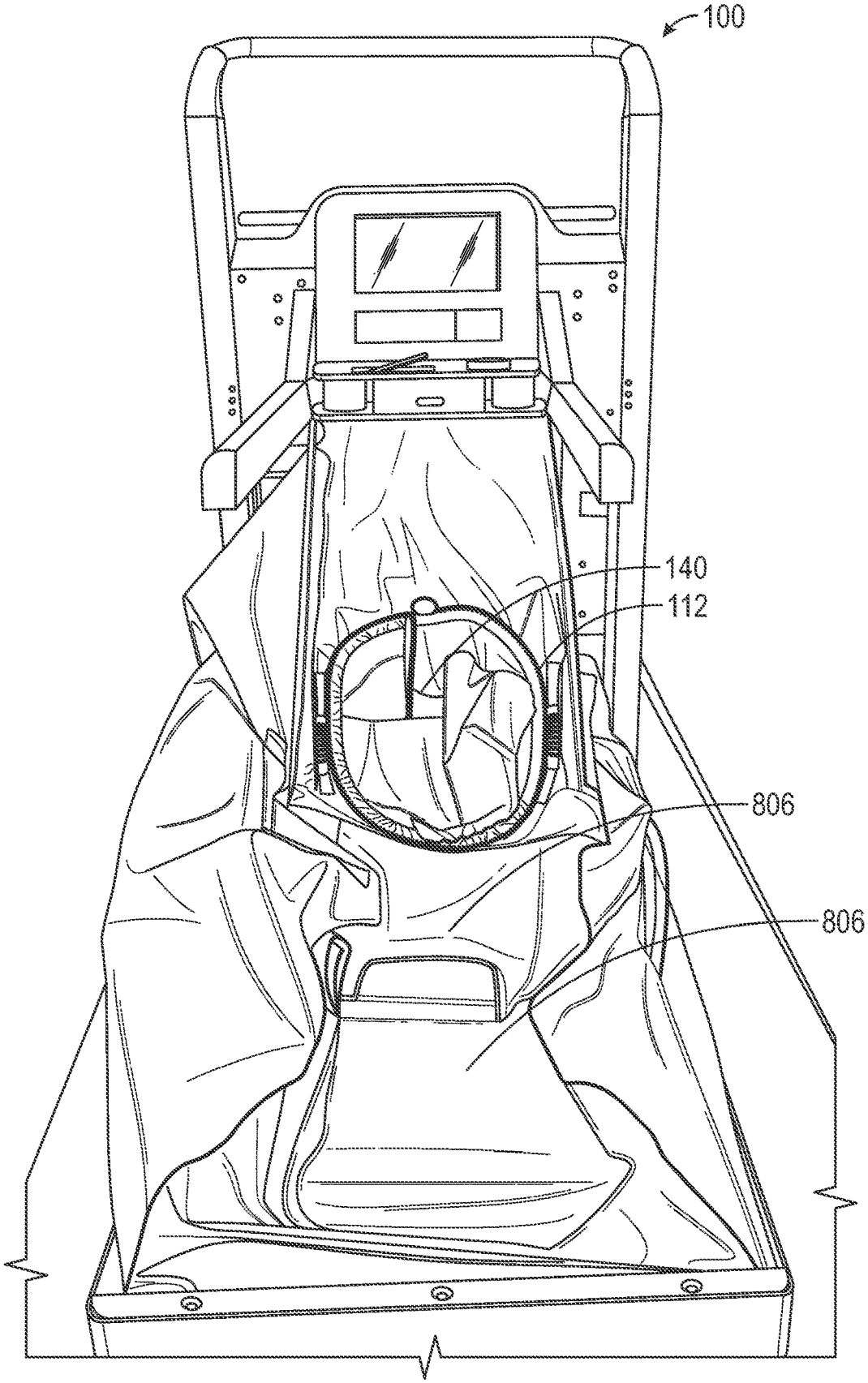
FIG. 8B is a rear view of the DAP chamber configuration shown in FIG. 8A. 2 step locations formed by the rear panel are shown adjacent to the user opening.

FIG. 8B is a rear view of the DAP chamber configuration shown in FIG. 8A. 2 step locations 806 formed by the rear panel 804 are shown adjacent to the user opening 140 and user seal 112.

Figure 8C:
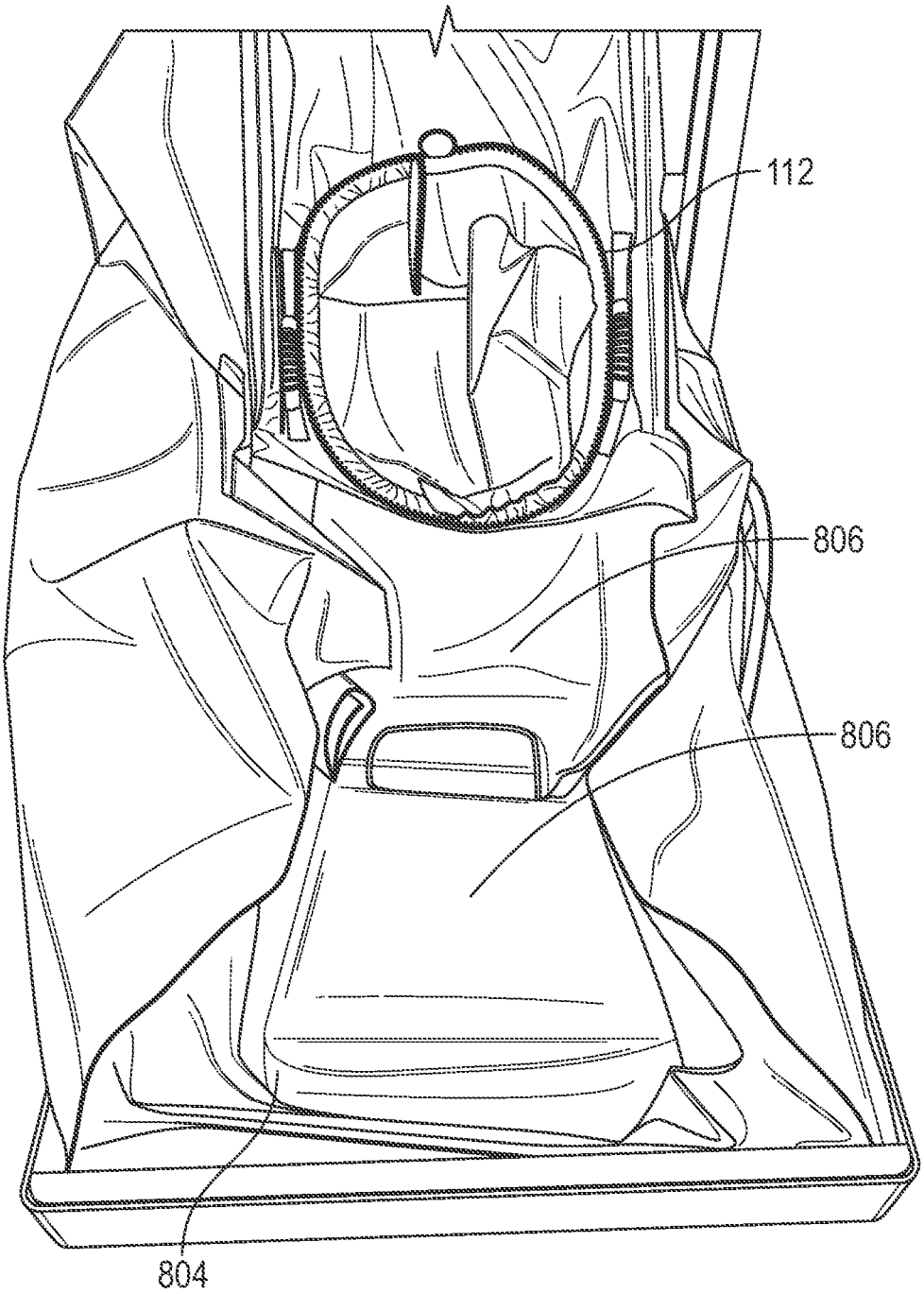
FIG. 8C is a close up rear view of the user chamber and rear panel steps of FIG. 8B.

FIG. 8C is a close up rear view of the user chamber 130 and rear panel steps 806 formed by the folded rear panel 804 and near the edge of the user seal 112 of FIG. 8B.

Figure 8E:
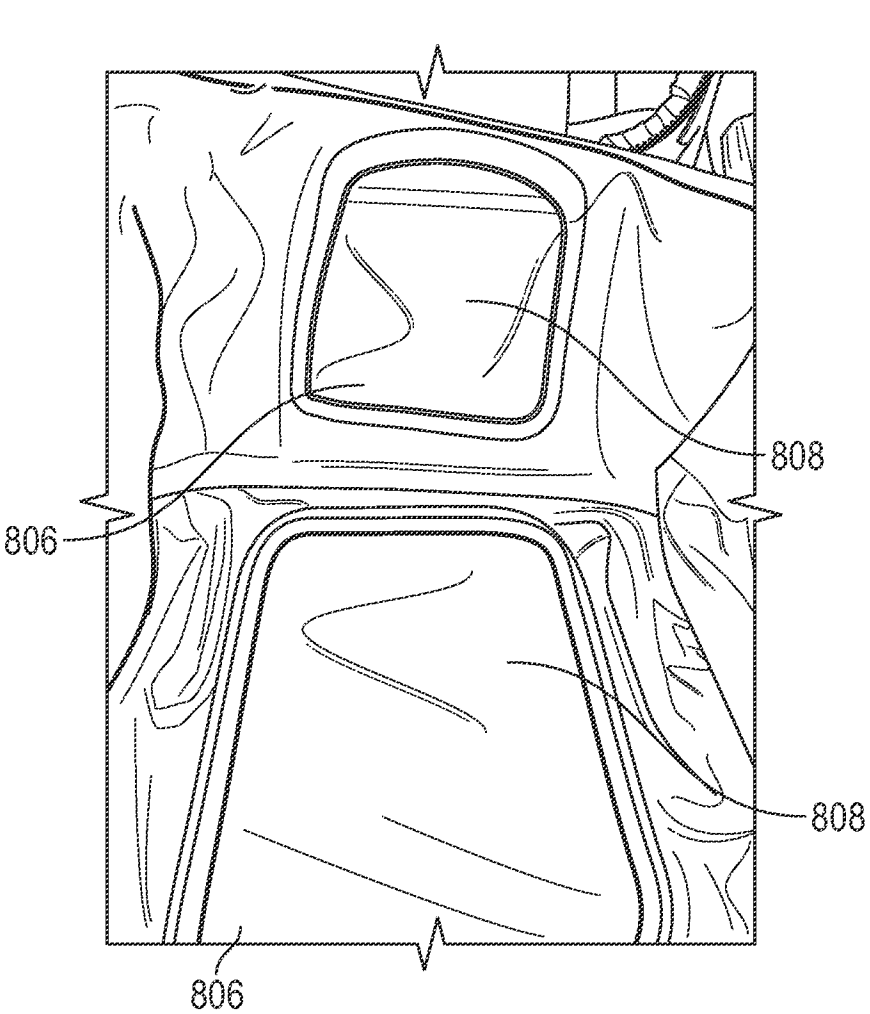
FIG. 8E is a close up rear view of the user chamber and rear panel steps of FIG. 8B with the rear panel fold lifted to show that the rear transparent panel is protected when in the folded condition.
Figure 8D:
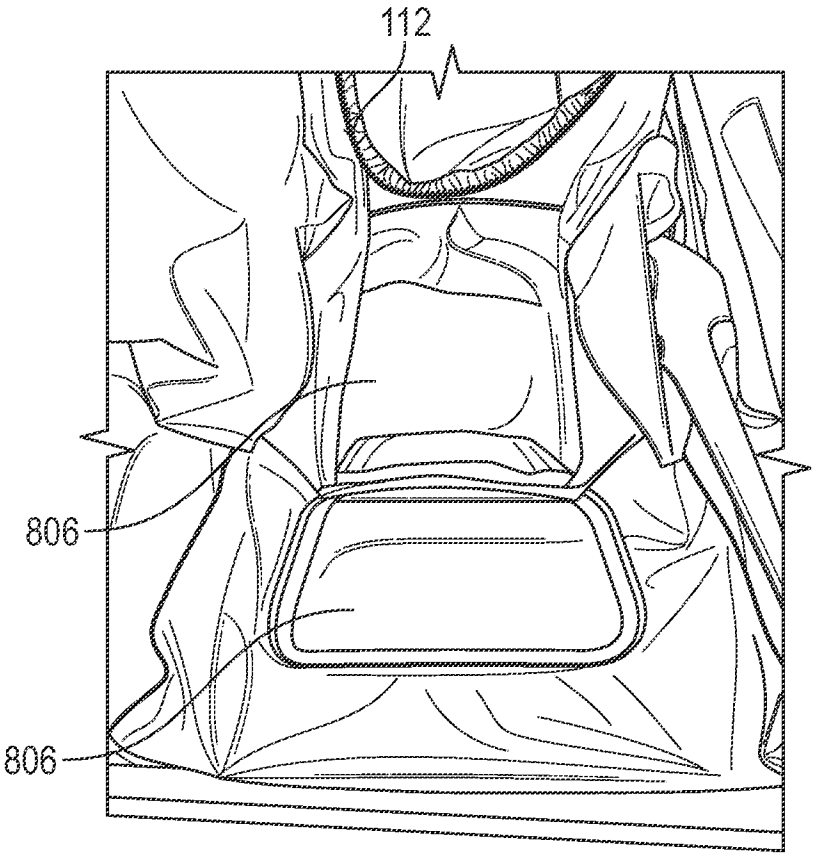
FIG. 8D is a close up rear view of the user chamber and rear panel steps of FIG. 8C.

FIG. 8D is a close up rear view of the user chamber and rear panel steps 806 of FIG. 8C.

FIG. 8E is a close up rear view of the user chamber 130 and rear panel steps 806 of FIG. 8B with the rear panel fold lifted to show that the rear transparent panel 808 is protected when in the folded condition.

Figure 9:
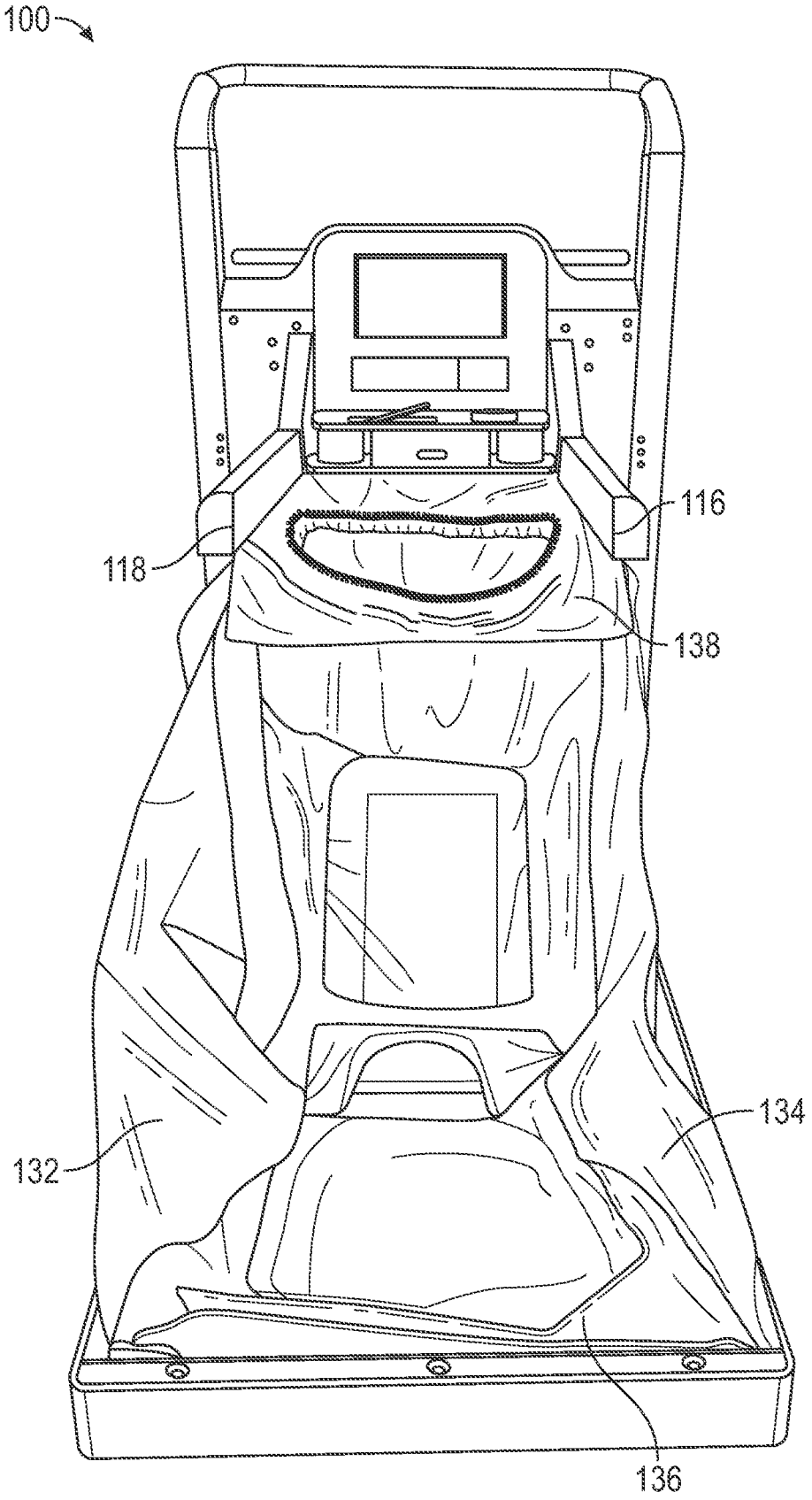
FIG. 9 is a rear perspective view of the DAP system of FIGS. 8A-8E with the chamber support frame in the engaged position. The DAP system is shown uninflated and without a user to illustrate the condition of the bag panels prior to inflation.

FIG. 9 is a rear perspective view of the DAP system of FIGS. 8A-8E with the chamber support frame in the engaged position, engaged with the arms 118, 116 using support frame coupling elements. The DAP system is shown uninflated and without a user to illustrate the condition of the bag panels 132, 134, 136, 138 prior to inflation.

Figure 10A:
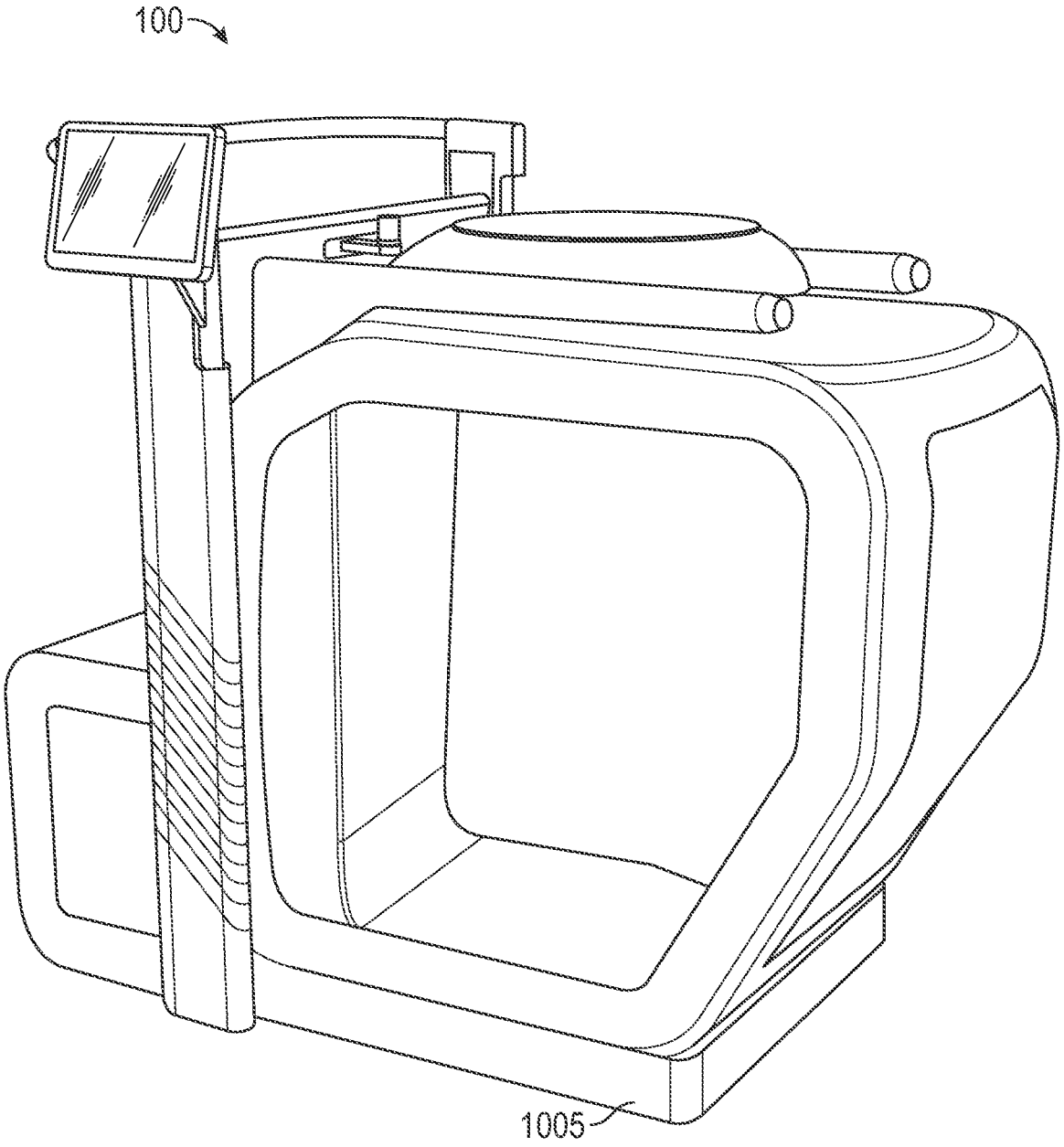
FIG. 10A is a left side view of a DAP system similar to the systems described in FIGS. 1A-4B except the platform is shortened to provide use of an exercise system, balance map or other non-treadmill training device.
Figure 10B:
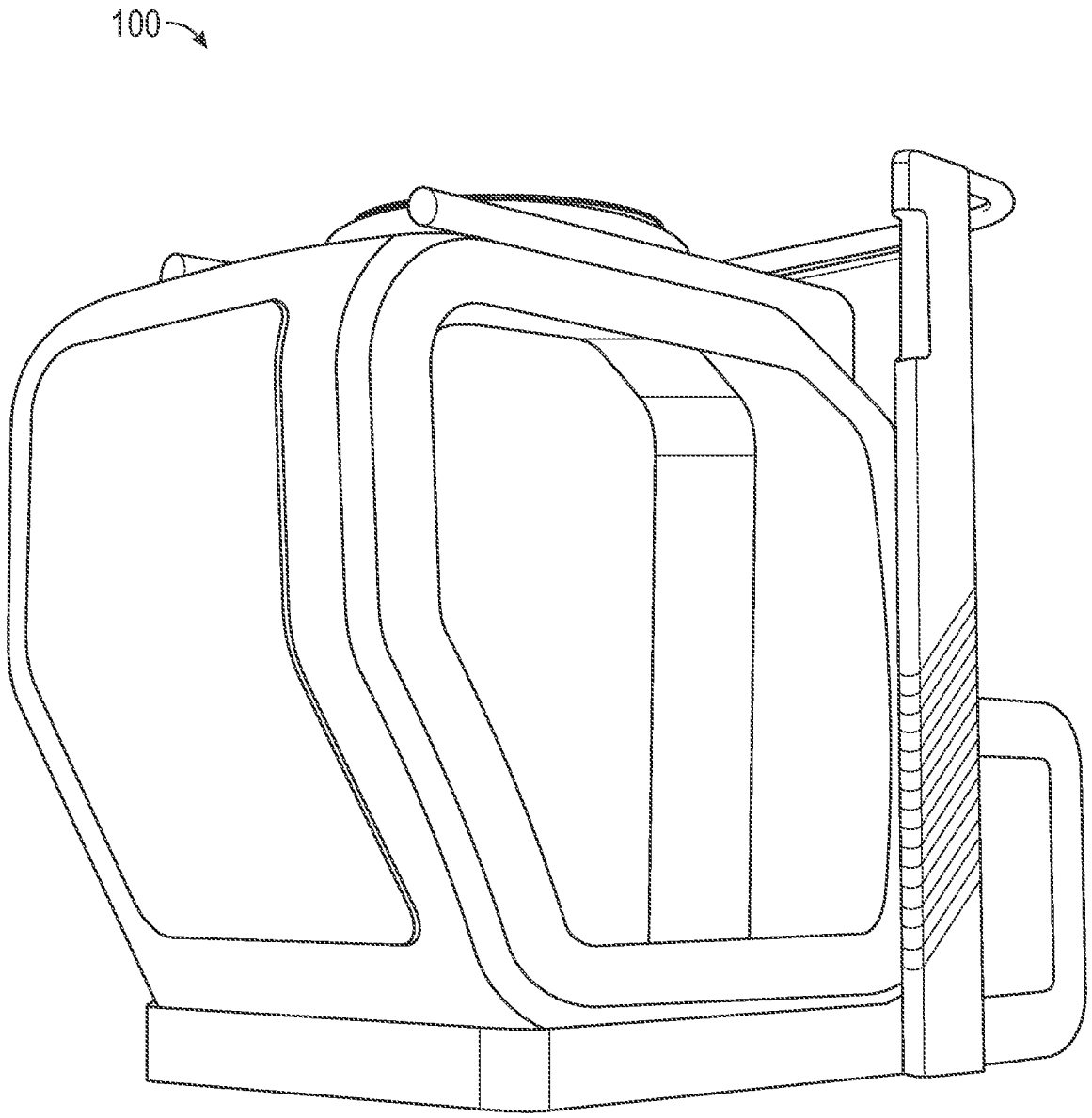
FIG. 10B is right side rear view of the DAP system of FIG. 10A.
Figure 10C:
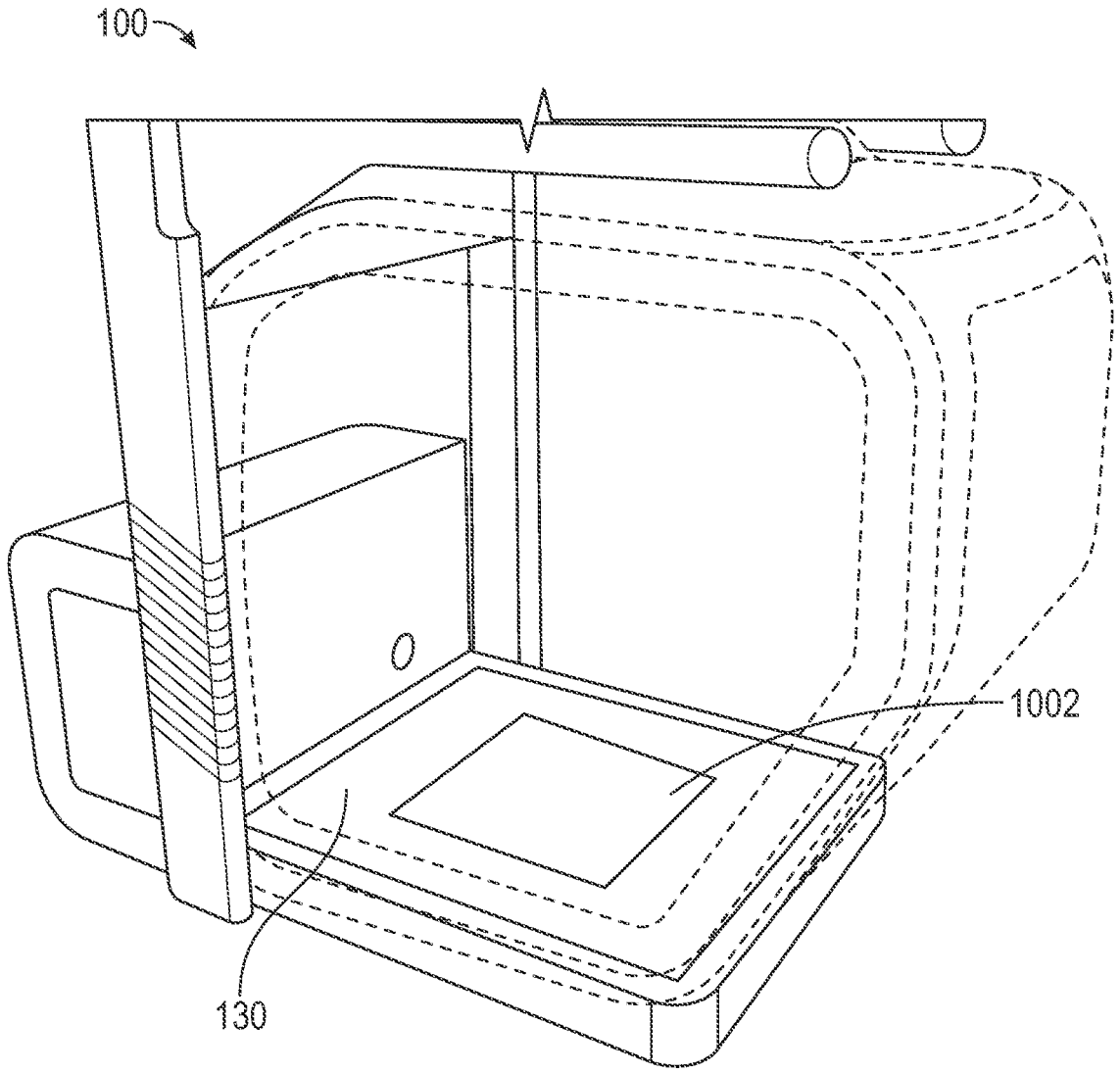
FIG. 10C is a left rear view of the DAP system of FIG. 10A with the interior of the DAP chamber visible showing the balance platform or exercise equipment within the smaller footprint base.

FIG. 10A is a left side view of a DAP system 100 similar to the systems described in FIGS. 1A-4B except the platform 1005 is shortened to provide use of an exercise system, balance map or other non-treadmill training device. FIG. 10B is right side rear view of the DAP system of FIG. 10A. FIG. 10C is a left rear view of the DAP system of FIG. 10A with the interior of the DAP chamber visible showing the balance platform or exercise equipment 1002 within the smaller footprint base. As shown, the smaller footprint deck is adjusted for the size of the balance platform.

The DAP systems described herein have a modular and configurable base design allowing the DAP activity to be conducted on a wide array of exercise platforms. There may be a treadmill 191 within the base 105. Optionally, an exercise platform 192 is within the base 105.

Figure 11B:
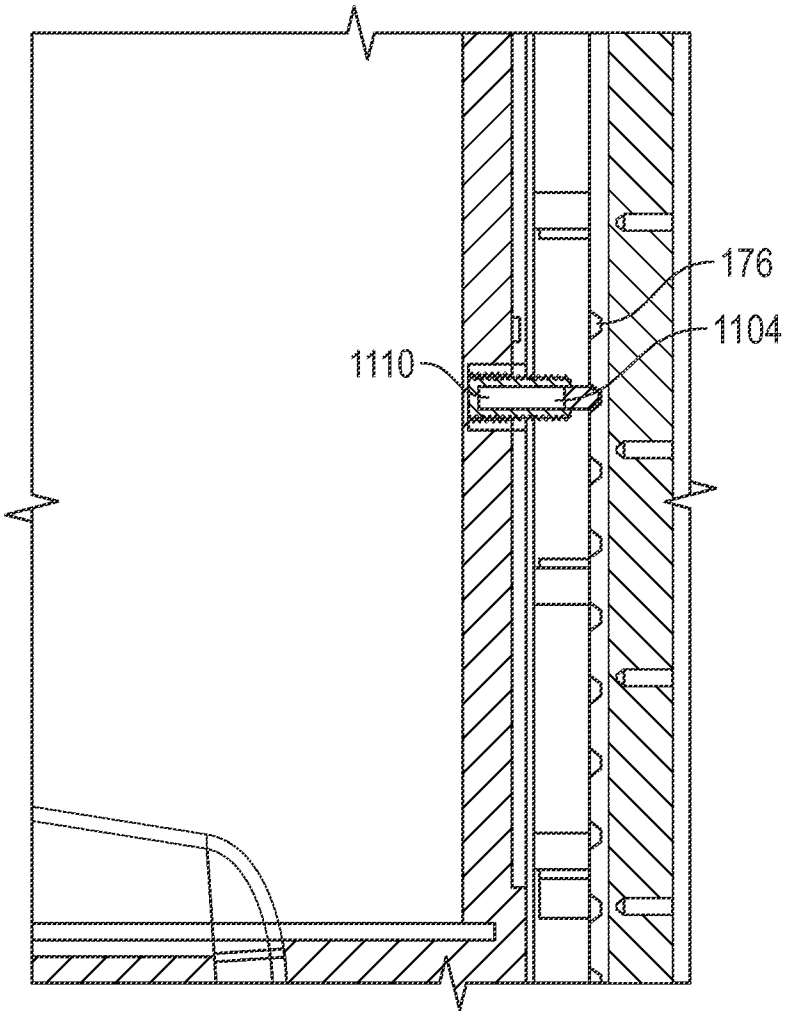
FIG. 11B is cross section view of FIG. 11A showing the position of the locking pin to the preset openings for different user inseam settings.
Figure 11A:
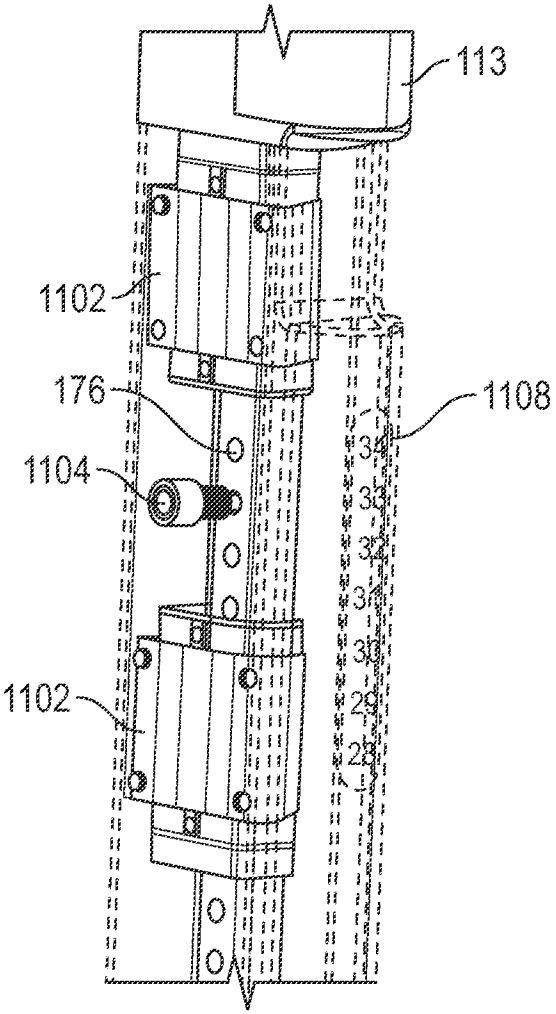
FIG. 11A is a perspective view of the right upright showing interior components of vertical bearings and a locking pen along with several slots for engaging at separate user inseam settings. Also shown in this view are user inseam settings ranging from 28 to 34.

FIG. 11A is a perspective view of the right upright showing interior components of vertical bearings 1102 and a locking pen 1104 along with several slots or openings 176 for engaging at separate user inseam settings. Also shown in this view is an index of user inseam settings ranging from 28 to 34.

FIG. 11B is cross section view of FIG. 11A showing the position of the locking pin 1104 to the preset openings 176 for different user inseam settings. FIG. 11B also shows a spring loaded detent 1110 for height positioning an improved locking alignment. The openings 176 are spaced to provide different inseam settings.

Figure 12B:
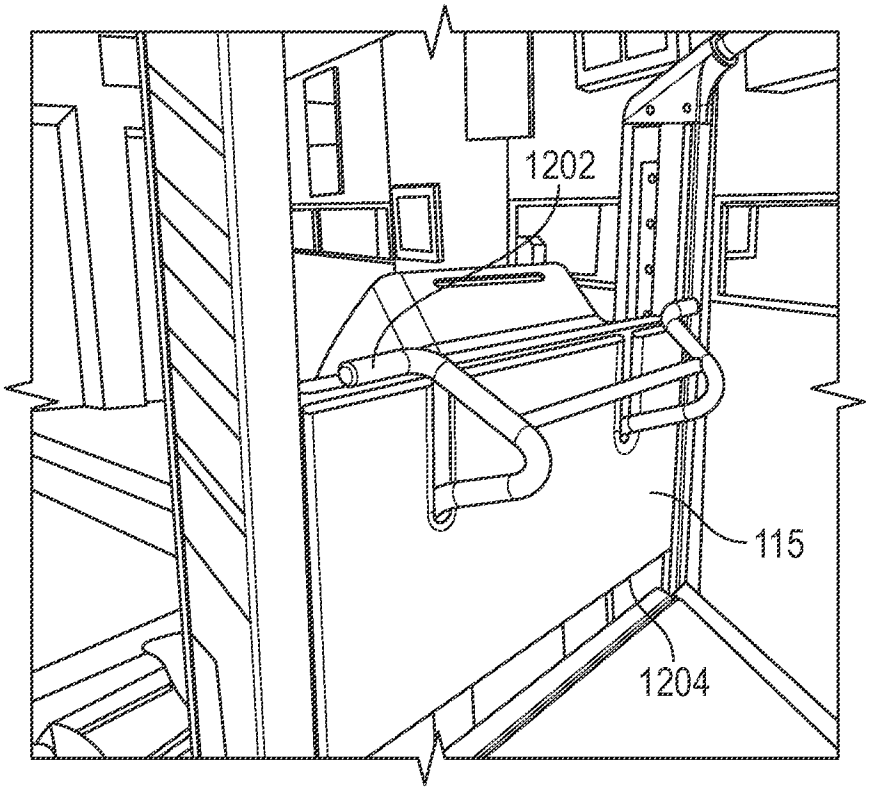
FIGS. 12A and 12B are front views of the DAP system bulkhead with the front cover in place.
Figure 12A:
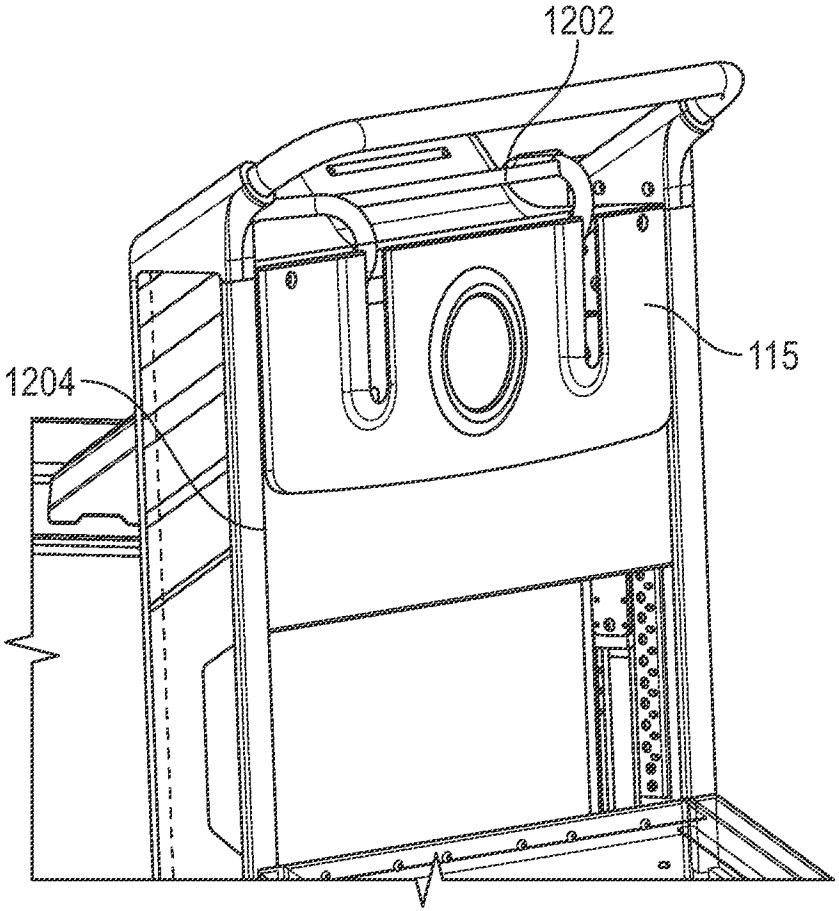

FIGS. 12A and 12B are front views of the DAP system bulkhead 115 with the front cover 1204 in place. FIG. 12A shows the bulkhead 115 at the upper most travel for a bulkhead as positioned in FIG. 6A. FIG. 12B shows the bulkhead 115 at the bottom of travel as shown in FIGS. 7A and 7B. Also shown in FIGS. 12A and 12B is the pull bar arm 1202.

Figure 12C:
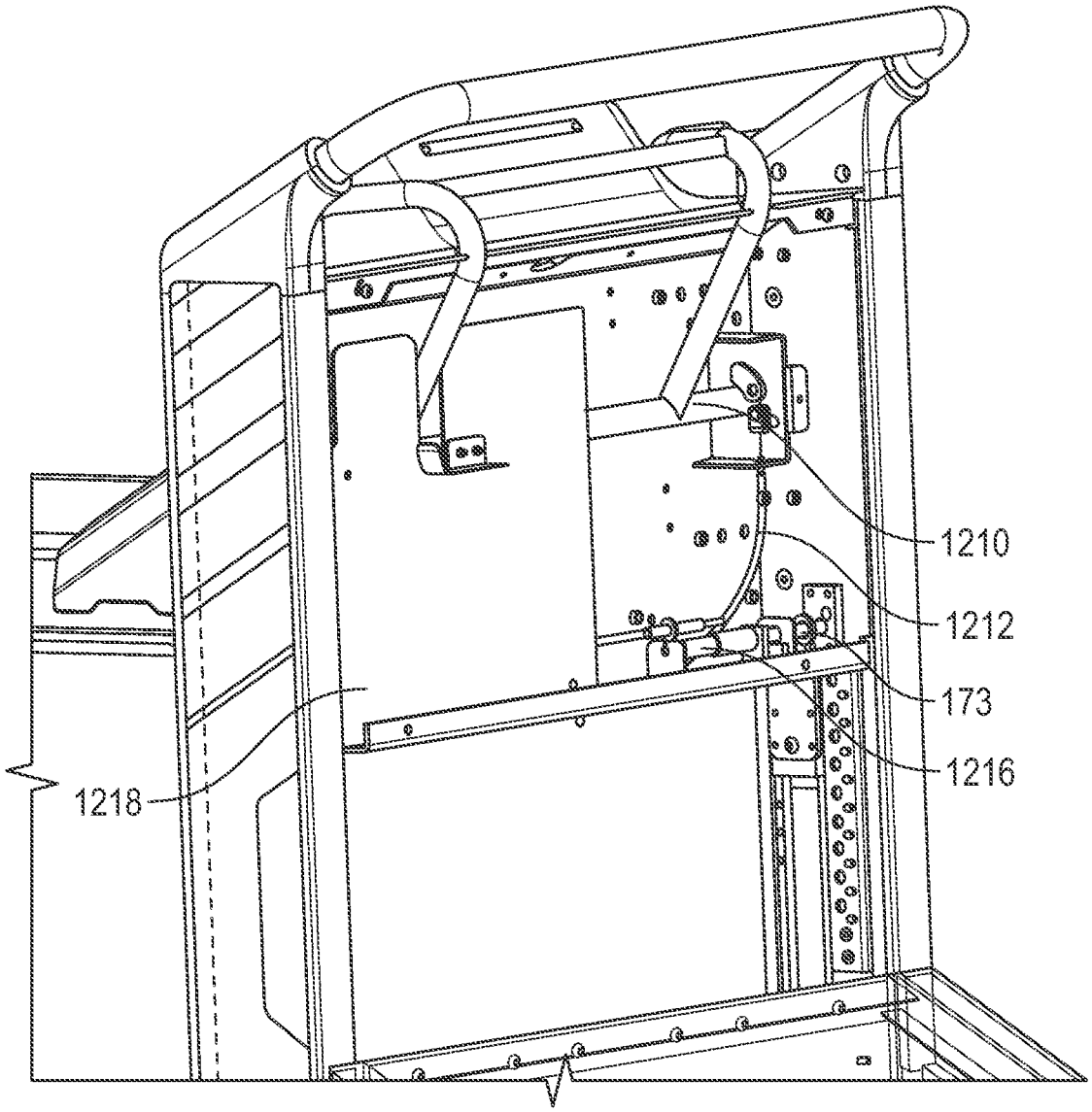
FIGS. 12C and 12D show the bulkhead view of FIGS. 12A and 12B with the bulkhead front cover removed showing a pin retraction mechanism.
Figure 12D:
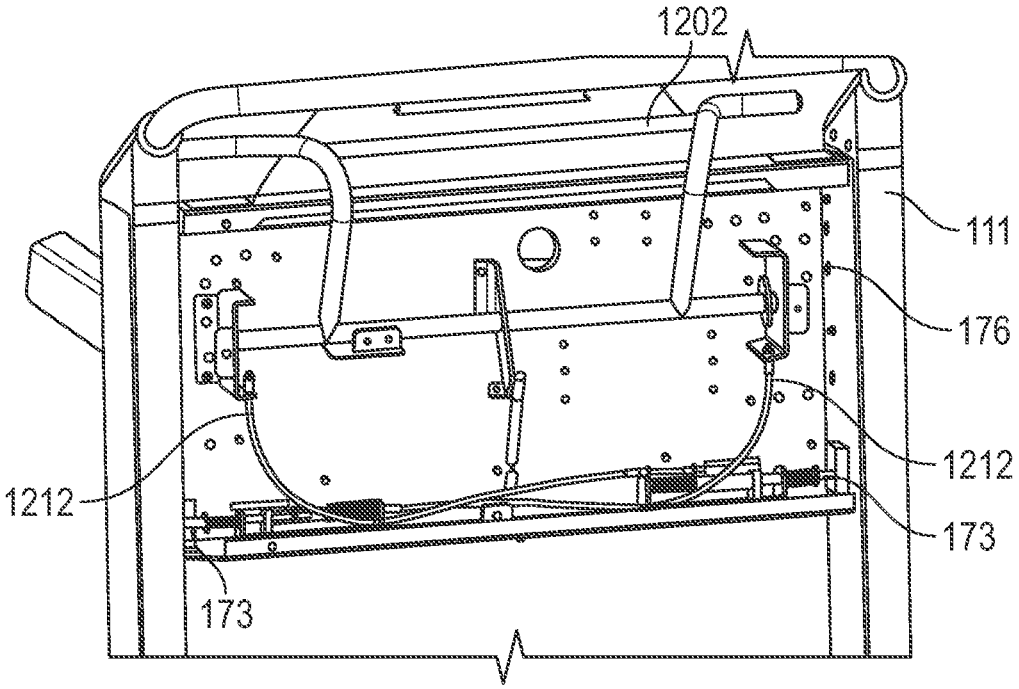
Figure 12E:
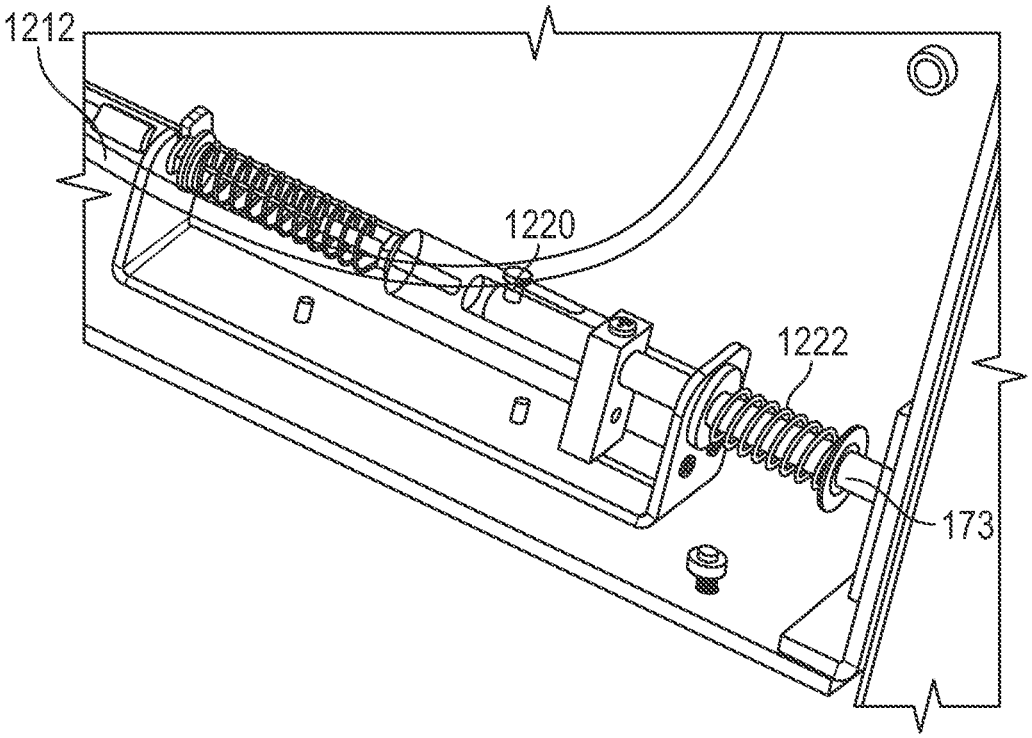
FIG. 12E is a detail view of a portion of FIG. 12D.

FIGS. 12C and 12D show the bulkhead 115 view of FIGS. 12A and 12B with the bulkhead front cover removed showing a pin retraction mechanism comprising a central shaft 1210, a cable pull 1212, a spring bonded pin 173, and a cable connector 1216 to pin 173. Also shown in FIG. 12C is a left side cover 1218. FIG. 12E is a detail view of a portion of FIG. 12D and shows pin 173, spring 122 around pin 1214, travel stop 1220, and cable 1212. The motion of the pull arm rotates the central shaft to pull cables 1212 to withdraw the normally biased outward pins 173 from engagement with a hole 176 in the upright 111.

The bulkhead is positioned along the left and right uprights into pre-selected vertically displaced positions above the exercise device within the DAP chamber. These pre-selected heights are selected to meet the requirements of a range of users without requiring the bulkhead or the DAP chamber bag to move to a lowered position as near as possible to the DAP base. Instead, the lower bulkhead height corresponds to a level just below or within less than 10 inches of the lowest user inseam setting. In order to provide ease of movement of the bulkhead, there is provide a release mechanism such as a lever or a pull bar. Operation of the release mechanism will cause a pair of retractable pins 173 on the bulkhead 145 to mover relative to a series of holes 176 along a surface of each of the uprights 111, 113 adjacent to the bulkhead. The holes 176 are spaced along the upright and positioned for engagement with one pin of the pair of retractable pins in order that the user cockpit may be placed to provide the desired user inseam setting.

There is a release mechanism on the bulkhead configured to move the retractable pins from engagement with one of the holes along the surface of each of the uprights. In one aspect, the release mechanism is a slider 172 that moves across a face of the bulkhead 115 as in FIG. 1. In another embodiment, the release mechanism is a pull bar 174 which is described in FIGS. 12A-12D The holes 176 spaced along the surface of each of the uprights provide a fixed position of the arms and bulkhead at a plurality of predetermined user inseams lengths. Additionally, the holes 176 are spaced along the surface of each of the uprights provide a fixed position of the bulkhead when the pins are engaged with the holes to position the left arm and the right arm 111, 113 alongside a user's hips.

In another embodiment, the holes 176 spaced along the surface of each of the uprights provide a fixed position of the bulkhead 115 when the pins 173 are engaged so that the differential air pressure system accommodates a user having a waist to foot measurement between 29 inches and 42 inches. In additional embodiments, the holes 176 are spaced along the surface of each of the uprights provide a fixed position of the bulkhead 115 when the pins 173 are engaged so that the differential air pressure system accommodates a user as defined within FIGS. 27A, B and C.

Figure 13:
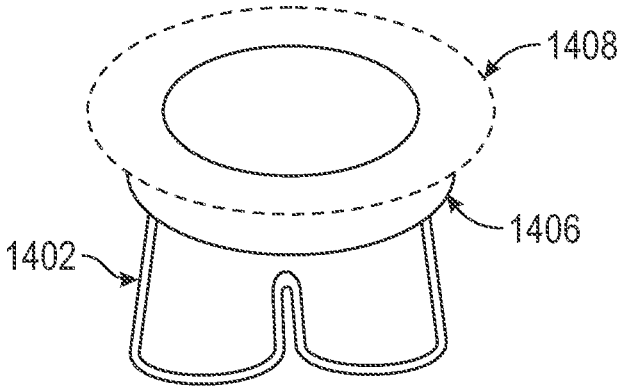
FIG. 13 is a perspective view of a user seal on a pair of shorts.

FIG. 13 is a perspective view of a user seal on a pair of shorts. FIG. 13 shows the a pair of user shorts 1402, a user seal 1406 on the shorts and a user zipper 1408 on the shorts.

Figure 14:
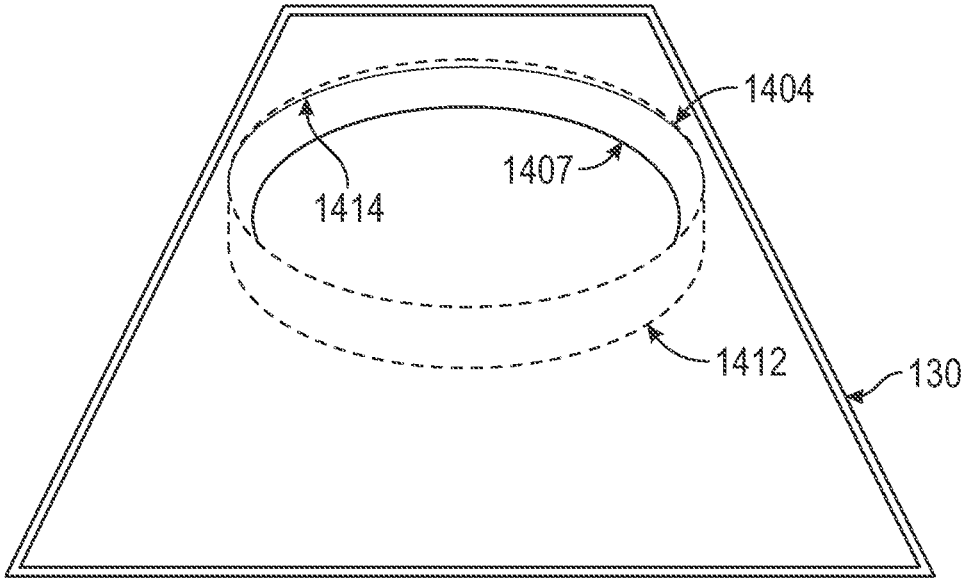
FIG. 14 is a portion of a DAP chamber top panel with an opening and a chamber sealing member in position and coupled to the chamber opening.

FIG. 14 is a portion of a DAP chamber top panel with an opening 140 and a chamber sealing member in position and coupled to the chamber opening. Shown in FIG. 14 is the DAP bag 130, a user seal 1407 on the bag, and a user seal protector 1408. A height adjustment 1410 is also shown.

Figure 15:
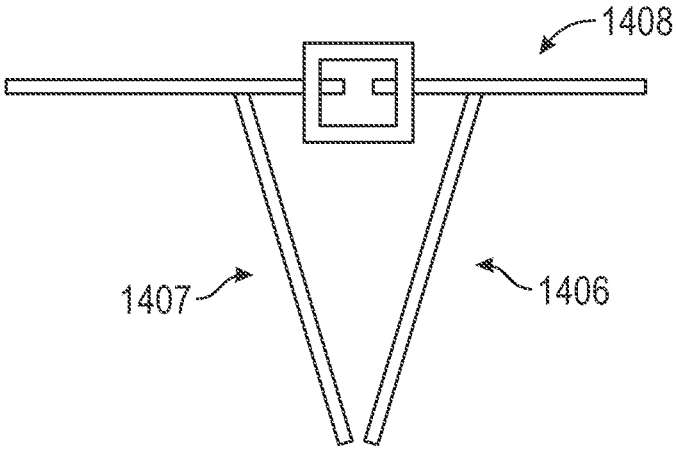
FIG. 15 is a cross section view of the duckbill seal formed when the user seal of FIG. 13 is coupled to the chamber seal of FIG. 14.

FIG. 15 is a cross section view of the duckbill seal formed when the user seal 146 of FIG. 13 is coupled to the chamber seal 147 of FIG. 14.

Figure 17:
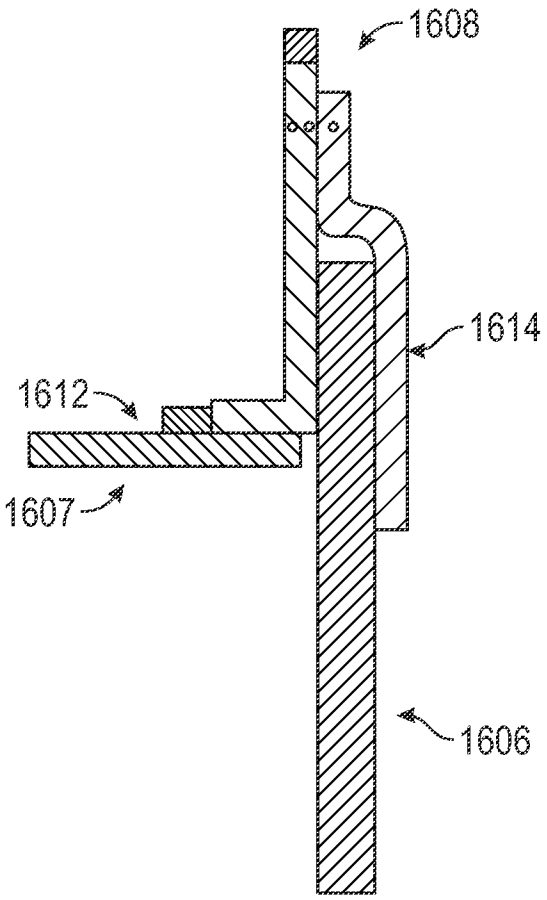
FIG. 17 is the chamber sealing member of FIG. 16 shown in an orientation when in use when a user is coupled to the user zipper. The chamber seal is extended to the left under the chamber top panel and the chamber gasket. The user zipper and zipper spacer are shown in relation to the chamber seal indicating how the zipper spacer may provide height adjustment of the user seal.
Figure 16:
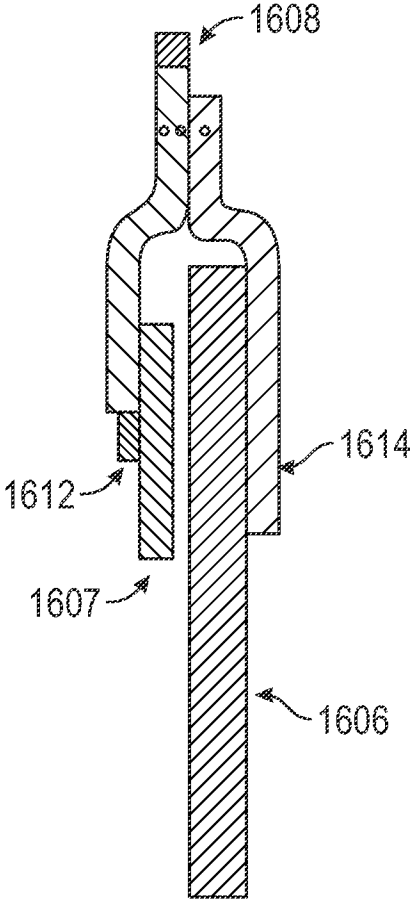
FIG. 16 is a cross section view of a chamber sealing member. In this view the relationship between the user zipper and the chamber zipper is shown.

FIG. 16 is a cross section view of a chamber sealing member. In this view the relationship between the user zipper 1608 and the chamber zipper 1612 is shown. FIG. 17 is the chamber sealing member of FIG. 16 shown in an orientation when in use when a user is coupled to the user zipper 1608. The chamber seal 1607 is extended to the left under the chamber top panel and the chamber gasket. The user zipper 1608 and zipper spacer are shown in relation to the chamber seal 1607 indicating how the zipper spacer may provide height adjustment of the user seal.

Figure 18:
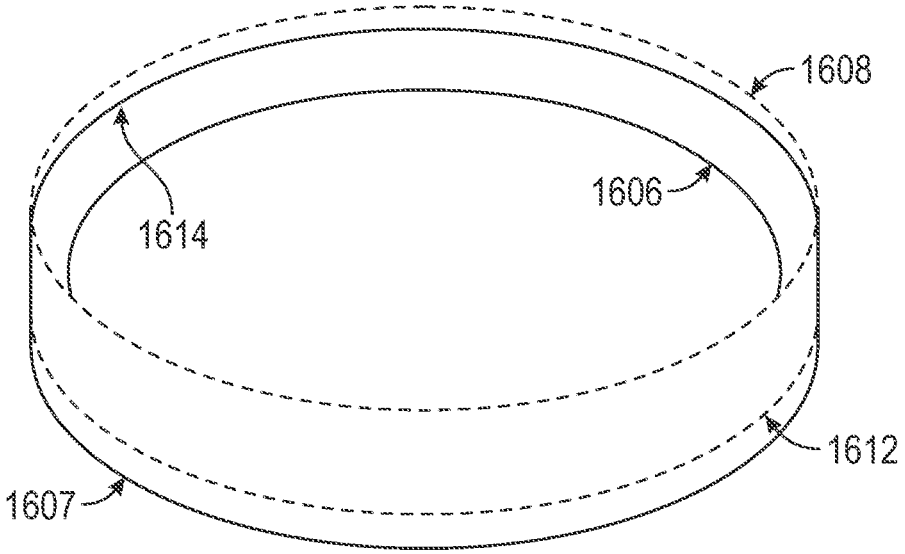
FIG. 18 is a perspective view of the chamber sealing member of FIGS. 16 and 17.

FIG. 18 is a perspective view of the chamber sealing member of FIGS. 16 and 17. Shown in FIG. 18 is the user zipper 1608, the bag zipper 1612, the user seal 1606, the bag seal 1607, and the user seal protector 1614.

A differential air pressure chamber bag as used in the various embodiments includes a left side panel; a right side panel; a rear panel; a front panel; a top panel having an opening; a zipper along the top panel opening. The top panel opening is configured to engage with a chamber sealing member. The chamber sealing member has a zipper spacer, a first zipper on a first side of the zipper spacer configured to couple to the zipper in the top panel opening and a second zipper on a second side of the zipper spacer configured to couple to a user zipper. Additionally, there is a chamber gasket adjacent to the first zipper and a first user gasket adjacent to the second zipper. The chamber sealing member also includes a chamber liner adjacent to the first zipper and a user liner adjacent to the second zipper wherein in use the first zipper moves along the chamber liner when coupling to the zipper in the top panel and the second zipper moves along the user liner when coupling to a user zipper.

In some embodiments, the zipper spacer is dimensioned wherein the first zipper is separated from the second zipper by from 0.5 inches to 6 inches. The first zipper teeth spacing is different from the second zipper teeth spacing. In other configurations, the DAP system includes a user seal having a user zipper and a second user gasket wherein with the user zipper is coupled to the second zipper the first user seal gasket is against the second user gasket. Still further, the zipper teeth spacing on the user zipper and the second zipper is different from the zipper spacing on the first zipper.

One benefit of the DAP chamber top panel having an opening configured for use with an embodiment of the chamber sealing member is that the exchange of the user zipping in and zipping out can result in wear around the chamber top panel as a result of abrasion caused by the zipper motion. In contrast, in chamber top panels using a chamber sealing member, the main portion of the chamber top panel is protected. Any wear is absorbed by the chamber sealing member. As such, the DAP bag wear is extended because a source of potential DAP top panel wear is mitigated. Replacement of a chamber sealing member is much less than the cost of a DAP chamber bag once the top panel has been damaged.

Figure 19:
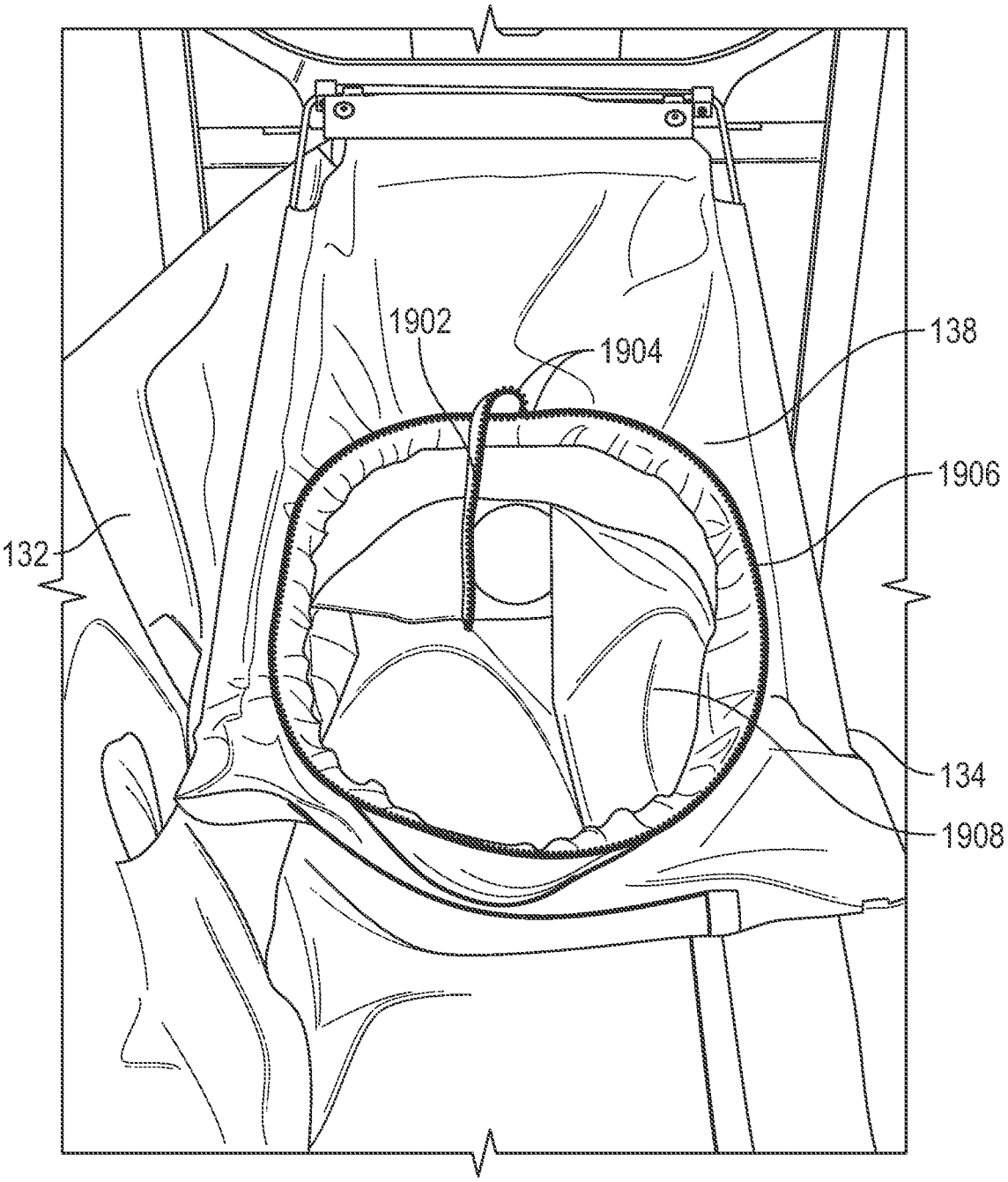
FIG. 19 is a close up view of a DAP chamber with the support frame in the lowered condition showing a chamber sealing member in place in the DAP chamber top panel.

FIG. 19 is a close up view of a DAP chamber with the support frame in the lowered condition showing a chamber sealing member 1904 in place in the DAP chamber top panel 138. The chamber upper panel 138 has an opening 1908 that has the chamber sealing member 1904 zipped in. The chamber sealing member 1904 includes a user size zipper with a long lead in 1902. The chamber zipper 1906 is engaged. This configuration is 'ready to receive user' to zip in.

Figure 20:
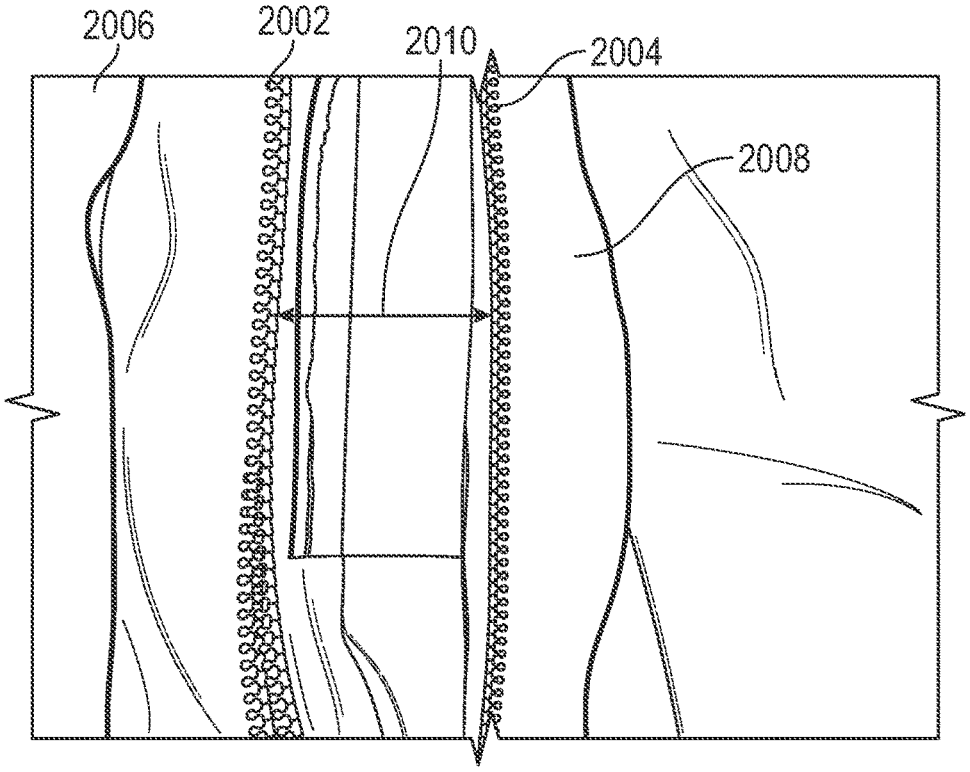
FIG. 20 is a close up view of a prototype chamber sealing member. The relationship of the zipper spacer to the user zipper and the chamber zipper is visible in this view. The relationship between the chamber gasket to the chamber zipper and user gasket to the user zipper as also shown.

FIG. 20 is a close up view of a prototype chamber sealing member. The relationship of the zipper spacer 2010 to the user zipper 2002 and the chamber zipper 2004 is visible in this view. The relationship between the chamber gasket 2008 to the chamber zipper 2004 and user gasket 2006 to the user zipper 2002 as also shown. Different spacing s between zippers is available, permitting a height adjustable user cockpit in use.

Figure 21:
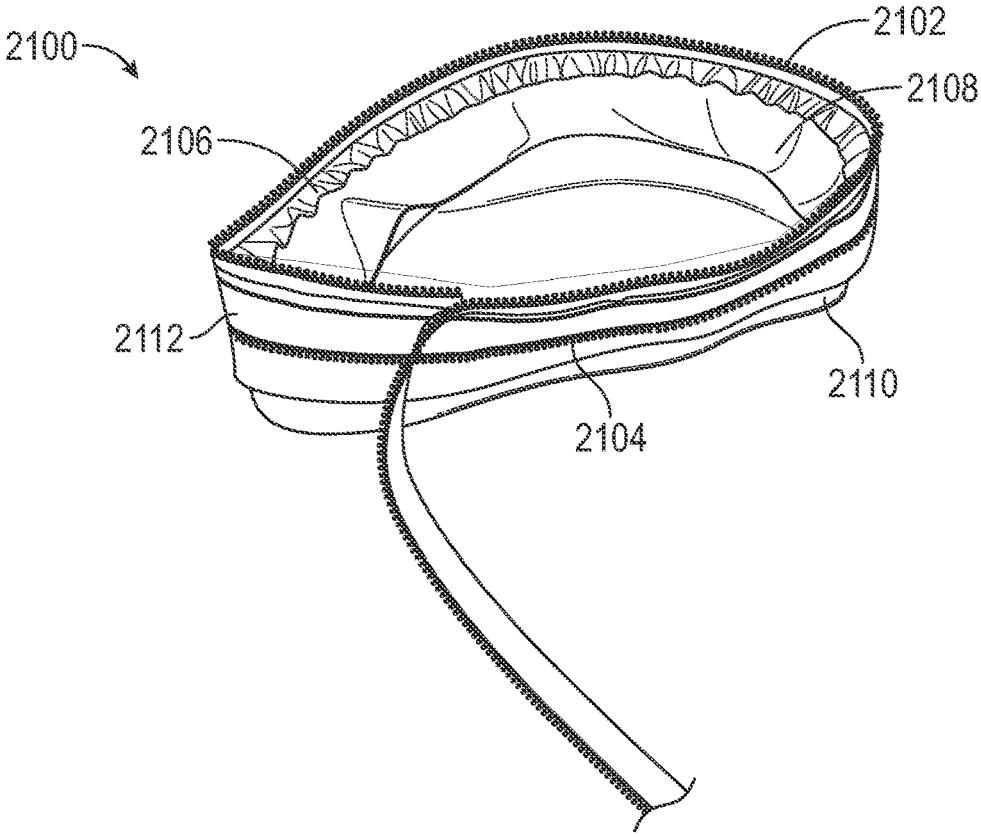
FIG. 21 is a perspective view of a prototype chamber sealing member oriented with the user zipper up and the chamber zipper down as would be when positioned for use in a chamber top panel of a DAP chamber.

FIG. 21 is a perspective view of a prototype chamber sealing member 2100 oriented with the user zipper 2102 up and the chamber zipper 2104 down as would be when positioned for use in a chamber top panel of a DAP chamber. The user zipper 2102 refers to the zipper configured to couple to a user zipper. The chamber zipper 2104 refers to the zipper configured to couple to a chamber top panel zipper. Also shown in FIG. 21 is a user gasket seal protector 2106, a user gasket seal 2108, and a chamber gasket 2110. A zipper spacer 2112 is also shown.

There is also an enclosure 145 adjacent the pair of uprights 113, 113 in the front portion 107 of the base 105. The enclosure 145 includes a computer controller 146 and a differential air pressure source 150 in the enclosure 145 wherein an outlet 151 of the differential air pressure source 150 is coupled to an inlet 156 in the differential air pressure chamber bag 130. Various embodiments and configurations of the components in the enclosure as shown in FIGS. 22-25. The enclosure includes a differential air pressure source 150 that is a pump under control of the computer controller 146. The pump 150 is one of a variable speed blower, a fixed speed pump, a variable speed pump, a centrifugal pump or a recirculating pump.

In other embodiments, the enclosure includes a valve 152 with an inlet 156 coupled to the differential air pressure chamber bag 130 and an exhaust within the enclosure 145. In some aspects, the there is a muffler 154 on a pump 150 exhaust. Alternatively, the valve 152 is a plunger valve 160 as in FIGS. 26A, 26B and 26C. The valve 152 may be a butterfly valve 153 also under control of the computer controller.

Figure 22:
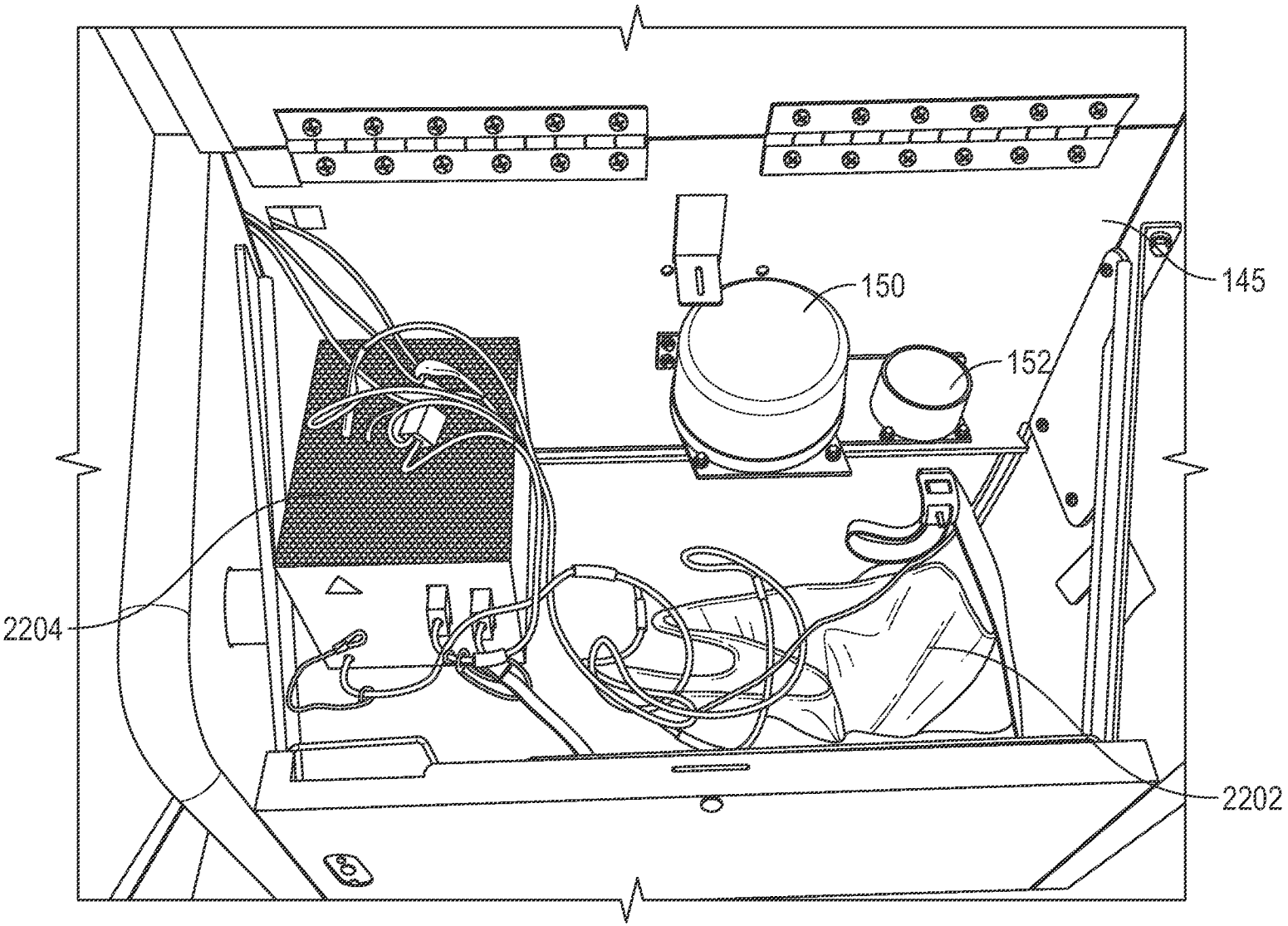
FIG. 22 is a top down view of an enclosure showing the relative positions of an electronics enclosure, a blower and an exhaust valve without a muffler. The front portion of the DAP bag is also shown with attachment points for the blower and valve.

FIG. 22 is a top down view of an enclosure 145 showing the relative positions of an electronics enclosure 2204, a blower 150 and an exhaust valve 152 without a muffler. The front portion 2202 of the DAP bag is also shown with attachment points for the blower 150 and valve 152.

Figure 23:
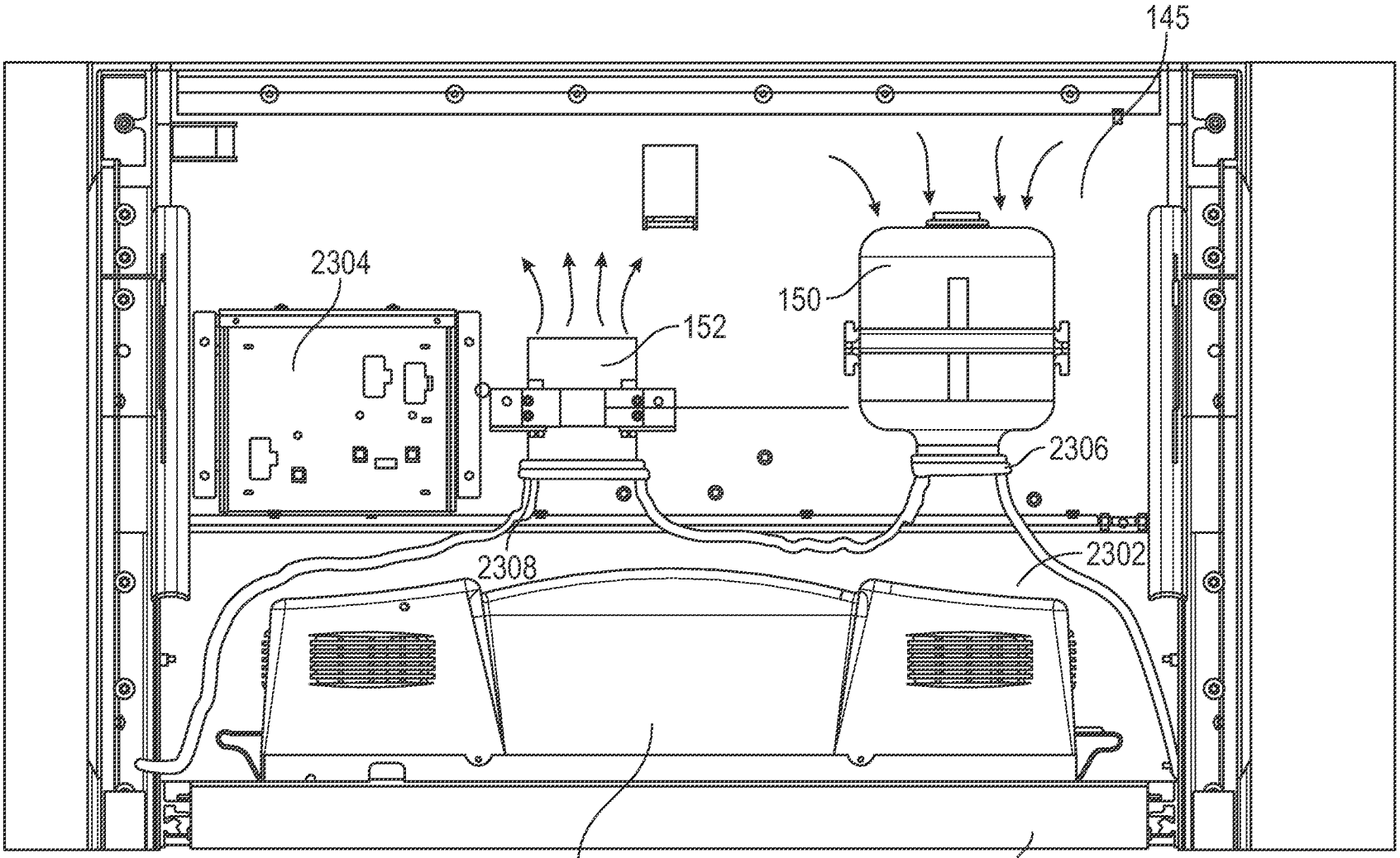
FIG. 23 is front view of an enclosure similar to FIG. 22. The connection points to the DAP bag for the blower and the valve are shown relative to the treadmill located within the DAP platform or base.

FIG. 23 is front view of an enclosure 145 similar to FIG. 22. The connection points to front portion 2302 of the DAP bag for the blower 150 and the valve 152 are shown relative to the treadmill 2310 located within the DAP platform or base 105. The valve seal 2308 and the pump seal 2306 are shown.

Figure 24:
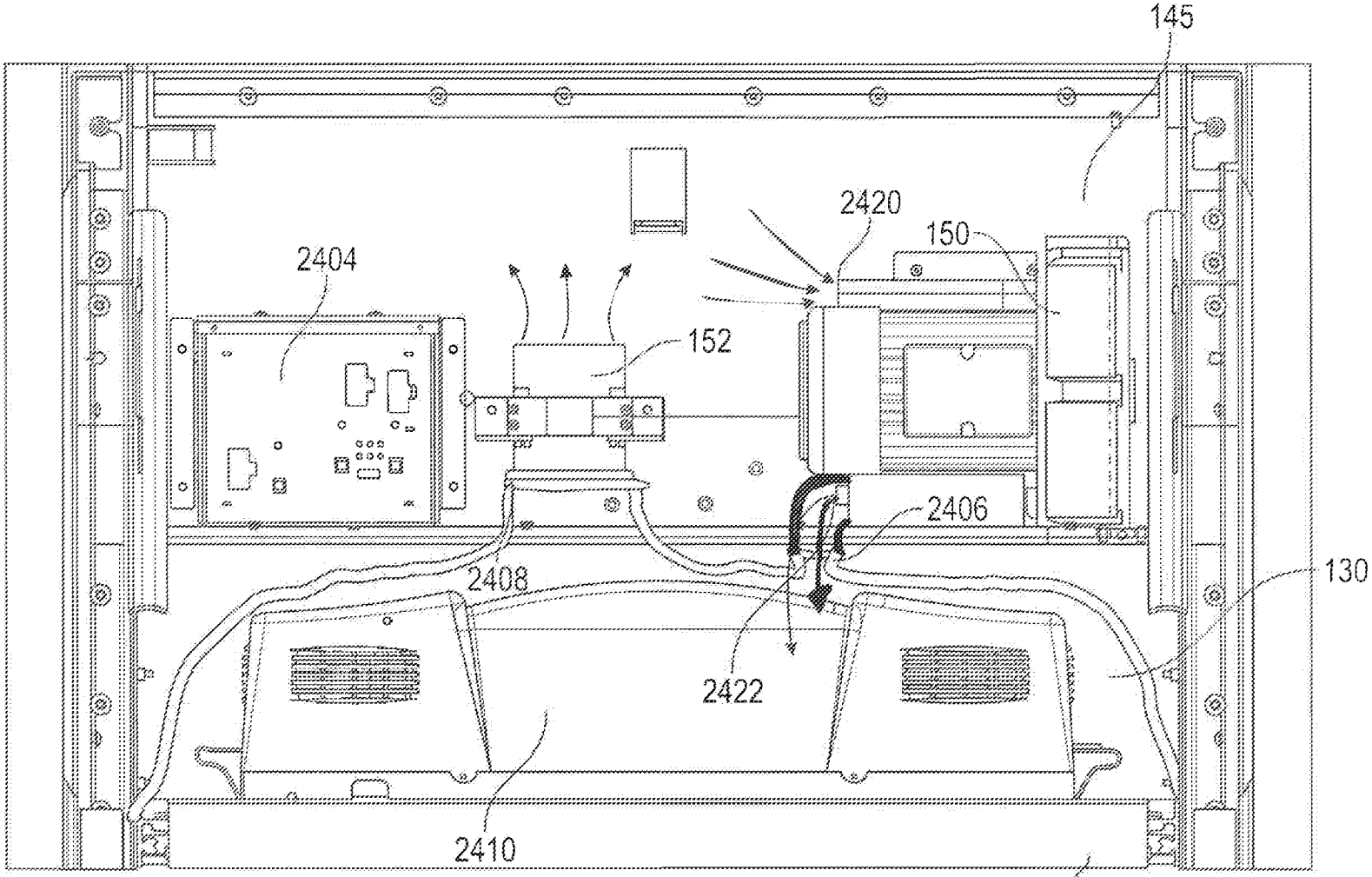
FIG. 24 is front view of an enclosure similar to FIG. 23. The connection points to the DAP bag for the blower and the valve are shown relative to the treadmill located within the DAP platform or base. The valve does not have a muffler. The DAP pressure source in this view is a regenerative pump with an intake and exhaust shown.

FIG. 24 is front view of an enclosure 145 similar to FIG. 23. The connection points to the DAP bag 130 for the blower 150 (e.g., regenerative centrifugal blower) (pump seal 2406) and the valve 152 (valve seal 2408) are shown relative to the treadmill 2410 located within the DAP platform or base 105. The valve 152 does not have a muffler. The DAP pressure source 150 in this view is a regenerative pump with an intake 2420 and exhaust 2422 shown.

Figure 25:
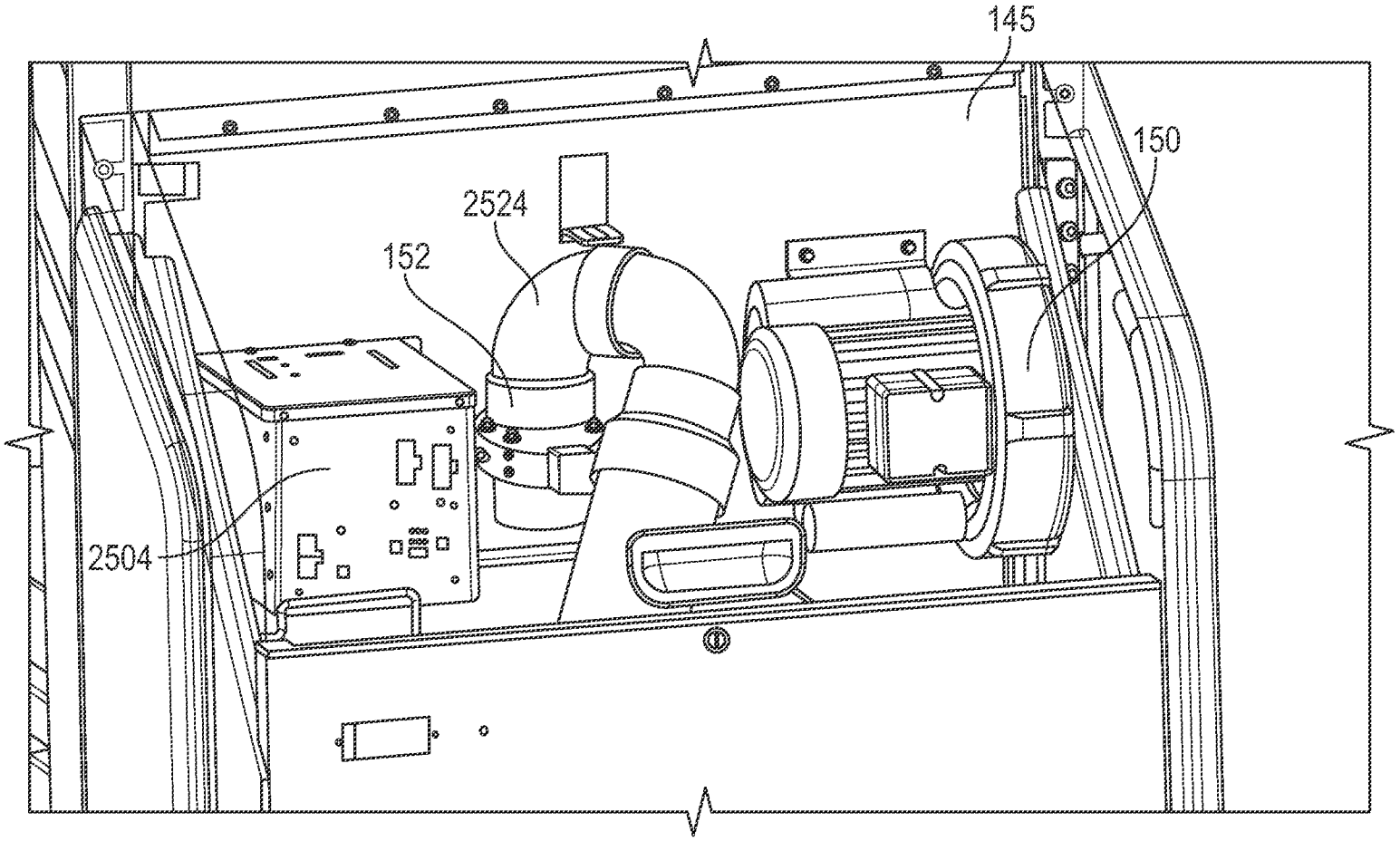
FIG. 25 is front view of an enclosure similar to FIG. 24. A muffler is shown attached to the valve outlet.

FIG. 25 is front view of an enclosure 145 similar to FIG. 24. A muffler 2524 is shown attached to the valve outlet. The pump 150 and electronics enclosure 2504 are also shown.

Figure 26A:
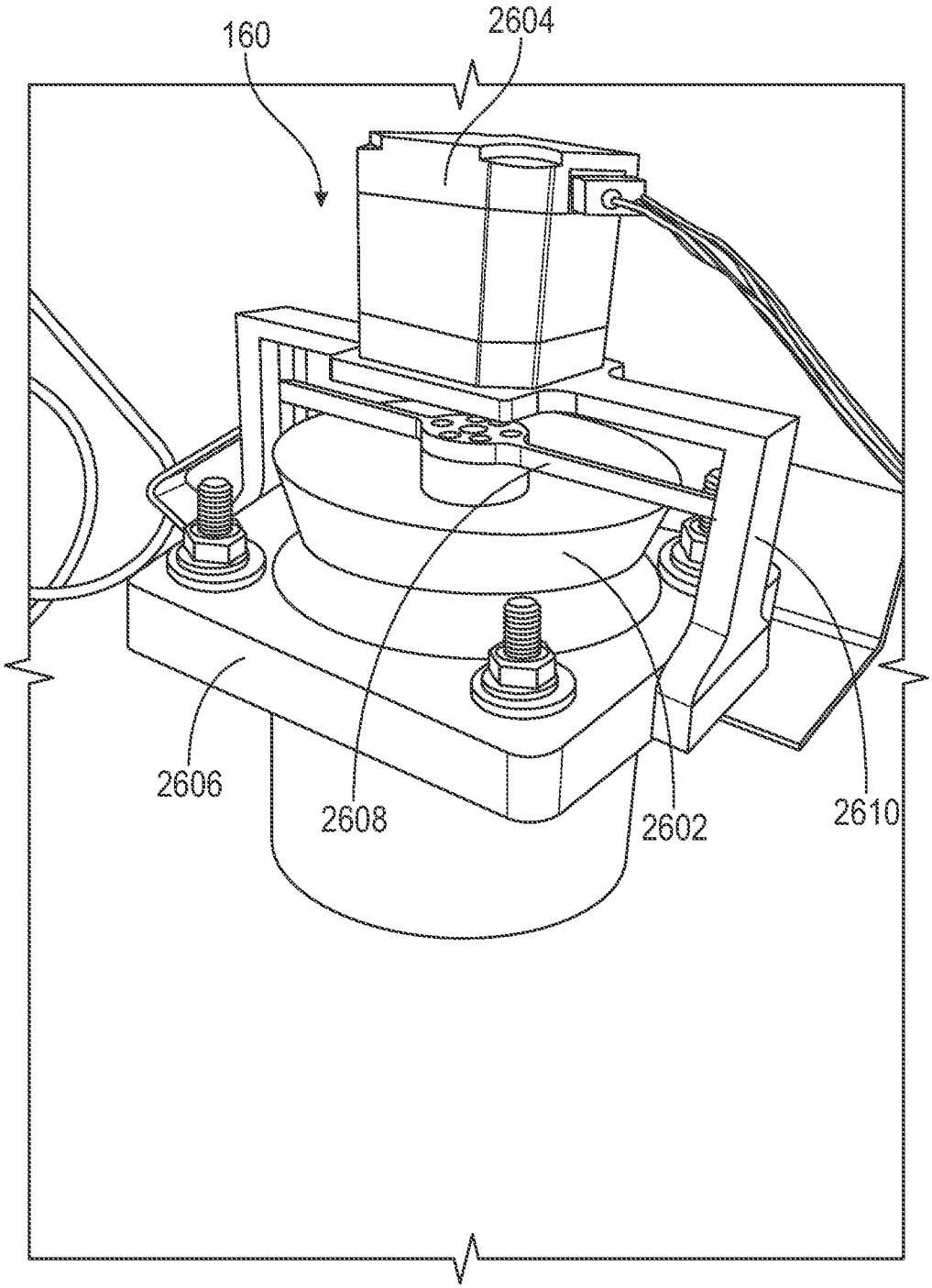
FIG. 26A is a perspective view of a prototype plunger valve adapted for use in a DAP control system.
Figure 26B:
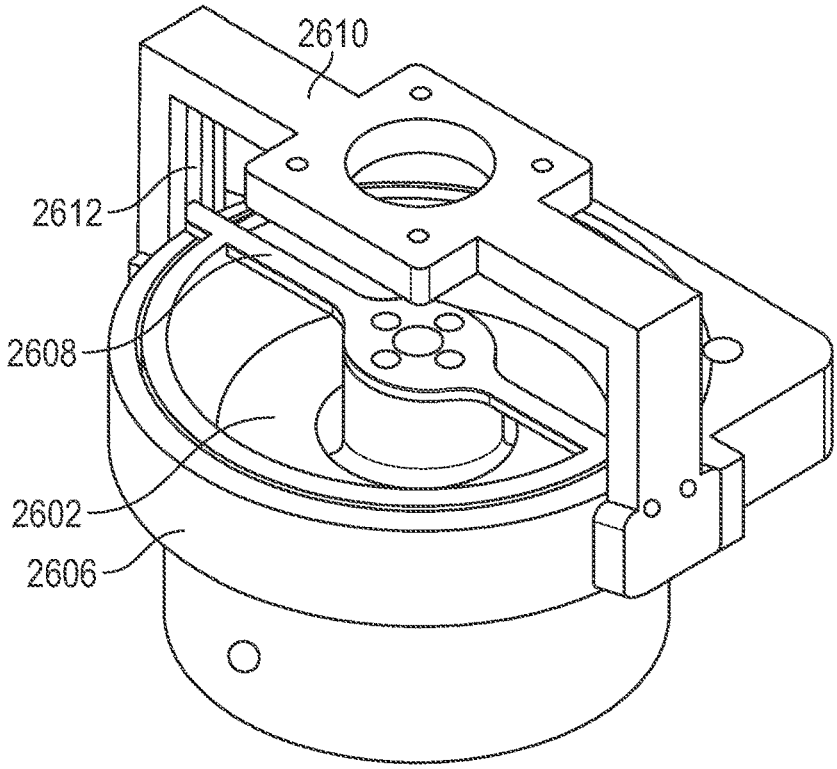
FIGS. 26B and 26C are perspective and exploded views respectively of a DAP plunger valve of FIG. 26A with the motor removed.
Figure 26C:
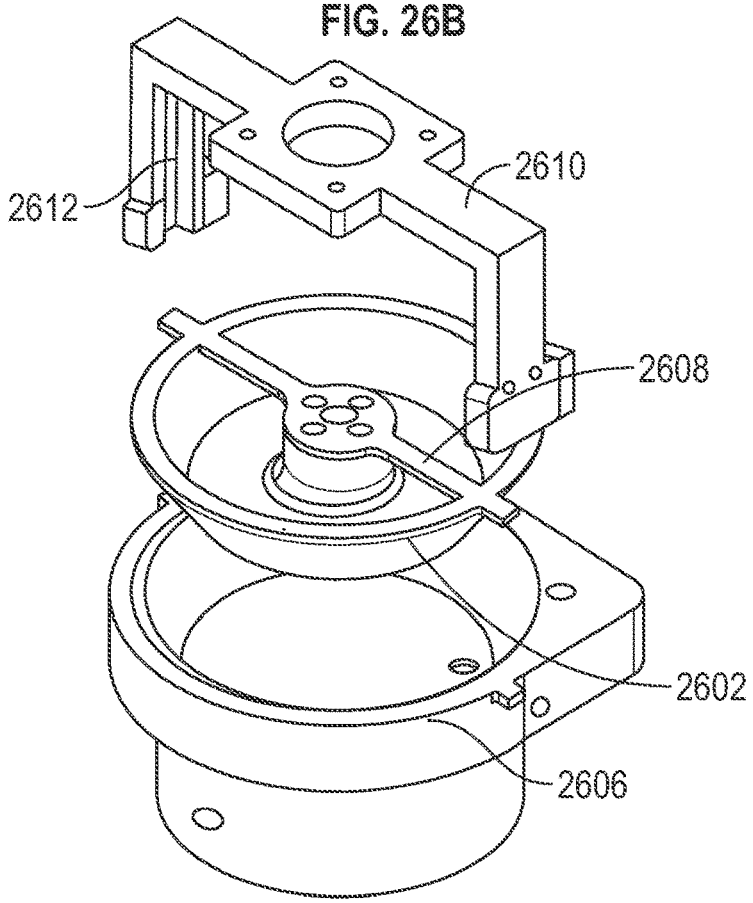

FIG. 26A is a perspective view of a prototype plunger valve 160 adapted for use in a DAP control system. FIG. 26A shows the drive motor 2604, the plunger 2602, the valve body 2606, the valve drive cross bar 2608, and the motor mount and guide 2610. FIGS. 26B and 26C are perspective and exploded views respectively of a DAP plunger valve 2602 of FIG. 26A with the motor 2604 removed. FIGS. 26B and 26C show the motor mount and guide 2610, the guide 2612, the valve drive cross bar 2608, the valve body 2606, and the plunger 2602.

FIG. 27A shows a $20^{th}$ percentile female standing on a DAP system. FIG. 27B shows a $80^{th}$ percentile male standing on a DAP system. FIG. 27C provides various details of male and female anthropomorphic data that may be used to determine the pre-set user inseam heights in various alternative DAP chamber configurations and for determining the range of travel for the bulkhead. FIG. 27A shows a $20^{th}$ percentile female standing on a DAP system. FIG. 27B shows a $80^{th}$ percentile male standing on a DAP system.

A new method of entering and sealing into a DAP chamber is provided as a result of the hinged cockpit frame. There is a method of providing a differential air pressure session for a user where the user first is stepping onto a first folded portion of a differential air pressure bag. Next, the user is stepping into a zippered opening in a top panel of the differential air pressure bag. Thereafter, the user will perform the step of moving the top panel of the differential air pressure bag about a hinge to bring the zippered opening into position for coupling to a zipper worn by the user. While the DAP chamber top panel is engaged with the chamber engagement elements on the left and the right arms, the user may perform the step of zipping the user worn seal into the zippered opening in the top panel.

Figure 28:
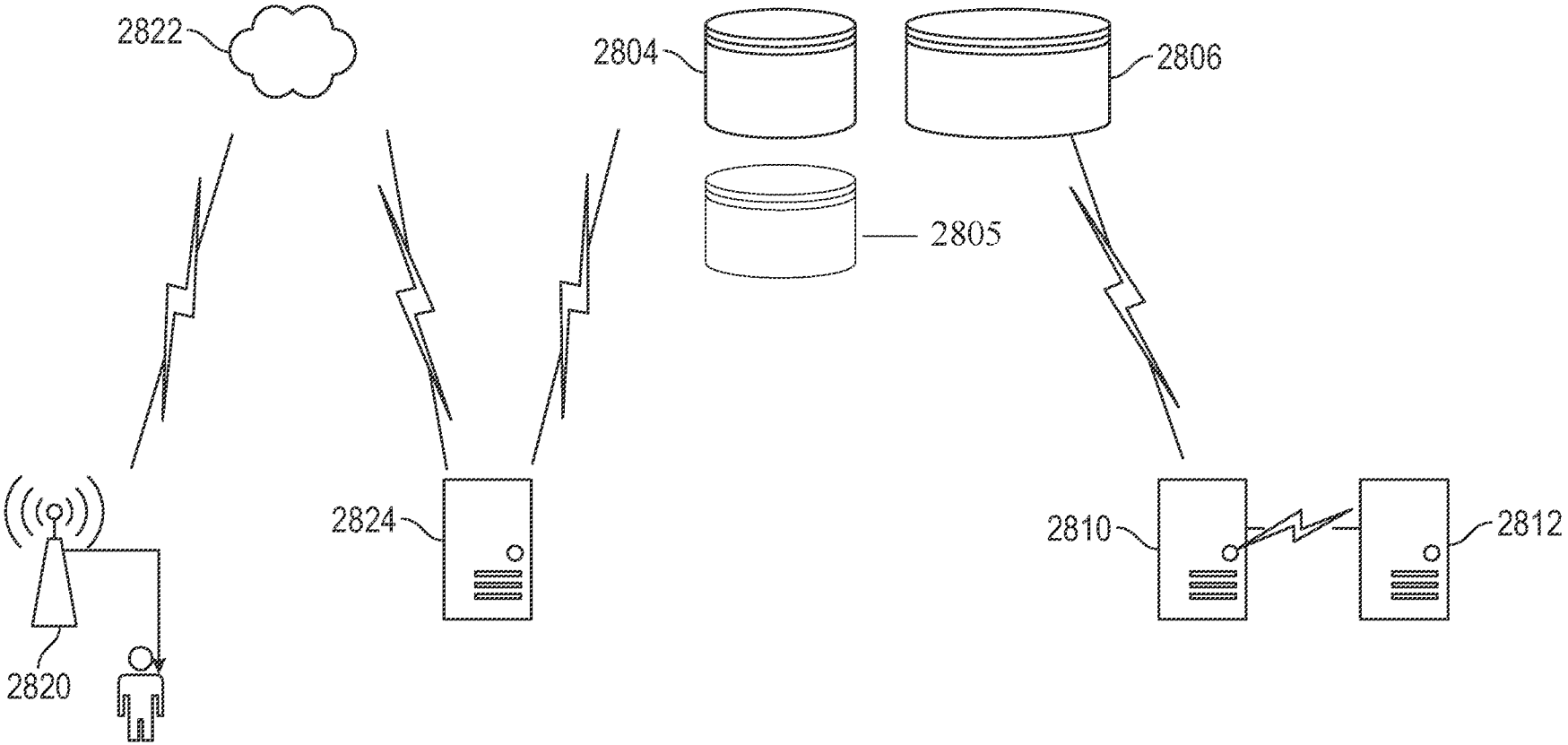
FIG. 28 is an exemplary connectivity and data base structure for use with DAP systems and related training.

FIG. 28 is an exemplary connectivity and data base structure for use with DAP systems and related training. FIG. 28 shows a customer portal (e.g., website) 2802 which includes a usage database (data) 2804 and an authentication database 2806 (email/password). A session database 2805 is also shown. Organization admin maintains access control to information. This includes audit trail of access (who/when) which and be data exportable. The authentication database 2806 is shown in communication with (ODBC/API) to a database 2810 (serial no. and customer) and can include invoicing. The database 2810 is shown in communication with a database 2812 including customer assets. A DAP system(s) 2820 at a customer site is also shown. The data may be accessed via a facility screen at the customer site. The DAP system(s) 2820 is shown in communication with to the cloud/internet 2822. Data can be encrypted in transit. A database and portal 2824 is also shown in communication with to the cloud/internet 2822 and to the usage database 2804. In one embodiment, a Bluetooth or other suitable wireless communications controller link is provided to allow remote access or control via a mobile device. The mobile device may be attached to the DAP system as shown in FIG. 28 or be separate from the DAP system.

Figure 29:
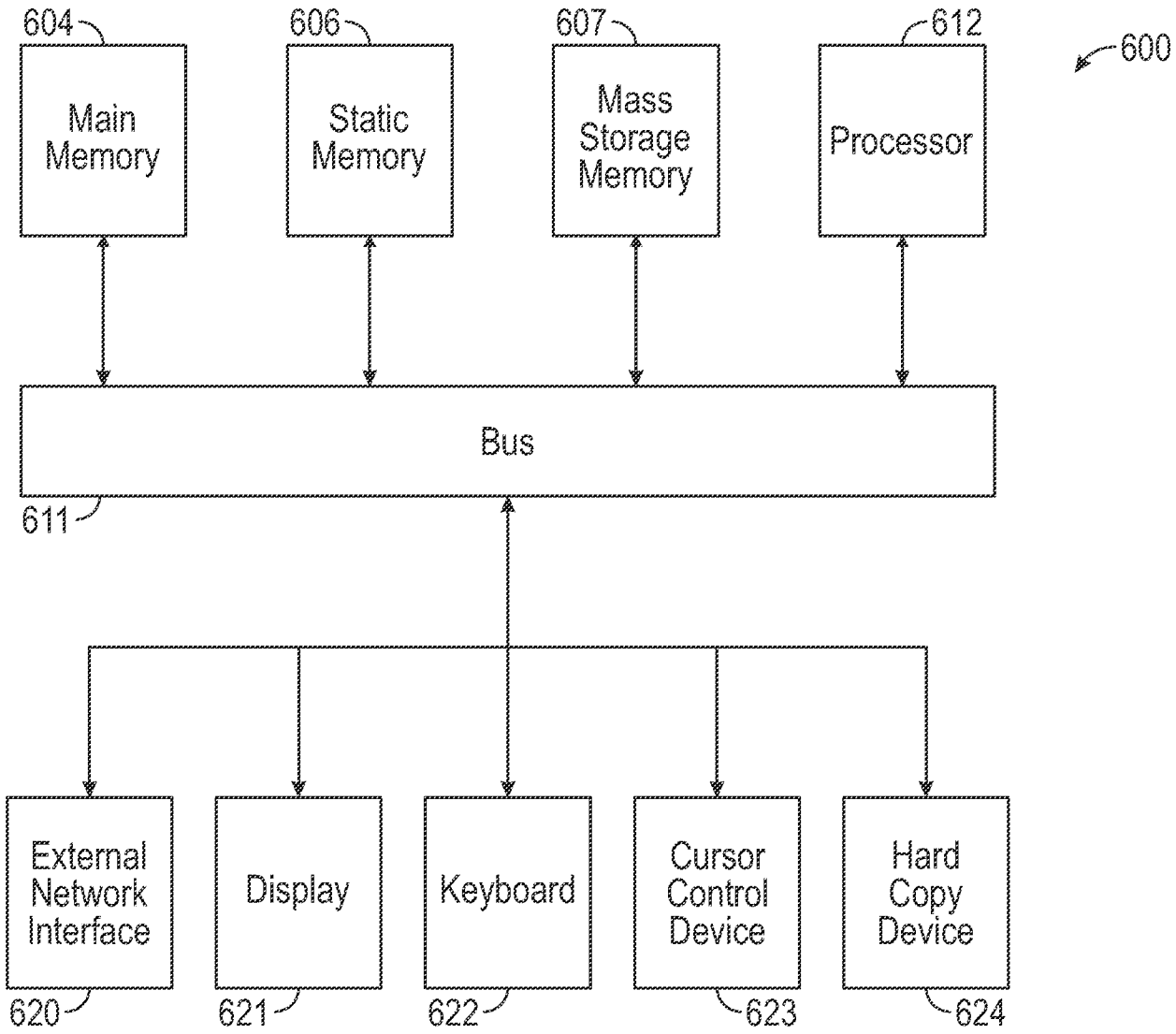
FIG. 29 is a schematic drawing of a representative computer controller for use in an unweighting system.

FIG. 29 is a schematic drawing of a representative computer controller for use in an unweighting system.

Figure 30:
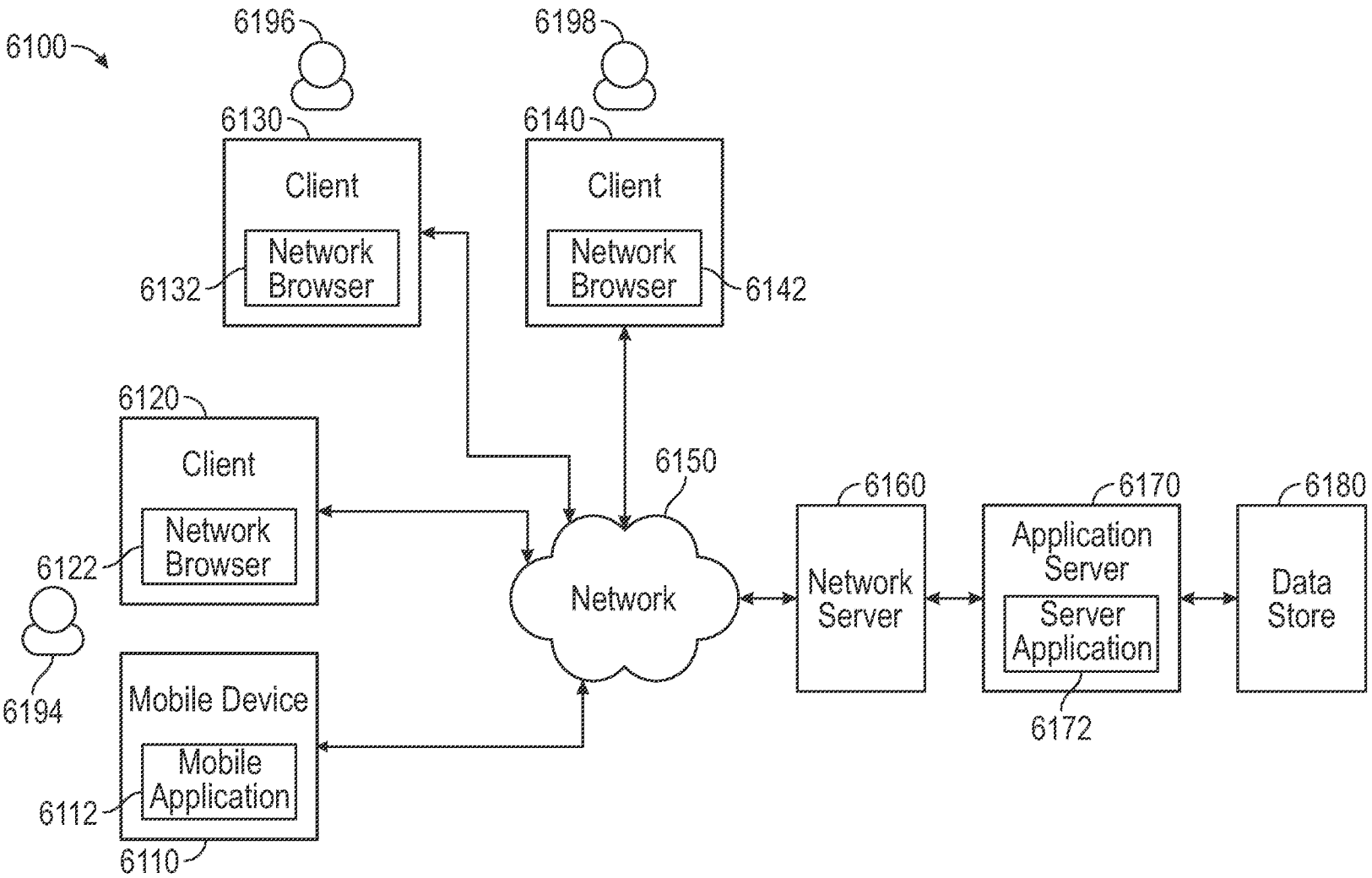
FIG. 30 illustrates a networked communications system to implement the various embodiments of cloud connected unweighting systems.

FIG. 30 illustrates a networked communications system to implement the various embodiments of cloud connected unweighting systems.

Figure 31:
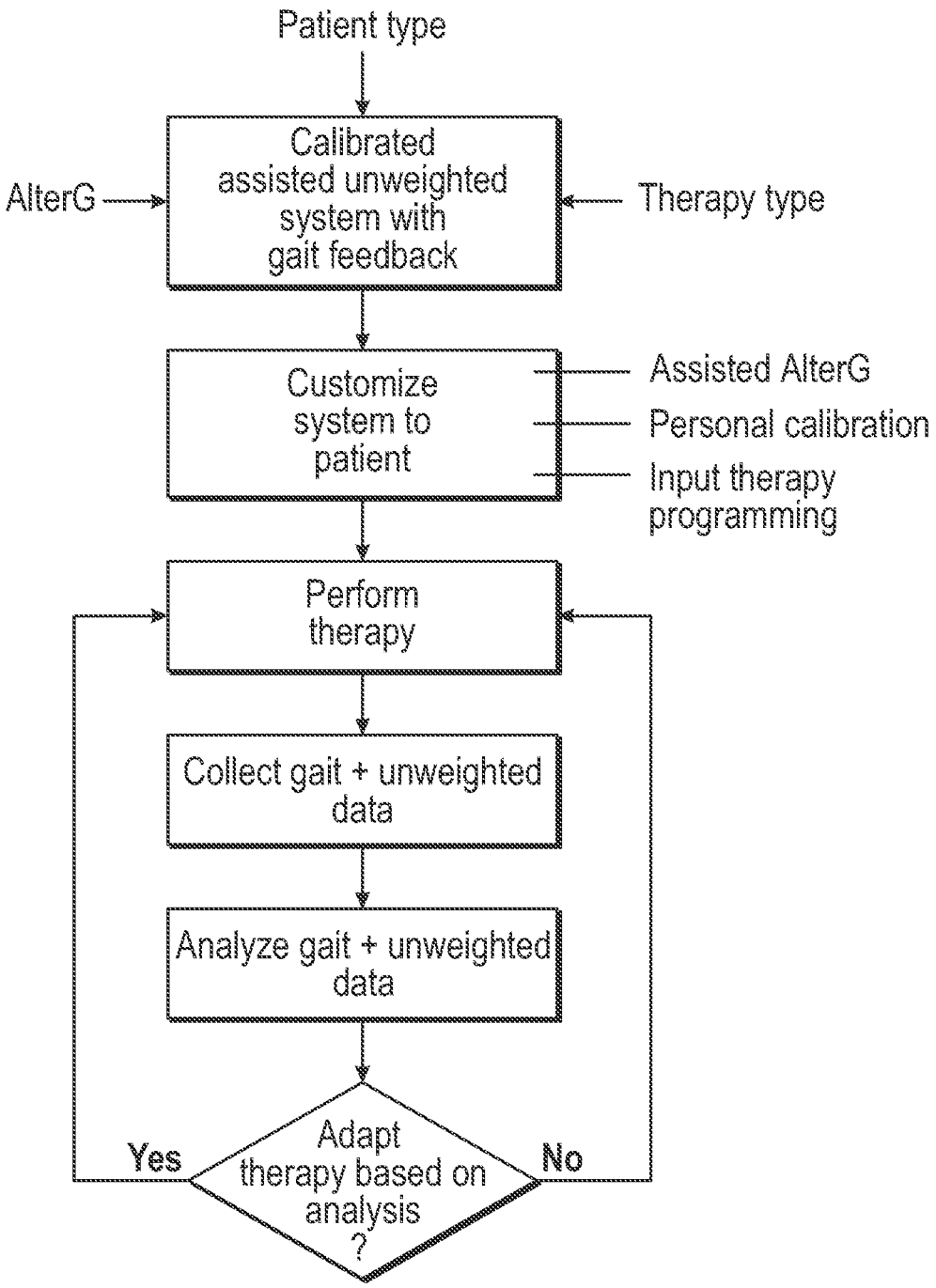
FIG. 31 is an exemplary method of providing unweighting therapy using an unweighting system having improved load cell utilization and unweighted gait parameters.

FIG. 31 is an exemplary method of providing unweighting therapy using an unweighting system having improved load cell utilization and unweighted gait parameters.

Figure 32:
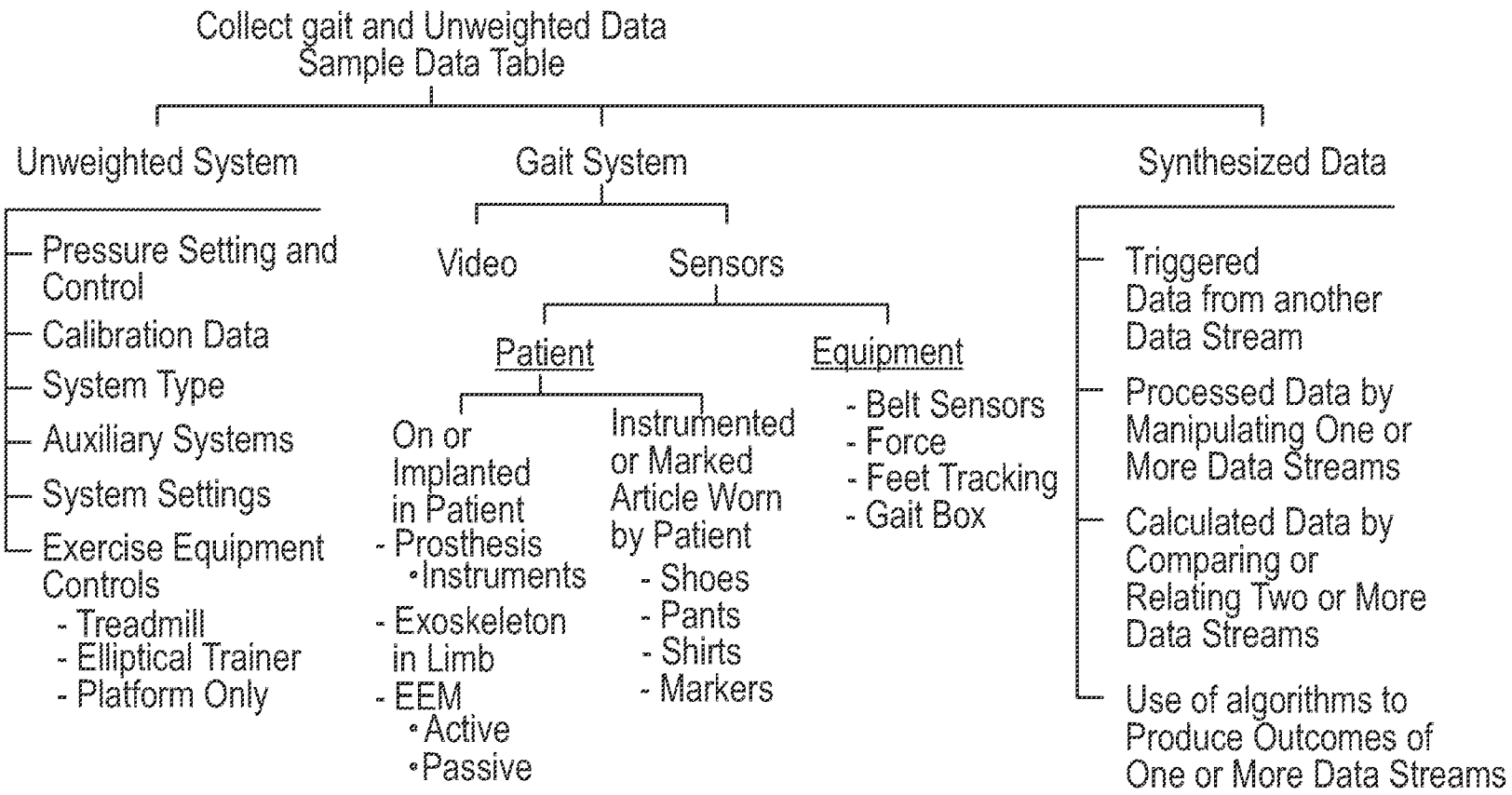
FIG. 32 is an exemplary data table showing the various data streams that may be collected and synthesized including those from pediatric users and including data based on improved unweighted load cell techniques for calibration, gait parameters, maximum unweighting level or gain adjusted unweighting load cells.

FIG. 32 is an exemplary data table showing the various data streams that may be collected and synthesized including those from pediatric users and including data based on improved unweighted load cell techniques for calibration, gait parameters, maximum unweighting level or gain adjusted unweighting load cells.

Exemplary Computer System

The DAP system described herein may have a display 103 coupled to an upright of the pair of uprights. Display 103 may be wireless and not connected to the DAP system as in FIGS. 1 and 2. Alternatively, a display 103 may be provided in an off center location to maintain a clear forward view field for a user. A display 103 in an off center position is shown in FIGS. 3, 5B, and 5C. Other display 103 configurations are possible. A display 103 may be positioned in a fixed central position coupled to an overhead structure as in FIGS. 4A and 4B. In this configuration, the display 103 remains in a fixed position relative to the uprights. Optionally, a display 103 may be positioned on and move along with the bulkhead 115. The display 103 may be in a central position between the left and right arm bases 117, 119 as best seen in FIG. 8B. In other embodiments, the display 103 coupled to the bulkhead 115 between the right arm and the left arm 116, 118. The display may be attached to a cross bar 170 that joins the tops of right and left uprights 111, 113.

FIG. 29 is a block diagram of an exemplary computer system 600 adapted and configured to perform one or more of the logic, control, data collection, software and hardware operations and the like described herein. These are exemplary of the various configurations of the display 103 and computer controller 146 and communications systems used in various embodiments. In some embodiments, the computer system also includes a software controlled gain adjustment for the load cells associated with an unweighting system. Still further, the computer system and electronic controls of an unweighting system may be adapted and configured to have computer readable instructions for implementing methods 1300 and 1400 described above. Still further, the computer system and electronic controls of an unweighting system may be adapted and configured to have computer readable instructions for controlling chamber pressure, treadmill speed, treadmill incline or other DAP system components according to factors and data obtained by performing the various steps of the methods 1300 and 1400 described above.

The computer system 600 may be adapted and configured using hardware, software, firmware in any combination, for example, to perform the various gait functions described herein as well as various other computer controlled and implemented methods. Additionally or optionally, the exemplary computer system 600 may also provide suitable electronic connections along with wired and wireless communication capabilities for direct and remote user interfaces, inputs and controls including touch screen, voice activated commands, remote control devices including those implemented using smart phones, tablets or mobile phones as well as other types of mobile graphical user interface devices. The computer system includes operating systems, software, firmware and communications for the use of the various user input devices described herein such as the touch screen interface, E-stop, user interface controls, interactive user interface and GUI display, touch button bar, as well as the various cameras and data recording devices.

The exemplary computer system 600 may comprise an exemplary client or server computer system. Computer system 600 comprises a communication mechanism or bus 611 for communicating information, and a processor 612 coupled with bus 611 for processing information. Processor 612 may in some variations be a microprocessor, but is not limited to a microprocessor.

System 600 further comprises a random access memory (RAM), or other dynamic storage device 604 (referred to as main memory) coupled to bus 611 for storing information and instructions to be executed by processor 612. Main memory 604 also may be used for storing temporary variables or other intermediate information during execution of instructions by processor 612.

Computer system 600 also comprises a read only memory (ROM) and/or other static storage device 606 coupled to bus 611 for storing static information and instructions for processor 612, and a data storage device 607, such as a magnetic disk or optical disk and its corresponding disk drive. Data storage device 607 is coupled to bus 611 for storing information and instructions.

Computer system 600 may further be coupled to a display device 621, such as a cathode ray tube (CRT) or liquid crystal display (LCD), coupled to bus 611 for displaying information to a computer user. An alphanumeric input device 622, including alphanumeric and other keys, may also be coupled to bus 611 for communicating information and command selections to processor 612. An additional user input device is cursor control 623, such as a mouse, trackball, trackpad, stylus, or cursor direction keys, coupled to bus 611 for communicating direction information and command selections to processor 612, and for controlling cursor movement on display 621.

Another device that may be coupled to bus 611 is hard copy device 624, which may be used for marking information on a medium such as paper, film, or similar types of media. Another device that may be coupled to bus 611 is a wired/wireless communication capability 625 to communication to a phone or handheld palm device, a LAN network, a remote network or a cloud based computer network or other distributed or shared computing and data storage system.

Note that any or all of the components of system 600 and associated hardware may be used in the inventive systems described herein. However, it can be appreciated that other configurations of the computer system 600 may include some or all of the devices. Certain variations of system 600 may include peripherals or components not illustrated in FIG. 29, e.g. components configured to receive different types of user input, such as audible input, or a touch sensor such as a touch screen.

Certain embodiments may be implemented as a computer program product that may include instructions stored on a machine-readable medium. These instructions may be used to program a general-purpose or special-purpose processor to perform the described operations. A machine-readable medium includes any mechanism for storing or transmitting information in a form (e.g., software, processing application) readable by a machine (e.g., a computer). The machine-readable medium may include, but is not limited to, magnetic storage medium (e.g., floppy diskette); optical storage medium (e.g., CD-ROM); magneto-optical storage medium; read-only memory (ROM); random-access memory (RAM); erasable programmable memory (e.g., EPROM and EEPROM); flash memory; electrical, optical, acoustical, or other form of propagated signal (e.g., carrier waves, infrared signals, digital signals, etc.); or another type of medium suitable for storing electronic instructions.

Additionally, some embodiments may be practiced in distributed computing environments where the machine-readable medium is stored on and/or executed by more than one computer system. In addition, the information transferred between computer systems may either be pulled or pushed across the communication medium connecting the computer systems.

The gait measurement methods, calibration and other unweighting system controls described herein along with digital processing device(s) described herein may include one or more general-purpose processing devices such as a microprocessor or central processing unit, a controller, or the like. Alternatively, the digital processing device may include one or more special-purpose processing devices such as a digital signal processor (DSP), an application specific integrated circuit (ASIC), a field programmable gate array (FPGA), or the like. In an alternative embodiment, for example, the digital processing device may be a network processor having multiple processors including a core unit and multiple microengines. Additionally, the digital processing device may include any combination of general-purpose processing device(s) and special-purpose processing device(s).

Networked System of Treadmill for Data Collection

A data collection and analysis system for use with unweighting systems is provided. Unweighting systems can be configured to capture data, such as a user's therapy history, goal, current condition, user type, age, medical history, etc. Analysis of an aggregate collection of such data from multiple users can allow an unweighting system or a therapist to generate a suggested treatment protocol or adapt a protocol already in use. Additionally, analysis of an aggregate collection of data can indicate whether certain assessments are indicated, such as a gait, balance, or concussion assessment. Such assessments collect data indicative of impairments from the user. This data can be compared against a normal threshold range, which can be generated from aggregate user data.

FIG. 30 is a block diagram of an exemplary networked computer system to implement the various embodiments of a cloud connected treadmill control system such as, for example, systems including a user and provider authentication structure enabling a medical professional supervising a patient session or an individual performing an unsupervised session. Additionally or optionally, the system includes the inventive security and data management system and methods to enable the use of the system as a medical professional, in a medical setting, where a patient record is being created or found within a cloud connected system where search functions and data transmission are central to functionality.

System 6100 of FIG. 30 includes mobile device 6110 and client device 6120 associated with user 6194, network 6150, network server 6160, application servers 6170, and data store 6180. The system of FIG. 61 also includes client 6130 for physician or healthcare provider 6196 and client 6140 for third party 6198. Though the discussion below may refer to a physician, a healthcare provider and a physical therapist are intended to be interchangeable for purposes of explaining the methods and systems disclosed herein.

In some embodiments, a method of unweighting system treatment management is provided. The method comprises providing a user's information, the information comprising at least two of the following characteristics: age, weight, gender, location, desired result, current medical condition, height, lift access requirements, therapist access requirements, therapy history, past workout information, and user type, wherein user type comprises at least one of an athlete, a casual user, a rehabilitation user, and a chronic user; analyzing, using a processor, the user's information based, at least in part, on aggregate information in a database comprising other users' characteristics and associated past workout session data including duration, speed, incline, and unweighting level used during workouts; and generating, using a processor, a suggested workout routine including duration, speed, incline, and unweighting level to be used during a workout based on the comparing of the user's information to the other users' information.

Mobile device 6110 may communicate with network 6150 via any suitable wired or wireless communication method and includes mobile application 6112. Mobile device 6110 may include an instrumented medical treadmill or an unweighting training system as described herein including mechanical unweighting systems and differential air pressure systems. Mobile device 6110 may receive input from a user and execute one or more programs to administer one or more tests, exercise routines, challenges, prescribed protocols, recommended protocols including unweighting therapy protocols and recommendations to a user, provide test results to application server 6170, and receive test set data, account data, and other data from application server 6170. The user may be a patient of a physician associated client 6130. The terms user and patient may be used interchangeably herein for purposes of explaining the operation of the system 6100. Mobile application 6112 resides in memory on mobile device 6110 and may be executed to allow a user to setup and login to an account with a network service, establish goals, get feedback, review and update or administer test results, and perform other functions related to unweighted therapy or gait evaluation or sharing of load cell based calibration data for one or more users.

Client device 6120 may include network browser 6122 and be implemented as a computing device, such as for example a laptop, tablet, mobile phone, smart phone, desktop, workstation, or some other suitable computing device. Network browser 6122 may be a client application for viewing content provided by an application server, such as application server 6170 via network server 6160 over network 6150.

Network 6150 may facilitate communication of data between different servers, devices and machines. The network may be implemented as a private network, cloud based network, distributed network, public network, intranet, the Internet, or a combination of these networks. Network server 6160 is connected to network 6150 and may receive and process requests received over network 6150. Network server 6160 may be implemented as one or more servers implementing a network service. When network 6150 is the Internet, network server 6160 may be implemented as one or more web servers. The network 150 may also be a cloud computing network.

Application server 6170 communicates with network server 6160 via network server 6160 and data store 6180. Application server 6170 may also communicate with other machines, wearable devices, biometric measurement devices and gait devices as described herein. Application server 6170 may host a server application 6172, and other software modules. Application server 6170 may be implemented as one server or multiple servers. Server application 6172 may reside on application server 6170 and may be executed to store, retrieve and transmit test set data, analyze test set results, and manage alerts.

Data store 6180 may be accessed by application server 6170. Data store 6170 may store data, process data, and return queries received from application server. Data stored on application data store 6180 may include user account data, user test data, user test results, analysis of the results such as trend data, and other data.

Clients 6130 and 6140 and network browsers 6132 and 6142 may be similar to client 6120 and network browser 6122, except that clients 6130 and 6140 may be associated with a physician and a third party, respectively, rather than a user (patient). Exemplary third parties include, for example, a drug company, a joint prosthesis company or manufacturer, a health care payer, an accountable care organization, an insurance company, a physical therapist, an athletic trainer or a hospital.

FIG. 31 is an exemplary method of providing therapy for patient using a differential pressure having measured gait feedback capabilities. The DAP systems described herein may be modified to include one or more of the below described features in addition to those features described above.

First, with an understanding of the different types of unweighting systems available, the patient type to use the system, and the desired therapy to be performed, select an appropriate system to perform therapy with a user. For example, focusing on DAP systems, a number of systems types for categories 1, 2 and 3 are provided in the '124 application. A category 1 system includes for example FIG. 2A of the '124 application. A category 2 system includes for example FIG. 7A of the '124 application. A category 3 system includes for example FIGS. 1A and 19 of the '124 application. A category 4 system includes for example FIG. 19A of the '307 Application.

Next, customize the system to this patient. Customization may take on many forms such as based on the specific type or configuration of the unweighting system being used, personal calibration techniques, or inputs of specific patient parameters, or protocols or patient specific training goals.

Next, the user performs the therapy in the system according to the input program or protocol.

Next, the system will collect gait and unweighting and other system parameters while therapy is ongoing.

Next, the system will analyze the collected data.

Next, determine whether to adapt the therapy based on the prior analysis step. One result of this step is to adapt the therapy and continue to perform the therapy as adapted. Another result is to continue to perform therapy without adapting the therapy based on the analysis.

One example of the format of a data table for an integrated differential air pressure and gait measuring and training device is shown in FIG. 32. This representative data system envisions collection and synthesis of data from several data streams depending upon the specific configuration of the system being used for therapy. The contents of FIG. 32 (i.e., the data table or variables collected, controlled, processed or manipulated by the control system) will vary to the degree needed to include collection of the various continuous, nearly continuous or segmented data streams including synthesized data from the therapy system. Additionally, the features of the DAP system detailed in FIG. 32 may also be modified to include the type, size or height of a chamber sealing member. Additionally or optionally, the specific configuration of the chamber arms used, including whether arms having raised, lowered, widened or narrowed characteristics are employed. Other specific aspects of the hinged chamber style DAP system may be included in order to ensure continuity of user training data and the specifics of DAP system type.

Simultaneous data collection refers to the general process of collecting data from multiple data streams under a common time stamp. It is to be appreciated that embodiments of the various inventive unweighting gait training systems described herein are adapted and configured for this purpose. However, the various inventive systems are also adapted and configured to synthesize the data that is being collected from the systems, subsystems, accessories, and sensors as shown in the exemplary data table (See FIG. 32). As used herein, synthesis of data refers to the integration of the independent data streams collected into another set of data or stream of data used in conjunction with the therapy or training undertaken in the system. Synthesis goes beyond basic data collection in that the data is put together to straight-forwardly assist the patient or therapist understand the workout from a quantitative standpoint. Data collection systems just record data, but do not take steps towards helping a patient or therapist who do not have training or experience with the direct data being collected. In one alternative, the type of data synthesis is derived from the type of patient receiving therapy and the specific system selected for his patient category (i.e., class 1, 2, 3 or 4). As such, the type of patient or system is one factor in determining the type of data synthesis needed for a specific patient therapy session or course of therapy. In still further alternatives, the data collected from one component is used to indicate the relevance of a subset of data from another source. In one specific example, there is a camera providing a high definition video stream of a post knee surgery patient's knee movement during therapy. The storage and later processing requirement for such a high volume of data may be a difficult and time consuming task. In one specific example of data synthesis, a force sensor on a treadmill is used to indicate heel strike and triggers the capture of a video stream that runs for a set time limit. In another specific embodiment, there is also a loop recorder used in conjunction with the high definition video stream. In this example, the heel strike sensor, employed in conjunction with a timing offset, is used to trigger the capture of a portion of the high definition stream in the loop just prior to the heel strike reading. Thereafter, the data stream is stored for an additional timing factor after heel strike. During the use of this data, the relevant portion of the video is now cut down to and synchronized with the recording or relevant trigger, here a heel strike reading in this example. In one example, the selective combination of heel strike data with video stream data to represent the collection of frame grab or snippet of unweighting and gait data. The data or data stream can be presented in real time, or packaged in a way to inform a doctor, therapist, shoe maker, etc. of the state of the patient.

In still other aspects of the various embodiments described herein, the system processor or controller of an integrated gait training system or the processor of a self-contained biometric sensor system contains computer readable instructions adapted and configured for storing, in a computer readable database stored within or accessible to the processor, the collected, synchronized or synthesized data of the unweighting system and the gait system. In some aspects, the collected, synchronized or synthesized data includes, depending upon system configuration and therapy performed data of one or more of: pressure setting and control, calibration data, system type, auxiliary systems, exercise system controls, video, user worn sensor or equipment sensor, synthesized data triggered from another data stream, synthesized data from processed data from manipulating one or more data streams, synthesized data calculated by comparing or relating two or more data streams, or, optionally, synthesized data obtained using algorithms to produce outcomes of one or more data streams. In still other aspects, collected, synchronized or synthesized data is displayed, output or provided to provide real-time feedback to a user of the system. In still further aspects, there are computer readable instructions for synthesizing the system by integration of independent data streams collected into another set of data or stream of data used in conjunction with the therapy or training performed using the system. In still other aspects, collected, synchronized or synthesized data is derived from the type of patient receiving therapy and the specific system selected for his patient category (i.e., class 1, 2 or 3). In some aspects, the type of patient or system is one factor in determining the type of data synthesis applied to a specific patient therapy session or course of therapy. In still other aspects, collected, synchronized or synthesized data from one component is used to indicate the relevance of a subset of data from another component or source. It is to be appreciated that the resulting data or data stream can be presented in real time, or packaged in a way to inform another person or system or process of the state of the patient.

In still other embodiments any of the above systems or methods are performed on cloud connected medical treadmill software system having a treadmill exercise system having a computer controller with a computer readable memory medium and computer controlling instructions within the memory; the computer readable memory medium containing one or more software applications having computer readable instructions for performing a function within the memory of the computer controller or via communication with a remote server to perform one or more of: authenticating a user to access patient information on a touch-screen interface in communication with the treadmill exercise system; searching for a particular patient using one or more patient search features adapted and configured for preventing the identification of other patients or users stored in the memory accessible to the treadmill exercise system or for preventing the display of protected health information of other patients or users.

In one aspect of the above embodiments performed using a medical treadmill system, one or more software applications is configured to collectively perform one or more of the steps of: establishing a patient profile; entering protected health information from the patient, searching for existing patient records with patient identification shielding, initiating an exercise therapy or diagnostic session with said patient; displaying real-time or near real-time treadmill metrics and analysis tools; or collecting treadmill session data and communicating to remote server.

In general, in one embodiment, an integrated differential air pressure assisted gait training system includes a differential air pressure system having a computer controller, at least one gait measurement or indication system in communication with the computer controller, and a computer readable database stored within or accessible to the computer controller comprising collected DAP system data from the differential air pressure system and gait system data from the at least one gait measurement or indication system This and other embodiments can include one or more of the following features. In one aspect, the DAP system data can include one or more of pressure setting and control, calibration data, system type, auxiliary systems, exercise system controls. In another aspect, the gait system data can include video, user worn sensor or equipment sensor. In a further aspect, the computer readable database can further include synthesized data from at least one of unweighted system data or gait system data. In an alternative aspect, the synthesized data can be triggered from another data stream. In still another aspect, the synthesized data can be processed data by manipulating one or more data streams. In one aspect, the synthesized data can be calculated data by comparing or relating two or more data streams. In another aspect, the synthesized data can include using algorithms to produce outcomes of one or more data streams. In a further aspect, can further include a display in communication with the computer controller adapted and can be configured to provide real-time feedback to a user of the differential air pressure system. In an alternative aspect, the system can further include video input in database. In yet another aspect, the video data stored can be collected based on a trigger from another component or device of the integrated system. In still another aspect, the database can be accessible to computer controller or accessible to the controller via wired or wireless communication. In one aspect, the system can include at least one gait measurement or indication system and can further include an enclosure, a pair of sensors supported by the enclosure and positioned such that when the enclosure is coupled to a treadmill of the integrated unweighting system a portion of the tread can be within the detectable range of the pair of sensors, and a processor supported by the enclosure and in communication with the pair of sensors and having computer readable instructions to receive and process an output from the pair of sensors and to perform calculations related to obtaining gait parameters based on the input from the sensors.

In general, in one embodiment, a method of training an individual to improve or alter walking or running mechanics by unweighting includes preparing the individual for training in a differential air pressure environment provided by a differential air pressure system, performing a training routine with the individual to improve or alter walking or running mechanics while the user is experiencing unweighting by the differential air pressure system, simultaneously measuring one or more of a user gait parameter or a user biomechanical parameter during the performing step, and collecting the one or more measured user gait parameter or measured user biomechanical parameter under instructions from a controller of the differential air pressure system.

In some embodiments, a method of using an unweighting system is provided. The method comprises downloading a workout routine to an unweighting system, the workout routine comprising a desired duration, speed, incline, and level of unweighting; identifying a user to the unweighting system; performing the workout routine; and recording performance data during the workout routine in the unweighting system. The method can further comprise connecting the unweighting system to a network. The method can further comprise uploading the performance data to the network. The method can further comprise providing user or therapist feedback to the unweighting system. User feedback can comprise feedback regarding at least one of satisfaction with the workout routine, overall mood and level of pain. Therapist feedback can comprise at least one of observations of the workout routine and rating of user progress. In some embodiments, identifying the user comprises providing user information or providing an identifier configured to access user information through the unweighting system. An appropriate workout routine can be selected based on user information. In some embodiments, the appropriate workout routine is selected based on reviewing past workout routines and performance data of other users sharing one or more user characteristics. The method can further comprise adjusting the downloaded workout routine. The method can further comprise sending performance data to at least one of a doctor, and insurance provider, and a patient file. The method can further comprise sending at least one of performance data, user feedback, and therapist feedback to an aggregate user database. In some embodiments, the method further comprises adjusting future unweighting workouts based on the performance data, user feedback, or technician feedback. The method can further comprise assessing user performance after a workout session to determine whether to modify workout parameters or scheduling.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Terminology used herein is for the purpose of describing particular embodiments only and is not intended to be limiting of the invention. For example, as used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be abbreviated as "/".

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed below could be termed a second feature/element, and similarly, a second feature/element discussed below could be termed a first feature/element without departing from the teachings of the present invention.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

In still other alternatives, the order in which various described method steps are performed may often be changed in alternative embodiments, and in other alternative embodiments one or more method steps may be skipped altogether. Optional features of various device and system embodiments may be included in some embodiments and not in others. Therefore, the foregoing description is provided primarily for exemplary purposes and should not be interpreted to limit the scope of the invention as it is set forth in the claims.

The examples and illustrations included herein show, by way of illustration and not of limitation, specific embodiments in which the subject matter may be practiced. As mentioned, other embodiments may be utilized and derived there from, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is, in fact, disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The invention claimed is:

1. A differential air pressure exercise system, comprising:
- a base;
- a pair of uprights on the base dividing the base into a front portion and a rear portion;
- a bulkhead extending between and vertically moveable relative to the pair of uprights;
- a right arm attached to the bulkhead extending from the bulkhead towards the rear portion of the base;
- a left arm attached to the bulkhead extending from the bulkhead towards the rear portion of the base;
- a chamber support frame coupling element on the right arm;
- a chamber support frame coupling element on the left arm;
- at least one hinge coupled to the bulkhead between the left arm and the right arm;
- a chamber support frame extending between the left arm and the right arm, the chamber support frame coupled to the at least one hinge to move between an engaged condition wherein a portion of the chamber support frame is coupled to the chamber support frame coupling element on the right arm and a portion of the chamber support frame is coupled to the chamber support frame coupling element on the left arm and a lowered condition wherein the chamber support frame is uncoupled from both the chamber support frame coupling element on the right arm and the chamber support frame coupling element on the left arm.

2. The system of claim 1 further comprising an enclosure adjacent the pair of uprights in the front portion of the base.

3. The system of claim 2 further comprising a computer controller and a differential air pressure source in the enclosure wherein an outlet of the differential air pressure source is coupled to an inlet in the differential air pressure chamber bag.

4. The system of claim 3 wherein the pump is one of a variable speed blower, a fixed speed pump, a variable speed pump, a centrifugal pump or a recirculating pump.

5. The system of claim 4 further comprising a valve with an inlet coupled to the differential air pressure chamber bag and an exhaust within the enclosure.

6. The system of claim 5 further comprising a muffler on a pump exhaust.

7. The system of claim 5 wherein the valve is a plunger valve or a butterfly valve under control of the computer controller.

8. The system of claim 3 wherein the differential air pressure source is a pump under control of the computer controller.

9. The system of claim 1 further comprising a differential air chamber bag that is at least partially conformable to the base, the differential air chamber bag having a left side panel, a right side panel, a rear panel and a top panel.

10. The system of claim 9 wherein the top panel further comprising an opening, and a set of loops sized to receive the chamber support frame wherein when the chamber support frame is within the set of loops on the top panel and the chamber support frame is in the lowered condition the rear panel is folded down and the opening is adjacent to a portion of the rear panel.

11. The system of claim 10 wherein the rear portion comprises a transparent portion.

12. The system of claim 9 wherein the top panel further comprising an opening, and a set of loops sized to receive the chamber support frame wherein when the chamber support frame is within the set of loops on the top panel and the chamber support frame is in the engaged condition the opening is between the right arm and the left arm.

13. The system of claim 9 wherein the top panel further comprising an opening, and a set of loops sized to receive the chamber support frame wherein when the chamber support frame is within the set of loops on the top panel the chamber support frame extends from the bulkhead along a right side of the top panel, along a left side of the top panel and only partially along a right side and a left side of the opening.

14. The system of claim 9 wherein the top panel further comprising an opening, and a set of loops sized to receive the chamber support frame wherein the chamber support frame is U-shaped with a bottom of the U-shape coupled to the at least one hinge and arms extending along and within the set of loops on the top panel wherein a portion of the opening extends beyond respective ends of the arms of the chamber support frame.

15. The system of claim 9 wherein the differential air chamber bag is sealed in the front portion and the rear portion.

16. The system of claim 1 wherein the support frame coupling element on the right arm and the left arm are magnets and the chamber support frame is made from a magnetic material.

17. The system of claim 1 wherein the support frame coupling element on the right arm and the left arm are made from a magnetic material and the chamber support frame further comprises one or more magnets to couple to coupling elements of the left arm and the right arm.

18. The system of claim 1 further comprising a display coupled to an upright of the pair of uprights or coupled to the bulkhead between the right arm and the left arm.

19. The system of claim 1 further comprising a treadmill within the base or an exercise platform within the base.

* * * * *